US005588784A

United States Patent [19]

Brandl et al.

[11] Patent Number: 5,588,784

[45] Date of Patent: Dec. 31, 1996

[54] SOIL OR ROCK NAIL WALL WITH OUTER FACE AND METHOD OF CONSTRUCTING THE SAME

[75] Inventors: Ernest D. Brandl, Houston, Tex.; David E. Weatherby, Potomac, Md.

[73] Assignee: Schnabel Foundation Company, Sterling, Va.

[21] Appl. No.: 485,276

[22] Filed: Jun. 7, 1995

[51] Int. Cl.[6] ..... E02D 5/20

[52] U.S. Cl. ..... 405/262

[58] Field of Search ..... 405/263, 284, 405/287, 285, 286, 258, 272, 273

[56] References Cited

U.S. PATENT DOCUMENTS

| | | |
|---|---|---|
| Re. 28,977 | 9/1976 | Mason . |
| 1,270,659 | 6/1918 | Ravier . |
| 1,739,108 | 12/1929 | Weber . |
| 1,747,038 | 2/1930 | Weber . |
| 1,761,614 | 6/1930 | Collier . |
| 1,762,343 | 6/1930 | Munster . |
| 1,909,980 | 5/1933 | Newman . |
| 1,933,483 | 10/1933 | Pennoyer . |
| 2,000,492 | 5/1935 | McKeen . |
| 2,045,112 | 6/1936 | Upson . |
| 2,110,253 | 3/1938 | Nedden . |
| 3,198,614 | 8/1965 | Powell . |

(List continued on next page.)

FOREIGN PATENT DOCUMENTS

| | | |
|---|---|---|
| 2233857 | 1/1975 | France . |
| 2917994 | 10/1980 | Germany . |
| 2102866 | 2/1983 | United Kingdom . |

OTHER PUBLICATIONS

"Soil and Rock Anchors", VSL Corporation Brochure, p. 9, Apr. 1978.

VSL Newsletter, p. 11, Nov. 1982.

Ivany Block® Promotional Materials, G. R. Ivany & Assoc. Inc., 14 sheets, Aug. 1983.

"Retaining Wall Proposal", Schnabel Foundation Co., Fed. Aid Project I35W-5(116)422, 10 sheets, Jun. 1989 and May 1993.

"Soil Nail Retaining Wall Details", Texas Dept. of Transportation Div. of Bridges and Structures, Fed. Aid Project I35W-5(116)422, 1 sheet, Mar. 1993.

"Precast Retaining Wall Panels Soil Nailed and Rock Nailed Wall", Texas Dept. of Transportation Div. of Bridges and Structures, Fed. Aid Project I35W-5(116)422, 2 sheets, Mar. 1993.

"Rock Nail Retaining Wall, Retaining Wall No. 9", Texas State Dept. of Highways and Public Transportation, Fed. Aid Project DPR 0114(001), 4 sheets, Jun. 22, 1992 and Nov. 19, 1993.

"Retaining Wall Details", Texas Dept. of Transportation Div. of Bridges and Structures, Fed. Aid Project No. CD 17-7-65, 1 sheet, Jul. 15, 1994.

"FHWA Soil Nail Wall Design Manual" (Draft Copy), by Golder Assoc., Chapter 4–Frost Loading, Oct. 4, 1994.

C. Louis, "New Support Method for Cut Slopes", Revue Travaux, Mar. 1981, pp. 67–75.

C. Louis, "Latest Devleopments In Soil Nailing", 1985.

*Primary Examiner*—Dennis L. Taylor

*Attorney, Agent, or Firm*—Banner & Allegretti, Ltd.

[57] ABSTRACT

A soil or rock nail retaining wall with an outer face is provided. A method of constructing such a wall is also set forth. A cut is excavated in successive sections to form exposed cut faces. The exposed cut face of each successively excavated section is temporarily supported with a temporary support means comprised of a nail installed through the exposed cut face into the ground. Shotcrete or a layer of barrier material may also be used in forming the temporary support means. Next, an outer face is formed. Facing elements are attached to the nail-supported cut via an isolated reinforced concrete closure. Formwork is used in placing the reinforced concrete closure. The reinforced concrete closure ties together the facing elements and the nail. Finally, free-draining granular backfill material, such as porous concrete, gravel or crushed rock, is placed along the remainder of the retaining wall between the exposed cut face and the facing elements.

66 Claims, 45 Drawing Sheets

U.S. PATENT DOCUMENTS

| | | | |
|---|---|---|---|
| 3,226,933 | 1/1966 | White . | |
| 3,243,963 | 4/1966 | Schnabel, Jr. . | |
| 3,250,075 | 5/1966 | Webb et al. . | |
| 3,412,562 | 11/1968 | Doughty . | |
| 3,438,207 | 4/1969 | Truzillo . | |
| 3,464,211 | 9/1969 | Andresen . | |
| 3,490,242 | 1/1970 | Schnabel, Jr. . | |
| 3,530,676 | 9/1970 | York . | |
| 3,541,798 | 11/1970 | Schnabel, Jr. . | |
| 3,555,830 | 1/1971 | York . | |
| 3,638,435 | 2/1972 | Mason . | |
| 3,802,204 | 4/1974 | Mason . | |
| 3,807,182 | 4/1974 | Schnabel, Jr. . | |
| 3,922,864 | 12/1975 | Hilfiker . | |
| 3,999,391 | 12/1976 | Meredith . | |
| 3,999,392 | 12/1976 | Fukushima et al. . | |
| 3,999,398 | 12/1976 | Kurose . | |
| 4,055,927 | 11/1977 | Tamaro | 52/577 |
| 4,106,225 | 8/1978 | Schnabel, Jr. | 37/184 |
| 4,117,686 | 10/1978 | Hilfiker | 405/284 |
| 4,124,983 | 11/1978 | Weatherby | 405/260 |
| 4,167,840 | 9/1979 | Ivany . | |
| 4,242,013 | 12/1980 | Watts | 405/272 |
| 4,318,637 | 3/1982 | Oger et al. | 405/153 |
| 4,343,572 | 8/1982 | Hilfiker | 405/284 |
| 4,369,004 | 1/1983 | Weatherby | 405/262 |
| 4,391,557 | 7/1983 | Hilfiker et al. | 405/287 |
| 4,407,611 | 10/1983 | Murray et al. | 405/284 |
| 4,426,176 | 1/1984 | Terada | 405/285 |
| 4,448,571 | 5/1984 | Eckels | 405/284 |
| 4,449,857 | 5/1984 | Davis | 405/286 |
| 4,470,728 | 9/1984 | Broadbent | 405/284 |
| 4,480,945 | 11/1984 | Schnabel, Jr. | 405/262 |
| 4,505,621 | 3/1985 | Hilfiker et al. | 405/284 |
| 4,514,113 | 4/1985 | Neumann | 405/286 |
| 4,561,804 | 12/1985 | Weatherby | 405/262 |
| 4,564,316 | 1/1986 | Hunziker | 405/262 |
| 4,653,962 | 3/1987 | McKittrick et al. . | |
| 4,718,791 | 1/1988 | Weatherby | 405/262 |
| 4,718,792 | 1/1988 | Louis | 405/262 |
| 4,732,510 | 3/1988 | Louis | 405/269 |
| 4,836,718 | 6/1989 | Deaton | 405/262 |
| 4,911,582 | 3/1990 | Peirce, Jr. et al. | 405/262 |
| 4,911,583 | 3/1990 | Carey | 405/262 |
| 4,913,594 | 4/1990 | Sigourney . | |
| 4,952,097 | 8/1990 | Kulchin | 405/262 |
| 4,961,673 | 10/1990 | Pagano et al. | 405/262 X |
| 5,002,436 | 3/1991 | Sigourney | 405/262 |
| 5,356,242 | 10/1994 | Elmore et al. . | |
| 5,395,185 | 3/1995 | Schnabel, Jr. . | |
| 5,505,563 | 4/1996 | Curt | 405/262 |

SOIL OR ROCK NAIL WALL WITH OUTER FACE AND METHOD OF CONSTRUCTING THE SAME

BACKGROUND OF THE INVENTION

1. Field Of the Invention

The present invention is directed to a retaining wall system. More particularly, the present invention is directed to a soil or rock nail retaining wall which includes a permanent outer face comprised of facing elements. A method of constructing such a retaining wall is also provided, including a method for connecting the soil or rock nails to the facing elements. The disclosed soil or rock nail wall and method are adapted for use with excavated cuts in many types of ground. The disclosed invention allows for the use of a permanent soil or rock nail wall in geographic locations where the ground freezes to significant depths and exerts pressure on the facing elements which apply additional loads to the soil or rock nails.

2. Description of the Prior Art

Tied Back Walls

One prior art method of supporting the sides of excavations is to use a tied back wall. A tied back wall utilizes a plurality of tiebacks. A tieback comprises a grouted anchor installed in the ground to secure a tendon which applies a force on the retaining wall. The tiebacks are anchored in the ground behind the wall and apply the force necessary to support the soil mass.

U.S. Pat. No. 4,561,804 shows one type of tied back wall. The exposed face of the soil is supported in part by vertically disposed sheet piles and either timber lagging or a layer of pneumatically applied concrete. The soil is then removed in descending stages until further support becomes necessary. At this point, tiebacks are installed through the sheet piles and into the ground. The tiebacks are then secured, tested and prestressed against the sheet piles. Excavation continues to the subgrade while lagging and, if required, more tiebacks are installed. A final layer of poured concrete is provided to form the finished, permanent retaining wall.

Other tied back wall systems are shown in U.S. Pat. Nos. 4,836,718 and 5,356,242. The disclosures of these patents provide a method for connecting soldier beams to precast panels. Both systems utilize a bulkhead or form system in conjunction with a cast-in-place concrete closure pour. However, both systems suffer from significant disadvantages. Most notably, both systems require the installation of vertical piles or soldier beams. Soldier beam installation is very costly and extremely difficult to accomplish in rock or rock-like ground formations. Further, neither system provides for the temporary support of the precast panels during construction of the wall. In addition, the configuration of U.S. Pat. No. 4,836,718 is somewhat disadvantageous because the bulkhead must be inflated. This system is thus extremely difficult to construct adjacent to an irregularly-shaped surface, such as an excavated cut face or an excavated cut face covered with a thin layer of pneumatically applied concrete.

Tied Back Element Walls (TE Wall)

A tied back element wall (TE wall) similarly uses a plurality of tiebacks. In a TE wall, the force necessary to support the side of an excavation is applied by prestressing the tiebacks against retaining elements disposed along the exposed face of the soil mass. The soil in front of the wall is excavated from the top down in successive sections. A layer or layers of pneumatically applied concrete is then applied to help support the exposed face of the excavated section of the soil. Retaining elements are next positioned along the exposed face of the soil or pneumatically applied concrete, and tiebacks are installed through the retaining elements and into the ground. Finally, the tiebacks are tested and prestressed against the retaining elements, and these steps repeated as needed until the entire wall is constructed.

Tied Back Element and Soil Nail Wall (TEN Wall)

A tied back element and soil nail wall (TEN wall) is a combination of a tied back element wall and a soil nail wall (soil nail walls are discussed in more detail below). A TEN wall is made up of a plurality of tiebacks, retaining wall elements and soil nails. This method utilizes short soil nails and pneumatically applied concrete to support a section of the soil to a certain excavated depth. At some point of the excavation, when further support becomes necessary to retain the soil, a row of tiebacks is added. By using the soil nails and pneumatically applied concrete as support between tiebacks, the wall uses both soil nails and tiebacks for support. In the TEN wall method, both the soil nails and the tiebacks form a part of the final retaining wall support structure. The ultimate strength of the retaining wall will thus depend on the strength of the soil nails and tiebacks themselves. An outer facing in addition to the pneumatically applied concrete is not used, and no further reinforcement is provided to the retaining wall structure.

A slightly different prior art retaining wall system is shown and described in U.S. Pat. No. 5,395,185. This system similarly utilizes soil nails, pneumatically applied concrete, and tiebacks, but also includes an outer face. The soil nails and pneumatically applied concrete are used to temporarily support the face of an excavated cut. Tiebacks are also installed, with their exposed ends extending a nominal distance from the face of the excavated cut. A permanent outer concrete facing is then poured and cured over the face of the excavated cut. After the concrete facing is applied, the tiebacks, via their exposed ends, are prestressed against the outer concrete facing. Because both tiebacks and soil nails must be used, this method is comparatively expensive. Also, with this method, the tiebacks either visibly protrude through the completed wall or the wall must be patched at each tieback location. In either case, the exposed face of the wall is unattractive.

Soil Nail Walls or Rock Nail Walls

Soil nailing is another method which is used to retain the ground adjacent to an excavated cut. In rock or rock-like ground formations, soil nailing may also be referred to as rock nailing. Soil or rock nailing is often preferred over the above-mentioned tied back and tied back element walls because soldier beams, timber lagging and numerous tiebacks are not required. This technique is thus less costly.

Soil nailing methods use untensioned tendons in grout-filled holes drilled into the ground behind a soil or rock cut. A soil nail system is shown in FIGS. 1 and 2. U.S. Pat. Nos. 3,638,435; 3,802,204 and Re. 28,977 are further exemplary of such soil nail systems.

As shown in FIGS. 1 and 2, in a soil nail wall, an array of nearly horizontal reinforcements, or soil nails 10, are installed in the soil mass as the excavation proceeds downwardly. A reinforced layer of pneumatically applied concrete 12 is used to support the exposed face of the cut between the soil nails 10. The pneumatically applied concrete 12 may be reinforced, for example, with a layer of welded wire reinforcing fabric 14.

During excavation, each lift is limited to a maximum depth at which the cut face is no longer self-supporting. A horizontal row of soil nails 10 is installed for additional support at this point. The soil nails 10 are essentially comprised of boreholes 8, grout 9 and nail tendons 10*a*. The boreholes 8 extend through the layer of pneumatically applied concrete 12 and into the ground adjacent the wall. The boreholes 8 are filled with grout 9, and nail tendons 10*a* are then installed in the holes 8 before the grout sets. One end of each nail tendon 10*a* extends outwardly from the skin to facilitate securing the tendon 10*a* to the outer wall, and each tendon 10*a* typically includes a bearing plate 10*b* and fastener 10*c*. Soil nails 10 and pneumatically applied concrete 12 are used to complete successively descending sections of the wall until the desired depth is reached as shown in FIG. 1. A concrete facing 16 is then applied. The concrete facing 16 is typically reinforced with horizontally and vertically disposed reinforcing steel 15. Also, prior art soil nail systems are often provided with drainage systems, such as drainage mats and weep holes.

In the prior art, the application of the concrete outer face 16 is accomplished using conventional means known to those of ordinary skill in the art. For example, pneumatically applied concrete may be used to form the entire outer face 16, or cast-in-place concrete may be formed and poured along the entire wall face 16. Each of these prior art methods suffers from certain drawbacks. The use of pneumatically applied concrete is disadvantageous because the face of the cut covered by the pneumatically applied concrete 12 is often irregularly shaped. This problem is particularly acute in rock or rock-like ground formations. Because a smooth, planar surface is not presented for pouring or blowing the outer face 16 against, additional concrete must be used to form the desired smooth, planar surface. Also, when cast-in-place concrete is used, the forming and pouring operations are highly labor intensive. Additional re-working of the cast-in-place concrete face is often required to repair imperfections in the formed surface caused by the placement of the forms or by improper pouring techniques.

A retaining wall system which uses rock nails is shown in FIGS. 3 and 4. This system is constructed in substantially the same manner as the soil nail systems described above, except it is constructed in a ground formation containing rock. Thus, rock nails 20 are used in cooperation with pneumatically applied concrete 22 instead of soil nails. Again, an outer face of cast-in-place concrete 26 is used to complete the retaining wall, resulting disadvantageously in a time- and labor-intensive process.

The above-described soil nail or rock nail systems utilize cast-in-place or pneumatically applied concrete to form the outer face. This is the most commonly used prior art configuration for soil nail or rock nail walls. However, it is known in the art to use prefabricated panels as the outer face. For example, U.S. Pat. No. 5,002,436 describes a retaining wall system which is comprised of a soil nail wall which is faced with precast concrete panels. The panels are connected to the exposed ends of the soil nails via an adjustable coupling means. Backfill, typically gravel or crushed rock, is then placed in the space between the exposed face of the cut and the panels. This configuration is disadvantageous in several respects. First, this method requires a sufficiently large distance between the layer of pneumatically applied concrete and the panel to allow for access by workers to make the mechanical connection from the nails to the panels. Second, the disclosed panel to soil nail connection significantly increases the overall cost of the retaining wall system. Finally, the panel to soil nail connection is embedded in backfill material and is thus prone to corrosion or deterioration from exposure to the environment.

This last disadvantage may be overcome somewhat by the prior art configuration shown in FIGS. 5 and 6. Rock nails or soil nails 30 and pneumatically applied concrete 32 are used to support the excavated cut as described above. When the desired depth of the excavation is reached, this system utilizes a facing comprised partially of cast-in-place concrete and partially of precast reinforced concrete. A plurality of precast concrete panels 36 are stacked alongside the wall at a distance from the pneumatically applied concrete facing. Each panel 36 is attached via a connecting means 36*a*, such as a strap and plate system, to a connecting rod (not shown) extending from the nail grout. As shown in FIG. 6, cast-in-place concrete 38 is used to complete the attachment of the precast concrete panels 36 to the rock nails or soil nails 30. The cast-in-place concrete 38 ties together the nails 30 along the cut face and the precast concrete panels 36 comprising the outer face. The exposed end 30*a* of the nail 30 may be bent upward, and extensive reinforcing steel 35 is employed in the area of the cast-in-place concrete 38. The remaining space between the precast concrete panels 36 and the pneumatically applied concrete layer 32 is filled with backfill material 39, such as gravel or crashed rock. In the prior art, the cast-in-place concrete 38 has been poured prior to the placement of the backfill material 39, with the cast-in-place concrete 38 and backfill 39 being separated by a crude bulkhead or form system. This bulkhead or form system has been constructed using plywood 37*a* and stakes 37*b*. The plywood 37*a* is individually cut and sized to span the gap between each respective facing element 36 and the layer of pneumatically applied concrete 32. A stake 37*b* is then drilled or driven into the ground, with the stake 37*b* positioned behind the plywood 37*a* to provide support.

While the system of FIGS. 5 and 6 provides protection from the environment for the connection of the panels 36 and the nails 30, it suffers from certain drawbacks. Initially, the disclosed cast-in-place concrete system necessitates time- and labor-intensive forming and pouring operations. First, the panels 36 must be supported sufficiently to resist the pressures exerted by the poured liquid concrete. Also, forms are required in the exposed area between the precast concrete panels 36. These forms are used to retain the cast-in-place concrete in place along its exposed face 38*a*. Because the liquid concrete exerts tremendous pressures on these forms when poured, the cast-in-place concrete must be placed in lifts. When the cast-in-place concrete is poured in this manner, seams in the concrete are formed between lifts. These seams present a discontinuous and unattractive outer surface along the exposed outer face 38*a*. Re-working of the exposed concrete face 38*a* will thus be required to remove imperfections in the finish and provide an acceptable appearance. In addition, since a portion of the ultimate outside facing is precast concrete 36 and a portion is cast-in-place concrete 38*a*, the color of the concrete will be dissimilar, requiring painting of all or a portion of the wall facing.

In addition, forms are also required at points between the precast concrete panels 36 and the pneumatically applied concrete 32 as shown in FIG. 6 at 37*a*. These forms 37*a* ensure that the poured liquid concrete 38 does not flow into areas which will later be filled with gravel or crushed rock backfill material 39. The forms 37*a* must be placed after erection of the precast concrete panels 36, which is often difficult because of the limited access to the space between the rear of the panels 36 and the layer of pneumatically applied concrete 32 disposed along the exposed cut face. Again, a bulkhead comprised of individually fitted plywood forms 37*a* and stakes 37*b* has been used in the prior art. However, this method has proven highly time- and labor-intensive because the distance from the back of the precast concrete panels 36 to the layer of pneumatically applied concrete 32 is not constant, but varies with the shape of the excavated cut face. Thus, each wood form 37*a* must be measured and cut to fit each individual panel 36 to face 32 connection. This process is time-consuming and tedious, and must be repeated at each column of nails along the face of the wall.

A further alternative prior art retaining wall system is shown in FIGS. 7 and 8. Once again, rock nails or soil nails 40 are used in conjunction with pneumatically applied concrete 42 in supporting the cut face while the excavation proceeds downwardly. Cast-in-place concrete 48 is also used to connect the precast concrete panels 46 to the rock nails or soil nails 40. In this regard, a connection means 43 is provided to attach the panels 46 to the cast-in-place concrete 48, which is itself attached to the nails 40. The connection means 43 may comprise anchors or loops. With this prior art construction, the entire outer face of the completed wall is comprised of precast concrete panels 46, and the entire space between the precast concrete panels 46 and the pneumatically applied concrete 42 skin is filled with cast-in-place concrete 48 and reinforced steel 45. No additional backfill material is used with this method. As noted above, since there is no reliable method for constructing the face of the pneumatically applied concrete 42 to close tolerances in the field, the space between the panels 46 and the skin 42 is typically variable, and is often quite large. Thus, extra reinforced cast-in-place concrete must undesirably be used to fill this space. This extra cast-in-place concrete serves no structural purpose, and merely leads to an increase in the expense of constructing the retaining wall. Additionally, the prior art does not provide a method for bracing the panels 46 during erection. Nor does the prior art provide for a method for supporting the panels 46 against the tremendous pressures exerted by the liquid concrete used in encasing the connection.

A still further alternative prior art retaining wall configuration is shown in FIGS. 9 and 10. This retaining wall system is similar to that described above with respect to FIGS. 7 and 8. Rock nails or soil nails 50 are again used in conjunction with pneumatically applied concrete 52 in supporting the cut face while the excavation proceeds downwardly. A connection means 53, such as anchor loops, is provided to facilitate the attachment of the precast concrete panels 56 to the rock nails or soil nails 50. Notably, as above, the prior art does not provide a method for bracing these panels 56 during erection, and a method for supporting the panels 56 against the tremendous pressures exerted by the liquid concrete used in encasing the connection is not provided. Nonetheless, with this prior art method, cast-in-place concrete 58, reinforcing steel 55 and the connection means 53 are used to connect the precast concrete panels 56 to the rock or soil nails 50. Additional backfill material 59, such as gravel or crushed rock, is used to fill the remainder of the open space between the panels 56 and the pneumatically applied concrete skin 52. However, the prior an fails entirely to disclose a form system or bulkhead 57 which would ensure that the poured concrete 58 does not flow into areas which will later be filled with the backfill material 59. Nor does the prior art teach a method for constructing such a form system or bulkhead 57 in the enclosed area behind the panels 56. Indeed, because the precast panels 56 are erected first, access to the area between the panels 56 and the layer of pneumatically applied concrete 52 is extremely limited. Placing detailed formwork in this area is thus difficult.

It can thus be seen that there is a need for an improved method of constructing a retaining wall with an outer face. In general, such a retaining wall system must be designed to overcome the disadvantages inherent in existing prior art retaining wall systems by providing a structurally sound retaining wall which is less costly to construct and which has an outer face which is ultimately pleasing to the eye. More particularly, there is a need for an effective retaining wall system which utilizes soil or rock nails in cooperation with outer facing elements.

Because soldier beams and tiebacks would not be required with such a wall, construction costs could be minimized. Further, unlike prior art walls with discontinuous and unattractive cast-in-place concrete outer faces, an outer face comprised entirely of facing elements would present an attractive surface which is ultimately pleasing to the eye.

In addition, careful application of any pneumatically applied concrete along the face of the cut would not be required since this layer of pneumatically applied concrete would be later covered by the facing elements. Elimination of the need for a smooth layer of pneumatically applied concrete is particularly attractive in rock or rock-like ground formations where the cut face is uneven and it is often difficult to apply such concrete evenly.

Further advantages could be attained by the existence of the space between the nail-supported excavated cut and the facing elements. An isolated cast-in-place concrete closure pour, bounded in part by the facing elements themselves, may be used in this space to further strengthen the wall and to encase the connection of the nails to the facing elements. The connection may thus be protected from corrosion caused by exposure to the environment. Also, if the facing elements and the excavated cut are separated, the remaining space between them may be filled with free draining backfill material. With such a configuration, an air space is created which prevents the ground formation from freezing and causing damage to the wall.

SUMMARY OF THE INVENTION

The present invention is directed to a soil nail or rock nail retaining wall with an outer face. A method of constructing such a wall is also provided. In accordance with the present invention, a cut is excavated in successive sections to form exposed cut faces. The exposed cut face of each successively excavated section is temporarily shored up with a temporary support means. The temporary support means is comprised of a plurality of nails installed through the exposed cut face into the ground. The temporary support means may also comprise a layer of pneumatically applied concrete. Alternatively, in rock or rock-like ground formations, a layer of barrier material, such as wire mesh, netting, or plastic, may form a part of the temporary support means.

The nail may be of any common type known to ordinarily skilled artisans, such as a soil nail or a rock nail. Suitable soil nails are illustrated in U.S. Pat. Nos. 3,638,435; 3,802,204 and Re. 28,977.

Similarly, if used, the pneumatically applied concrete may be of any common type known to those of ordinary skill in the art, such as shotcrete or gunite. The pneumatically applied concrete may also be reinforced in any conventional manner, such as by placement of welded wire mesh or steel re-bar, or by using fibers. Where the term shotcrete is used throughout this disclosure, it is intended to refer to any of these types of pneumatically applied concrete.

A first end of the nail extends outwardly from the exposed cut face. This end of the nail may be used to facilitate erection of the facing elements. The first end of the nail may include first and second bearing plates and first and second threaded fastening means, such that the first bearing plate and the first threaded fastening means may be tightened against either the exposed cut face or a layer of shotcrete disposed along the exposed cut face. As discussed below, if used, the second bearing plate and second threaded fastening means will be encased in the reinforced concrete closure pour to help tie together the nail and the facing elements. Alternatively, the first bearing plate may be provided with an embedment anchor means which will be encased in the reinforced concrete closure.

Once the temporary support means is in place, facing elements are set. An attachment means extends between the facing elements and the exposed cut face or the temporary support means. This attachment means provides support for the facing elements during erection.

A permanent connection is then formed. The permanent connection is comprised of an isolated reinforced concrete closure. The reinforced concrete closure may be comprised of reinforced cast-in-place concrete or reinforced pneumatically applied concrete (shotcrete). Respective members extending from the facing elements and the exposed ends of the soil nails are embedded in the reinforced concrete closure forming the permanent connection between the facing elements and the exposed cut face. Importantly, the attachment means not only provides support for the facing elements during erection, but the attachment means also resists the concrete pressures acting on the facing elements during placement of the reinforced concrete closure.

More specifically, a first attachment means having first and second ends is positioned adjacent to the exposed cut face. The first end of the first attachment means is secured to the exposed cut face. A first facing element is next erected and secured to the second end of the first attachment means, and second facing element is erected adjacent to the first facing element. The facing elements may be comprised of precast concrete. The facing elements may also be comprised of blocks, such as one or more reinforced masonry blocks or Ivany Blocks® as described in U.S. Pat. No. 4,167,840. A reinforced concrete closure is then utilized. Reinforced concrete is placed, i.e., poured or blown, along the area of the retaining wall adjacent to the first end of the nail. In this regard, reinforced concrete is placed between the exposed cut face and the first and second facing elements, or, if a layer of shotcrete is used as a part of the temporary support means, reinforced concrete is placed between the layer of shotcrete disposed along the exposed cut face and the first and second facing elements. The reinforced concrete thereby encases the first end of the nail. Finally, free-draining granular backfill material, such as gravel or crushed rock, is placed along the retaining wall between the exposed cut face or the layer of shotcrete disposed along the exposed cut face, the first and second facing elements, and adjacent reinforced concrete closures.

The first attachment means may take on a variety of different configurations. In one embodiment of the present invention, when a layer of shotcrete is not used, a first end of the first attachment means is secured directly to the exposed cut face, and a second end is attached to the first facing element. In another embodiment of the present invention, when a layer of shotcrete is used, a first end of the first attachment means is secured to the layer of shotcrete, and a second end is attached to the first facing element. In still another embodiment, the first end of the first attachment means is secured to the exposed cut face through the first end of the nail, and the second end is secured to the first facing element.

A second attachment means may also be used in constructing the retaining wall of the present invention. With this configuration, the first end of the second attachment means is secured to the temporary support means, and the second end of the second attachment means is secured to the second facing element. The second attachment means may be secured to the temporary support means through the first end of the nail.

First and second forms may also be positioned adjacent to the exposed cut face. Each of these first and second forms has a first end and a second end. The first ends of the first and second forms are secured to the exposed cut face or the layer of shotcrete disposed along the exposed cut face, and the second ends are positioned adjacent to the respective first or second facing element. Notably, the first form may serve as the first attachment means if the second end of the first form is secured to the first facing element. Also, both of the second ends of the first and second forms may be secured to the respective first or second facing element in one embodiment of the present invention. With this embodiment, the first and second forms are preferably flexible, such that they may be used regardless of the spacing between the facing elements and the exposed cut face or the layer of shotcrete disposed along the exposed cut face.

The first and second forms are arranged such that the reinforced concrete is placed only along the area of the retaining wall between the first and second forms. Thus, an isolated, or discrete, closure is formed when the reinforced concrete is placed between the first and second forms. More specifically, the reinforced concrete is placed adjacent to the first end of the nail in the area between the exposed cut face or the layer of shotcrete disposed along the exposed cut face, the first and second facing elements, and the first and second forms. Finally, backfill material is placed along the area of the retaining wall exterior of the first and second forms. The backfill material is placed in the area between the exposed cut face or the layer of shotcrete disposed along the exposed cut face and the first and second facing elements exterior of the first and second forms.

In one embodiment of the present invention, a third facing element, preferably formed of precast concrete or one or more masonry or Ivany Blocks® is erected adjacent to the first and second facing elements. This third facing element is secured between the first and second facing elements. The third facing element serves to complete the outer face of the retaining wall, and also conveniently provides a form for the reinforced concrete closure. The isolated reinforced concrete closure is formed when the reinforced concrete is placed along the area of the retaining wall between these first and second forms. Again, the reinforced concrete is placed adjacent to the first end of the nail between the exposed cut face or the layer of shotcrete disposed along the exposed cut face, the first, second and third facing elements, and the first and second forms. Backfill material completes the wall, and is placed between the exposed cut face or the layer of shotcrete disposed along the exposed cut face and the first and second facing elements exterior of the first and second forms.

Notably, the reinforced concrete may be placed prior to installation of the backfill material, or alternatively the backfill material may be installed first. This order of placement will be determined in accordance the configuration of the particular forms utilized. It is also possible to install the reinforced concrete and backfill material simultaneously with the added advantage that the pressure on the forms defining the reinforced concrete closure will be balanced.

The present invention provides for an improved method of constructing a retaining wall with an outer face. Because no tiebacks and soldier beams are required, this retaining wall system is less costly to construct, but yet is structurally sound. Further, because soldier beams need not be used, the retaining wall of the present invention is readily adapted for use with cuts formed in rock or rock-like ground formations. The present invention also provides corrosion protection for the soil nails utilized in constructing the wall. Unlike prior art systems which utilize exposed cast-in-place concrete outer surfaces, the retaining wall of the present invention uses exposed precast concrete facing elements which are attractive and pleasing to the eye.

The present invention also overcomes certain drawbacks of those prior art soil nail methods which utilize a cast-in-place concrete outer face to encase the exposed ends of the soil nails. Such cast-in-place concrete pours are extremely time- and labor-intensive, and typically require detailed formwork and re-finishing. By contrast, in accordance with the present invention, the facing elements themselves are used to conceal and isolate the reinforced concrete closure. Thus, detailed formwork along the ultimate outer face of the wall is not required. In addition, re-finishing and painting of a cast-in-place concrete surface is not necessary because the facing elements comprise the outer surface.

In addition, the present invention overcomes many of the disadvantages associated with prior art soil nail walls which utilized outer faces comprised of precast concrete. Through the use of an attachment means, the present invention provides a means for supporting the facing elements during erection and placement of the concrete closure. Also, the required formwork for the isolated reinforced concrete closure of the present invention may be positioned and installed prior to erection of the facing elements, thus eliminating the difficult task of custom-fitting the formwork into the variable gap between the back of the facing elements and the exposed cut face or the layer of shotcrete. Placement of the reinforcing steel is also simplified with the present invention since it too can be done prior to erection of the facing elements. Moreover, positioning of the facing elements is simplified because only the leading edge of each element must be attached to the exposed cut face for support during erection of the facing elements and placement of the concrete closure because the following edge is held in place by the previous facing element.

The present invention also draws on the inherent advantages of the space between the nail-supported excavated cut and the facing elements. An isolated reinforced concrete closure is used in this space to further strengthen the wall and to encase the connection of the nails to the facing elements. The permanent connection is thus protected from corrosion caused by exposure to the environment. Because the closure is isolated, inexpensive backfill material, such as gravel or crushed rock, may be used in between reinforced concrete closures, thus reducing the amount of concrete required. This backfill material provides the overall retaining wall system with good drainage capabilities.

Further, the use of the inexpensive backfill material is particularly advantageous in those irregular ground formations, such as rock or rock-like ground, where it is difficult to apply a layer of shotcrete smoothly along the exposed cut face. In these situations, the spacing between the facing elements and the exposed cut face or the layer of shotcrete along the cut face varies greatly, and is often quite large. Thus, it is desirable to fill this space with inexpensive backfill material, rather than concrete.

Also, the disclosed invention allows for the use of a permanent soil or rock nail wall in geographic locations where the ground freezes in winter and frost pressures could apply additional loads to the nails. The facing elements and the nail-supported excavated cut are separated, and the space between them which is not adjacent to the nail is filled with free draining backfill material. With this configuration, an air space is created which insulates the ground formation along the cut from the cold air temperatures. This insulation between the facing elements and the ground formation along the cut will prevent the ground formation from freezing and causing damage to the wall. This insulating effect may be further increased if one or more layers of insulation material is added to the back faces of the facing elements.

The present invention also presents numerous advantages over the construction method shown in U.S. Pat. No. 5,002,436. In particular, the connection of the facing elements to the soil nails and to one another is less complex and costly than that shown by U.S. Pat. No. 5,002,436. With this prior art method, the exposed end of the nail must be in precise alignment with the connection means in order to connect the nail to the facing elements. This requires careful positioning in the field. With the present invention, on the other hand, the exposed end of the nail must merely be placed in the general vicinity of the closure between adjacent facing elements. Stated differently, in the present invention, precise alignment of the nail in the field is not required because the nail must merely be placed somewhere within the general area defined by the reinforced concrete closure. Further, the facing element and soil nail connections of the present invention are advantageously embedded within reinforced concrete, and are thus protected from deterioration due to exposure to the environment.

BRIEF DESCRIPTION OF THE DRAWINGS

The novel features of the invention are set out with particularity in the appended claims, but the invention will be understood more fully and clearly from the following detailed description of preferred embodiments of the invention as set forth in the accompanying drawings, in which:

DETAILED DESCRIPTION OF THE INVENTION

Figure 1:
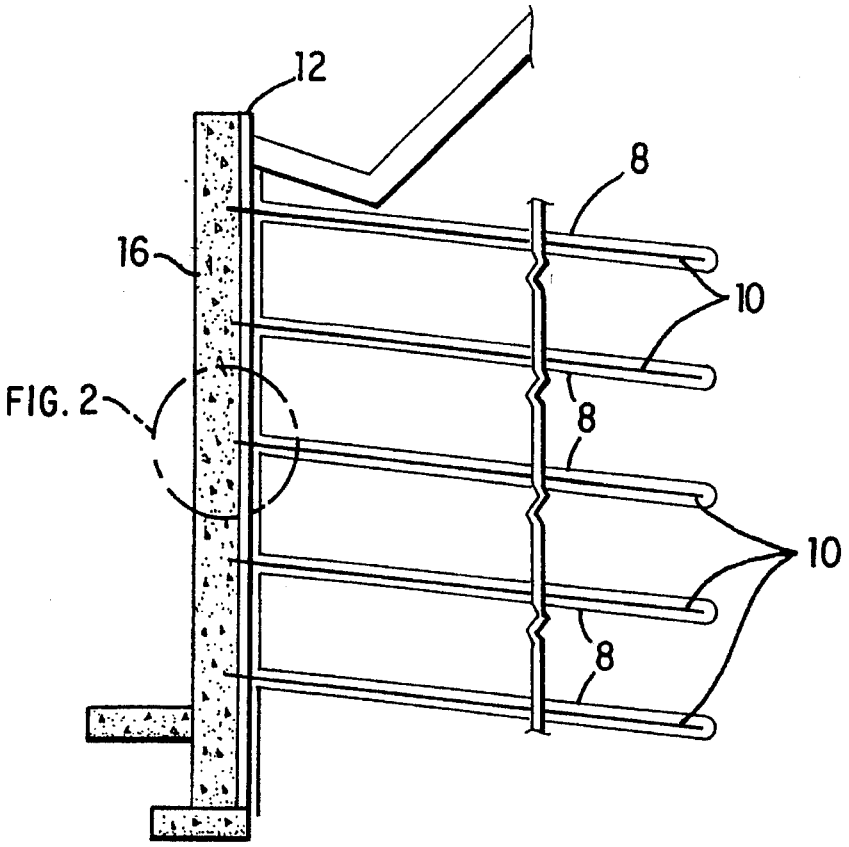
FIG.1 PRIOR ART
FIG. 1 is a sectional view of a prior art soil nail wall with a cast-in-place outer face.
Figure 2:
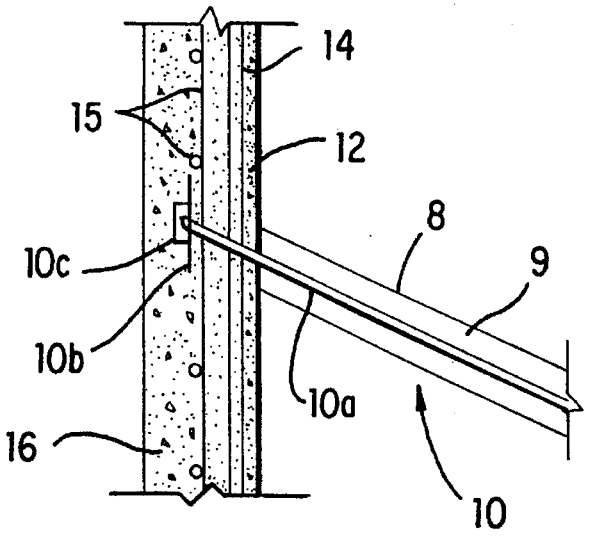
FIG.2 PRIOR ART
FIG. 2 is an enlarged partially broken-away sectional view of the prior art soil nail wall of FIG. 1.
Figure 3:
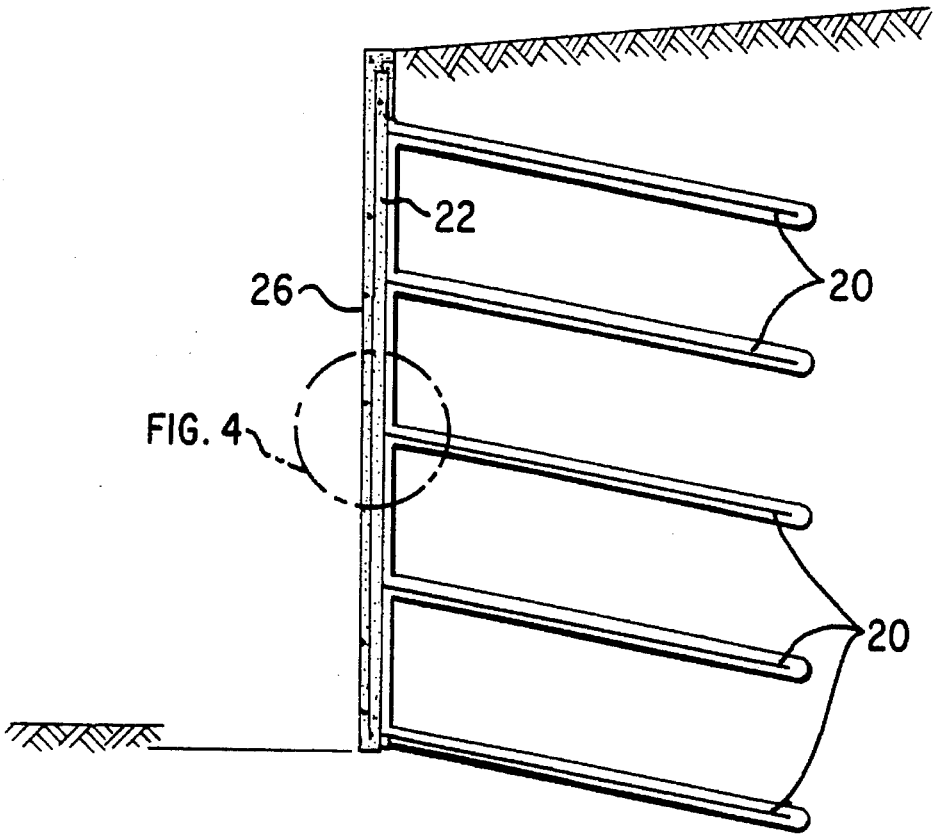
FIG. 3 PRIOR ART
FIG. 3 is a sectional view of a prior art rock nail wall with a cast-in-place outer face.
Figure 4:
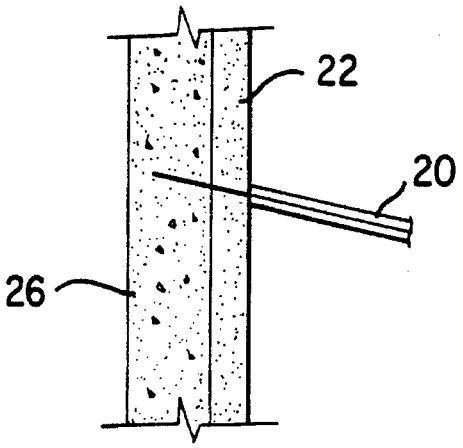
FIG. 4 PRIOR ART
FIG. 4 is an enlarged partially broken-away sectional view of the prior art rock nail wall of FIG. 3.
Figure 6:
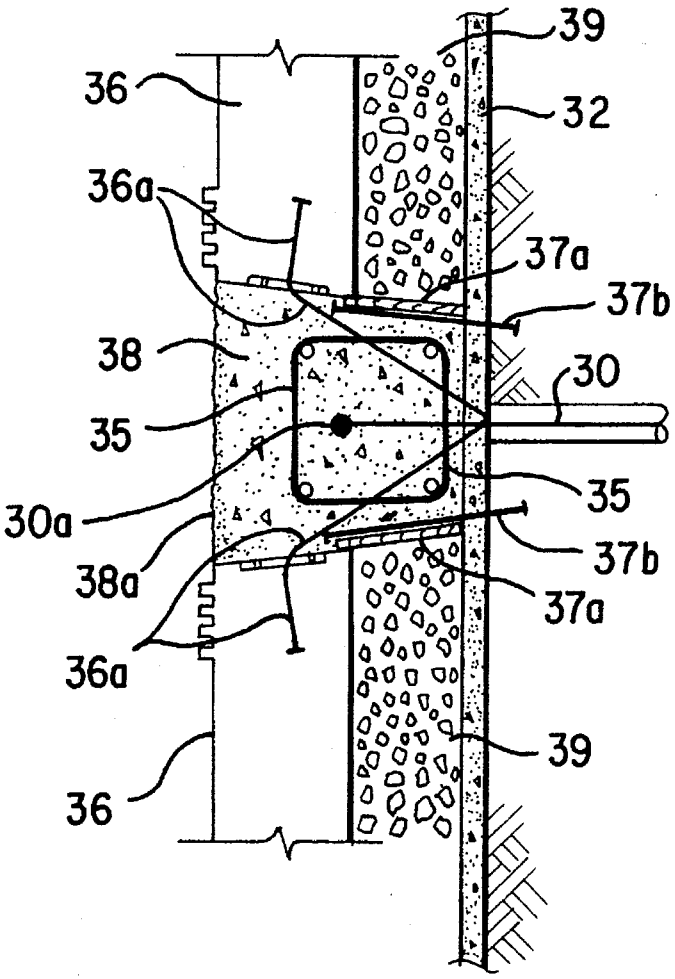
FIG. 6 PRIOR ART
FIG. 6 is a partial plan view of the portion of the prior art soil nail wall of FIG. 5 showing the cast-in-place concrete closure.
Figure 5:
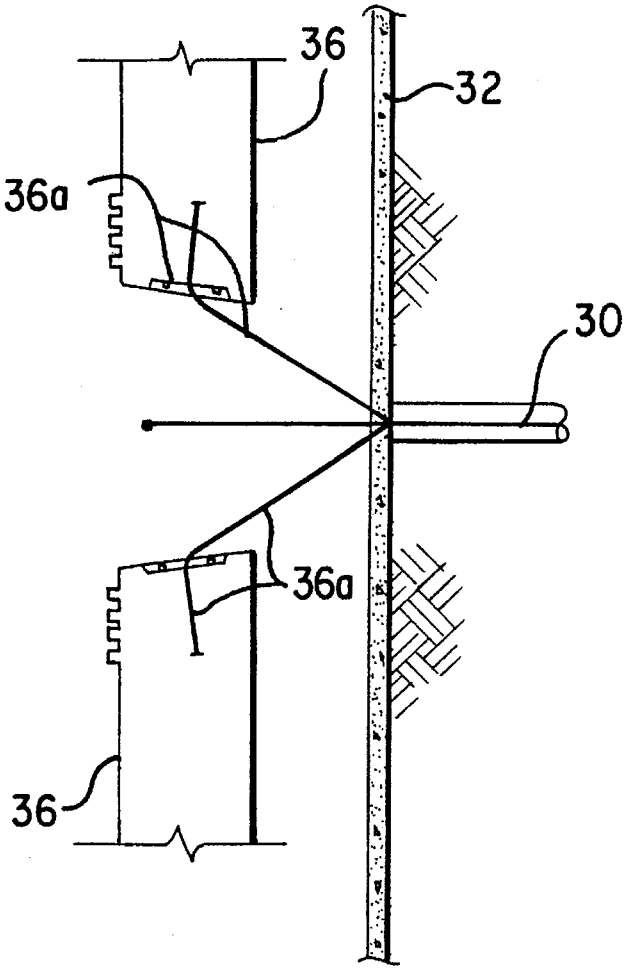
FIG. 5 PRIOR ART
FIG. 5 is a partial plan view of a portion of a prior art soil nail wall with precast facing panels.
Figure 7:
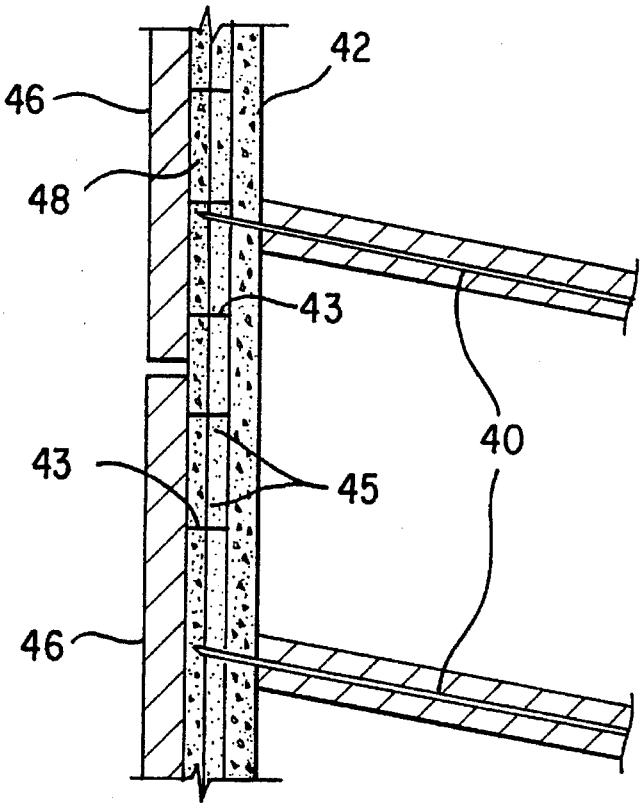
FIG. 7 PRIOR ART
FIG. 7 is a partially broken-away sectional view of an alternative prior art soil nail wall with segmental precast facing panels.
Figure 8:
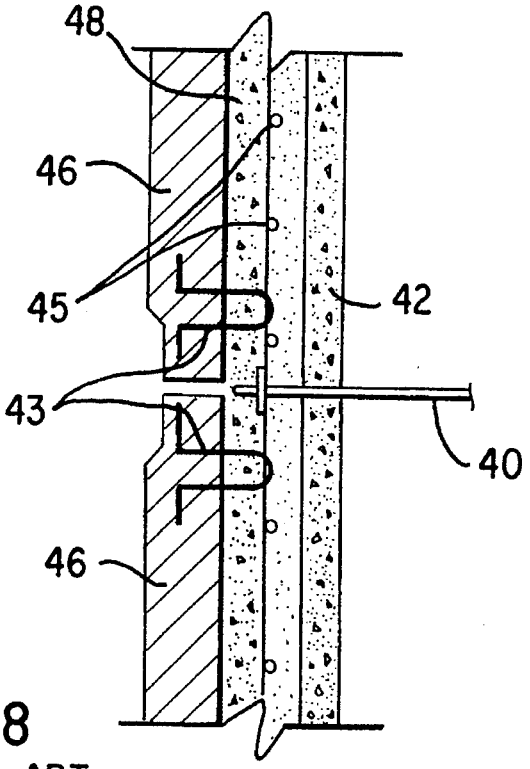
FIG. 8 PRIOR ART
FIG. 8 is a partial plan view of a portion of the prior art soil nail wall of FIG. 7.
Figure 9:
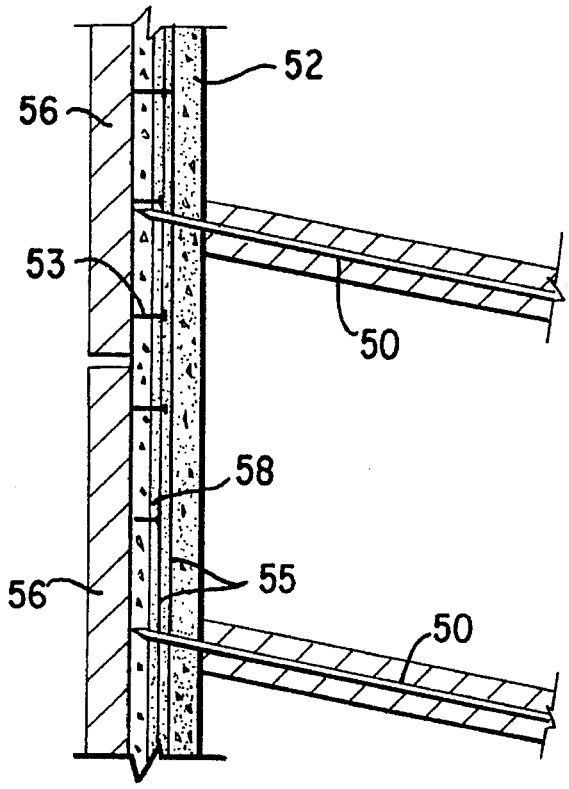
FIG. 9 PRIOR ART
FIG. 9 is a partially broken-away sectional view of a further alternative prior art soil nail wall with segmental precast facing panels.
Figure 10:
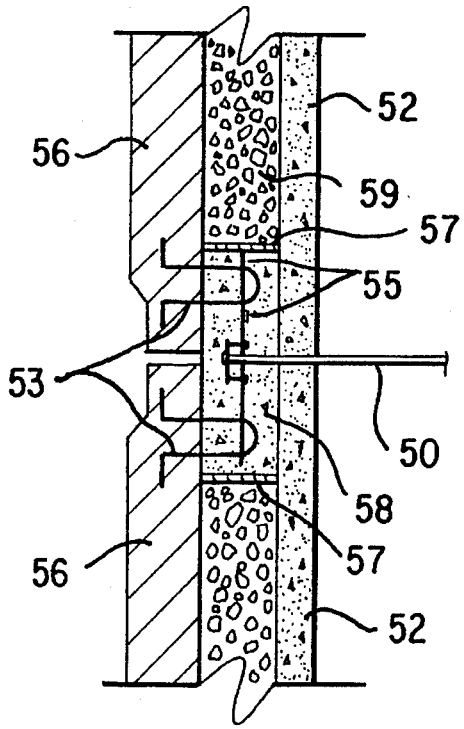
FIG. 10 PRIOR ART
FIG. 10 is a partial plan view of a portion of the prior art soil nail wall of FIG. 9.
Figure 11:
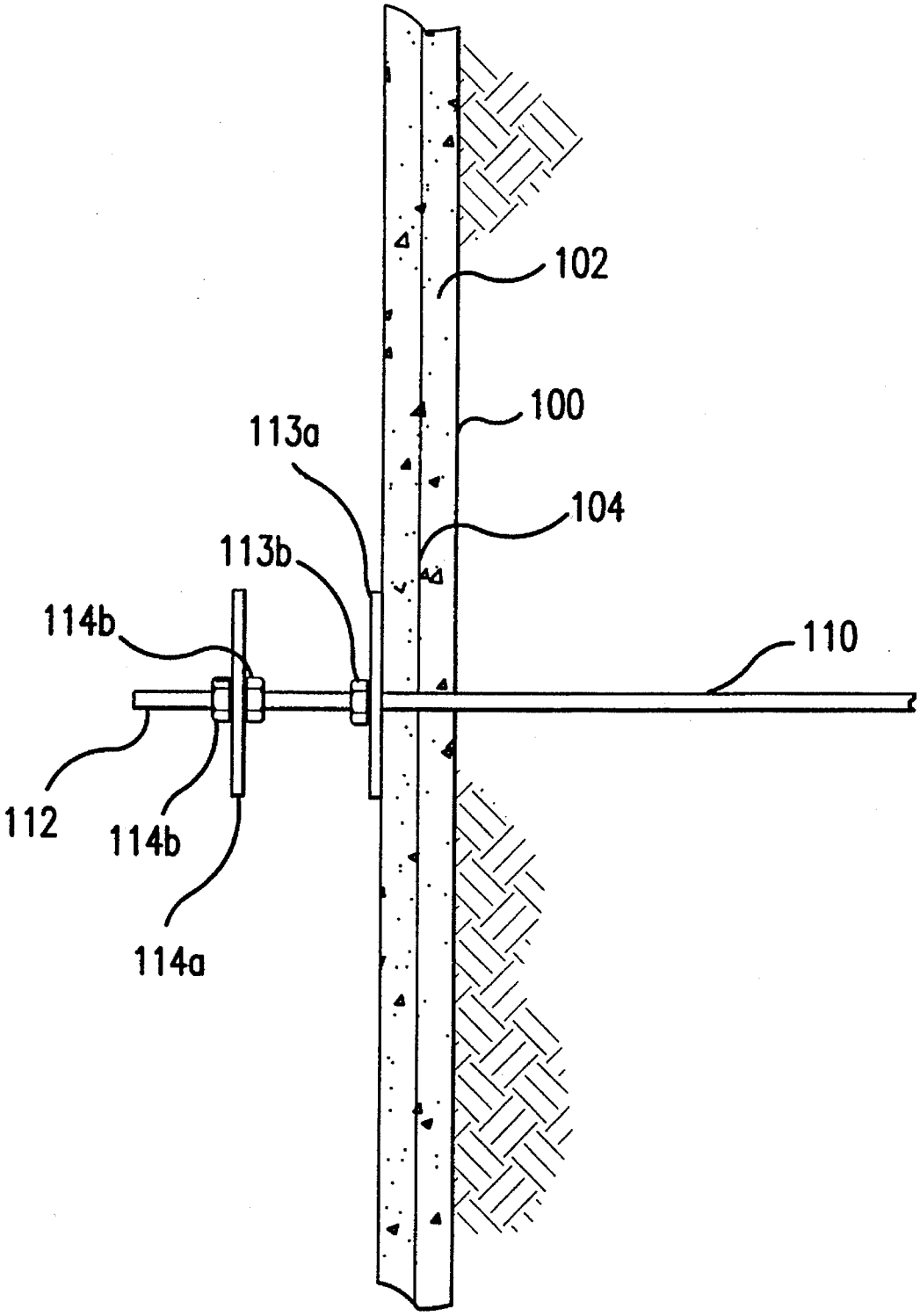
FIG. 11 is a partial plan view of a step in the construction of a first embodiment of the retaining wall of the present invention.

The present invention provides a soil nail or rock nail retaining wall with an outer face. In accordance with the present invention, a cut is excavated in successive sections to form exposed cut faces. As shown in FIG. 11, the exposed cut face 100 of each successively excavated section is temporarily shored up with a temporary support means. The temporary support means is comprised of a nail 110 installed through the exposed cut face 100 into the ground. The nail 110 is of any common type known to ordinarily skilled artisans, such as a soil nail or a rock nail. Suitable nails are described in U.S. Pat. Nos. 3,638,435; 3,802,204 and Re. 28,977. The nail 110 is grouted into a borehole formed in the soil or rock ground formation. A first end 112 of the nail 110 extends outwardly from the exposed cut face 100 or a layer of shotcrete 102 disposed therealong. The nail 110 may be threaded, i.e., the nail 110 may be partially threaded or fully threaded. The nail 110 may also be protected from corrosion by an epoxy coating, by encapsulation, or by other suitable methods known to those of ordinary skill in the art.

Figure 12:
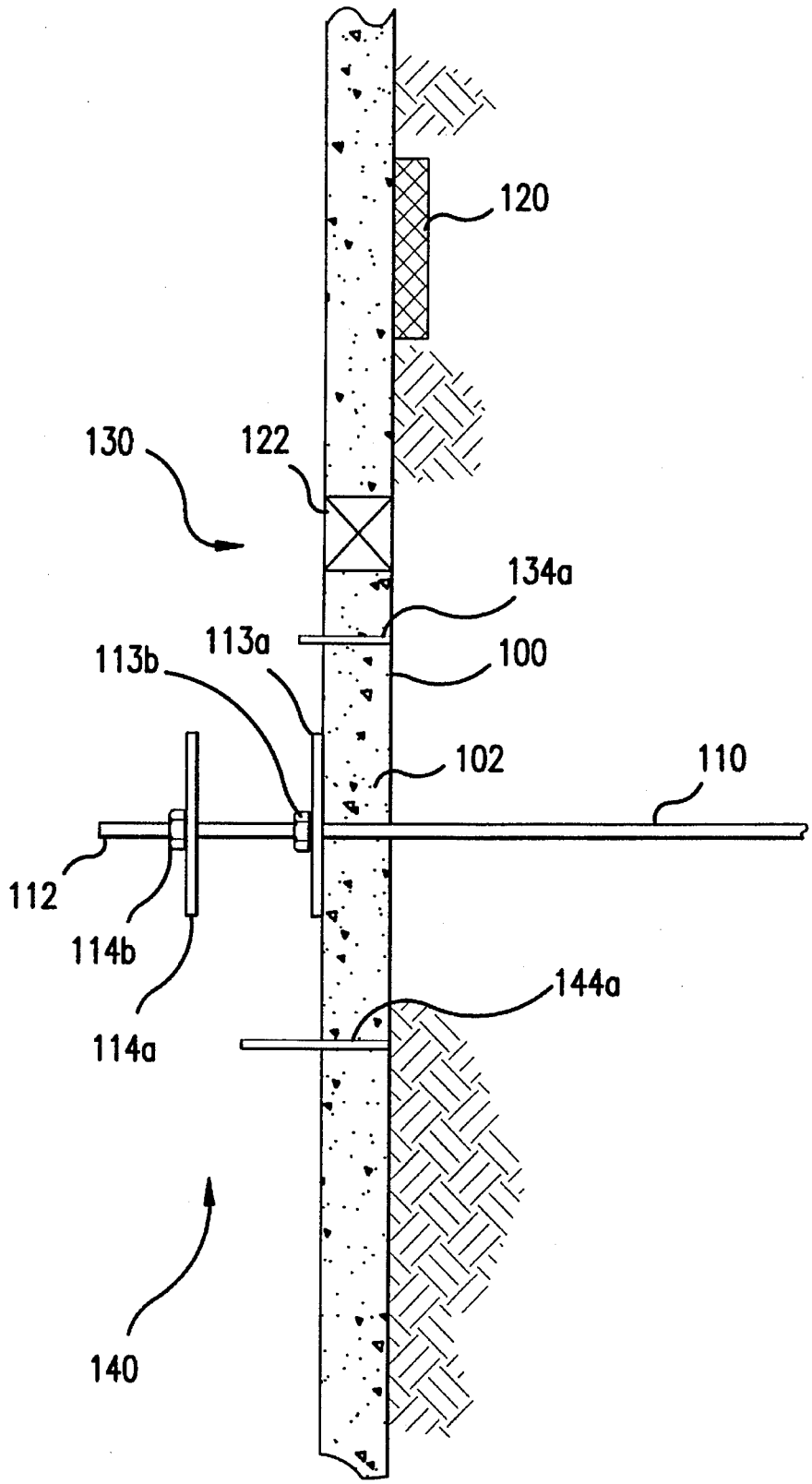
FIGS. 12–17 are likewise partial plan views of various steps in the construction of a first embodiment of the retaining wall of the present invention using various construction expedients.
Figure 13:
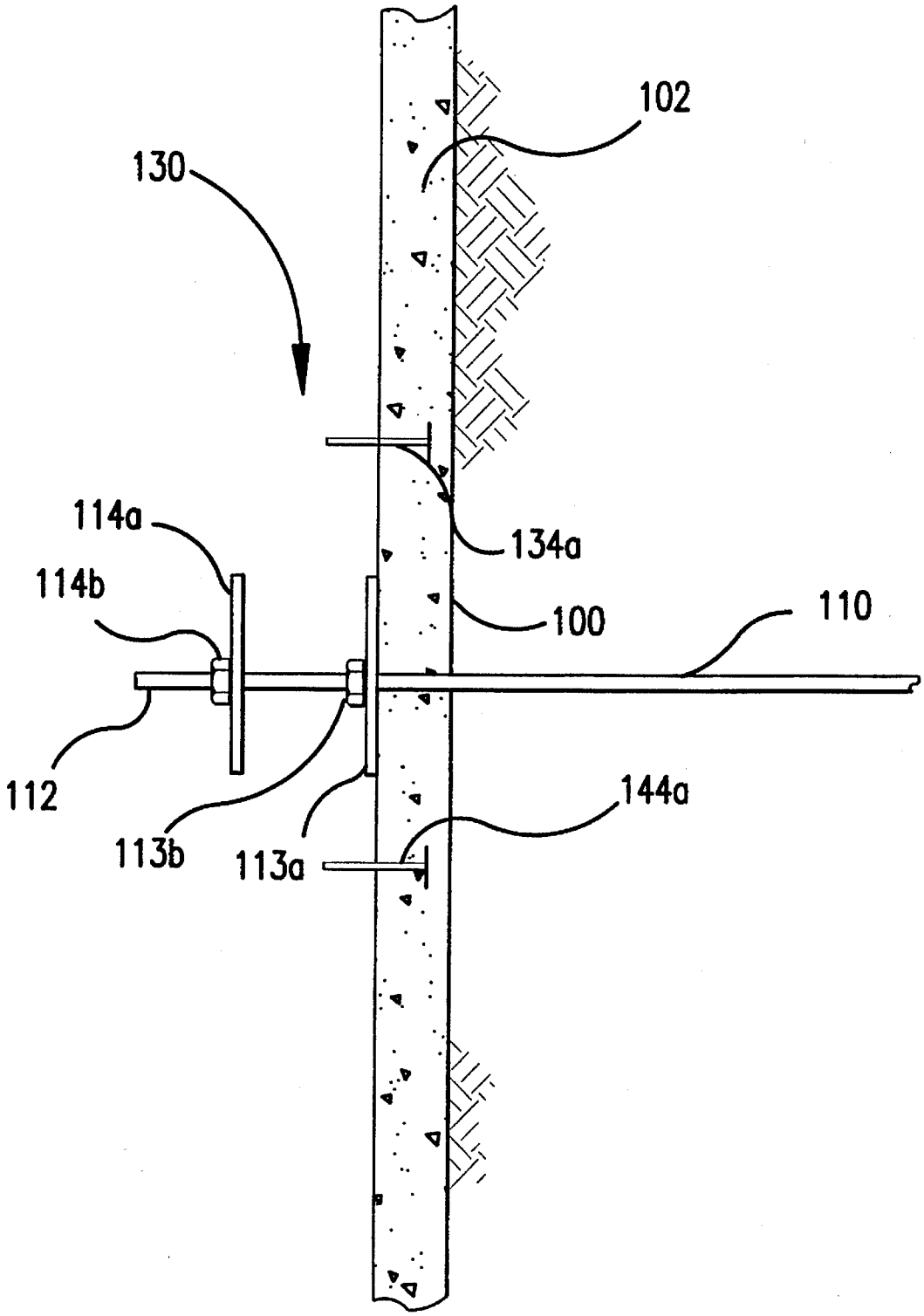
Figure 14:
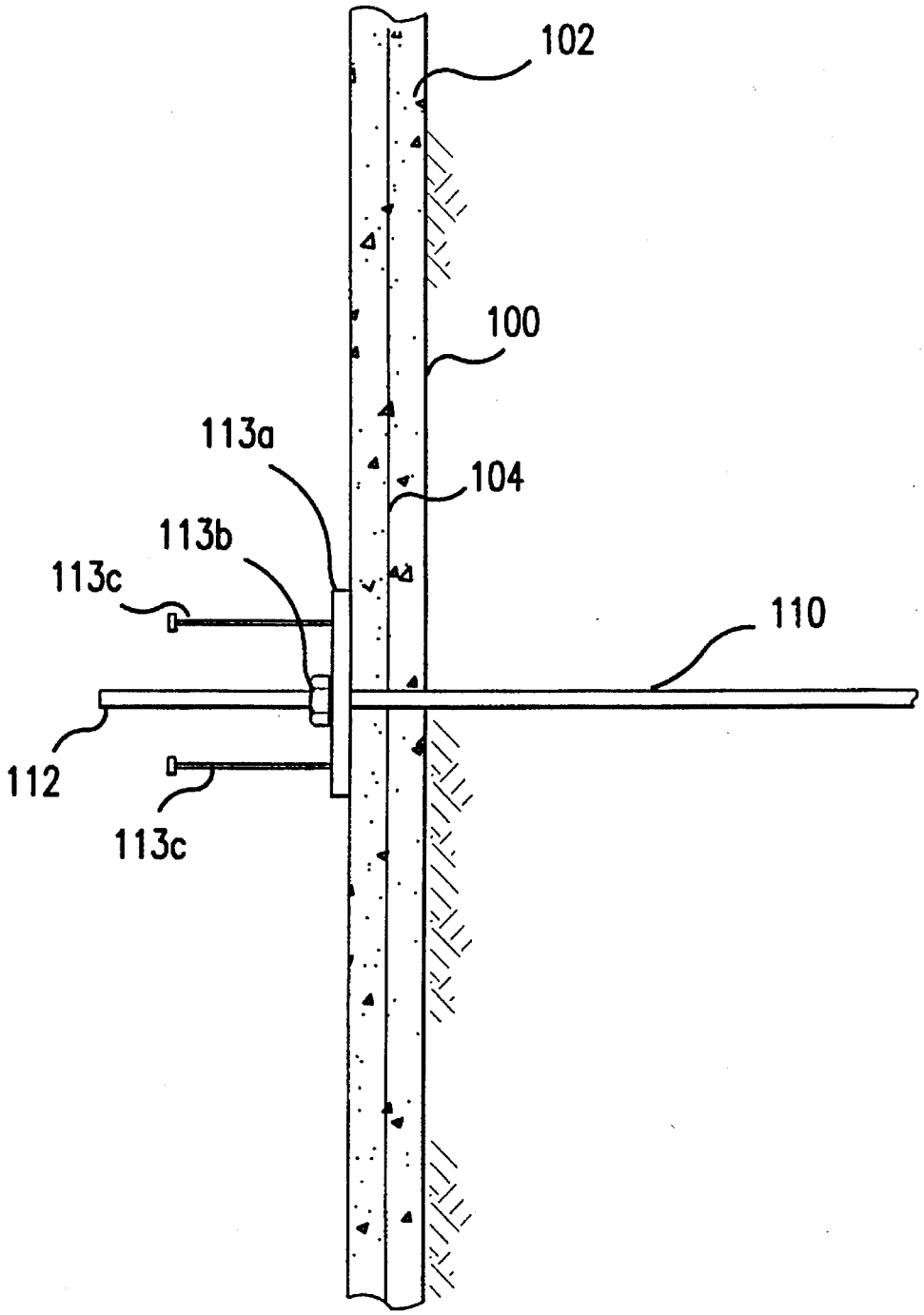

As discussed more fully below, the first end 112 of the nail 110 may be used to facilitate erection of the precast lacing elements and placing of the concrete closure. Further, as shown in FIGS. 11–13, the first end 112 of the nail 110 may include first and second bearing plates 113*a*, 114*a* and first and second threaded fastening means 113*b*, 114*b*. The first bearing plate 113*a* and the first threaded fastening means 113*b* may be tightened against either the exposed cut face 100 or a layer of shotcrete 102 disposed along the exposed cut face. The second threaded fastening means 114*b* may be comprised of a pair of threaded fastening means, or a double nut, as shown in FIG. 11. Alternatively, the second bearing plate 114*a* may be secured or otherwise fixed to the end 112 of the nail 110 in any conventional manner. If used, the second bearing plate 114*a* and second threaded fastening means 114*b* may be encased in the reinforced concrete closure, and thus help to tie together the nail and the facing elements as discussed more fully below. In an alternative configuration of the nail 110 as shown in FIG. 14, an embedment anchor means 113*c* is used in lieu of the second beating plate 114*a* and fastening means 114*b*. The embedment anchor means 113*c* extends away from the exposed cut face 100 or layer of shotcrete 102, and is encased in the reinforced concrete closure.

Figure 21:
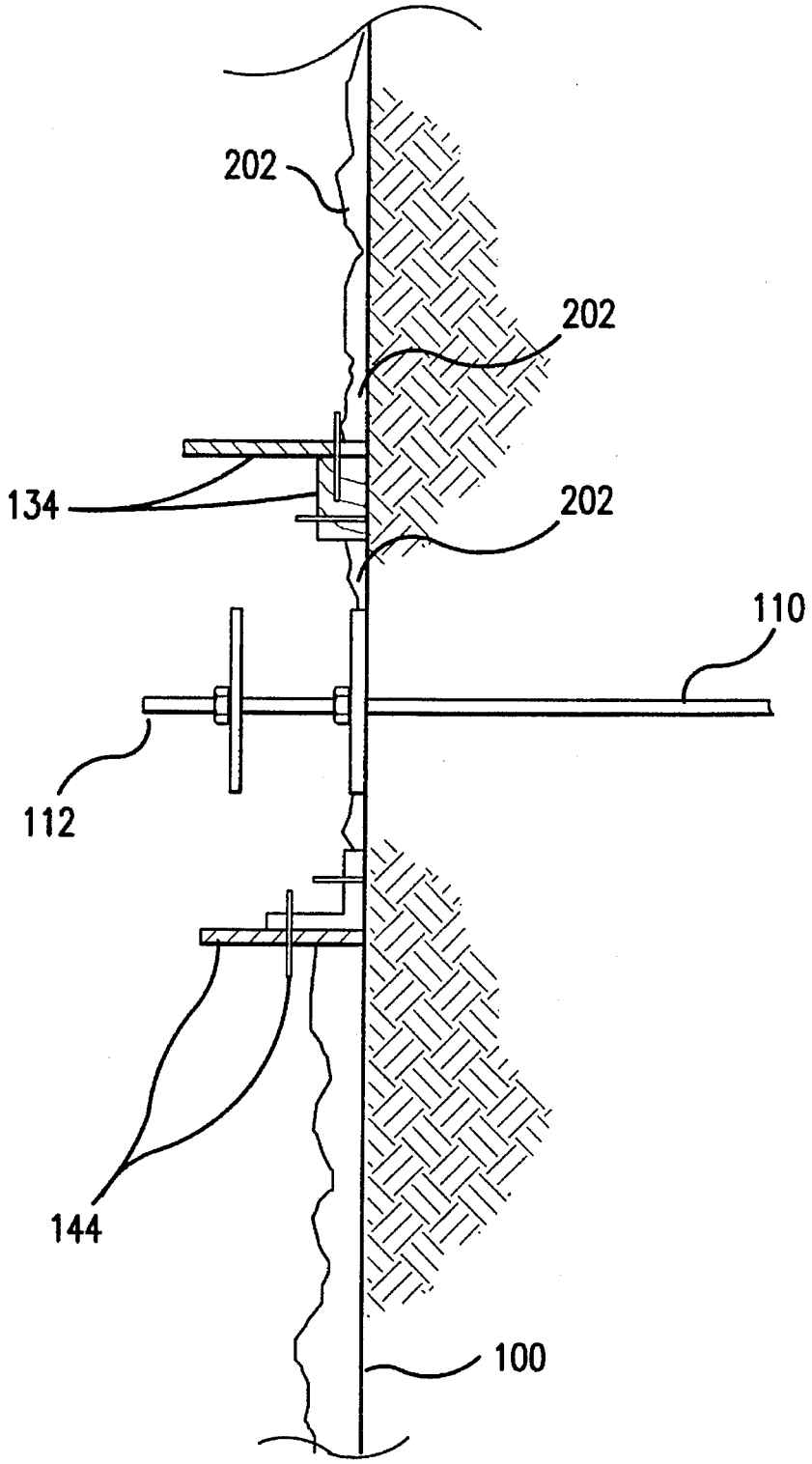
FIG. 21 is a partial plan view of a step in the construction of a first embodiment of the retaining wall of the present invention wherein a layer of shotcrete is not used for the temporary support means.
Figure 22:
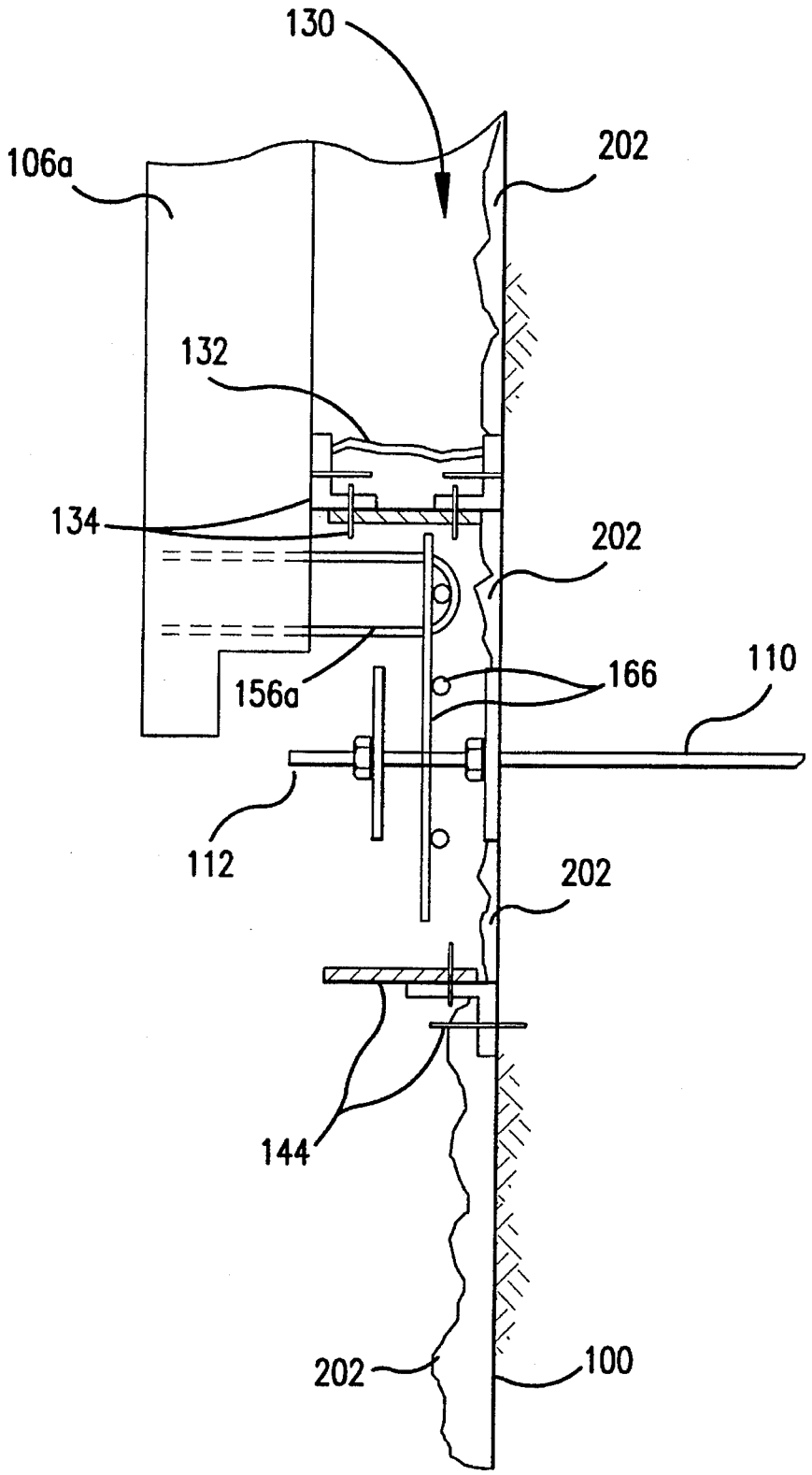
FIG. 22 is a partial plan view of the step of erecting the first facing element in accordance with the first embodiment of the retaining wall of the present invention when a layer of shotcrete is not used for the temporary support means.

The temporary support means is also typically comprised of a layer of pneumatically applied concrete or shotcrete 102. However, a layer of shotcrete 102 may not be required for excavations in certain types of ground. For example, as shown in FIGS. 21–22, in rock or rock-like ground formations, temporary support may be adequately provided for the exposed cut face 100 by the nails 110. In this situation, a layer of barrier material 202 may be disposed along the exposed cut face to keep loose material from falling into the cut as shown in FIGS. 21 and 22. Any conventional material may be used for the barrier material 202, such as wire mesh, netting, or plastic.

If used, the pneumatically applied concrete 102 may be of any common type known to those of ordinary skill in the art, such as shotcrete or gunite. The pneumatically applied concrete 102 may be reinforced, for example, by placing welded wire mesh or steel re-bar 104 within the pneumatically applied concrete as shown in FIG. 11. Any other conventional reinforcement for the pneumatically applied concrete may also be used, such as fibers. Where the term shotcrete 102 is used, it is intended to refer to any of these types of pneumatically applied concrete. Further, a drainage system may be provided, such as a chimney drain 120 or weep holes 122, as shown in FIG. 12.

After the temporary support means is provided, an outer face is set. Generally, the outer face is comprised of a plurality of facing elements which are first temporarily attached to the exposed cut face with an attachment means. The attachment means extends between the facing elements and the exposed cut face. This attachment means provides support for the facing elements during erection.

A permanent connection is then formed. The permanent connection is comprised of an isolated reinforced concrete closure. The reinforced concrete closure 108 may be comprised of reinforced cast-in-place concrete or reinforced pneumatically applied concrete (shotcrete). Respective members extending from the facing elements and the exposed ends of the soil nails are embedded in the reinforced concrete closure forming the permanent connection between the facing elements and the exposed cut face. The permanent connection is capable of resisting any and all lateral loads applied to the facing elements, e.g., earth pressures and backfill pressures. Importantly, the attachment means not only provides support for the facing elements during erection, but the attachment means also resists the concrete pressures acting on the facing elements during placement of this concrete closure.

Figure 15:
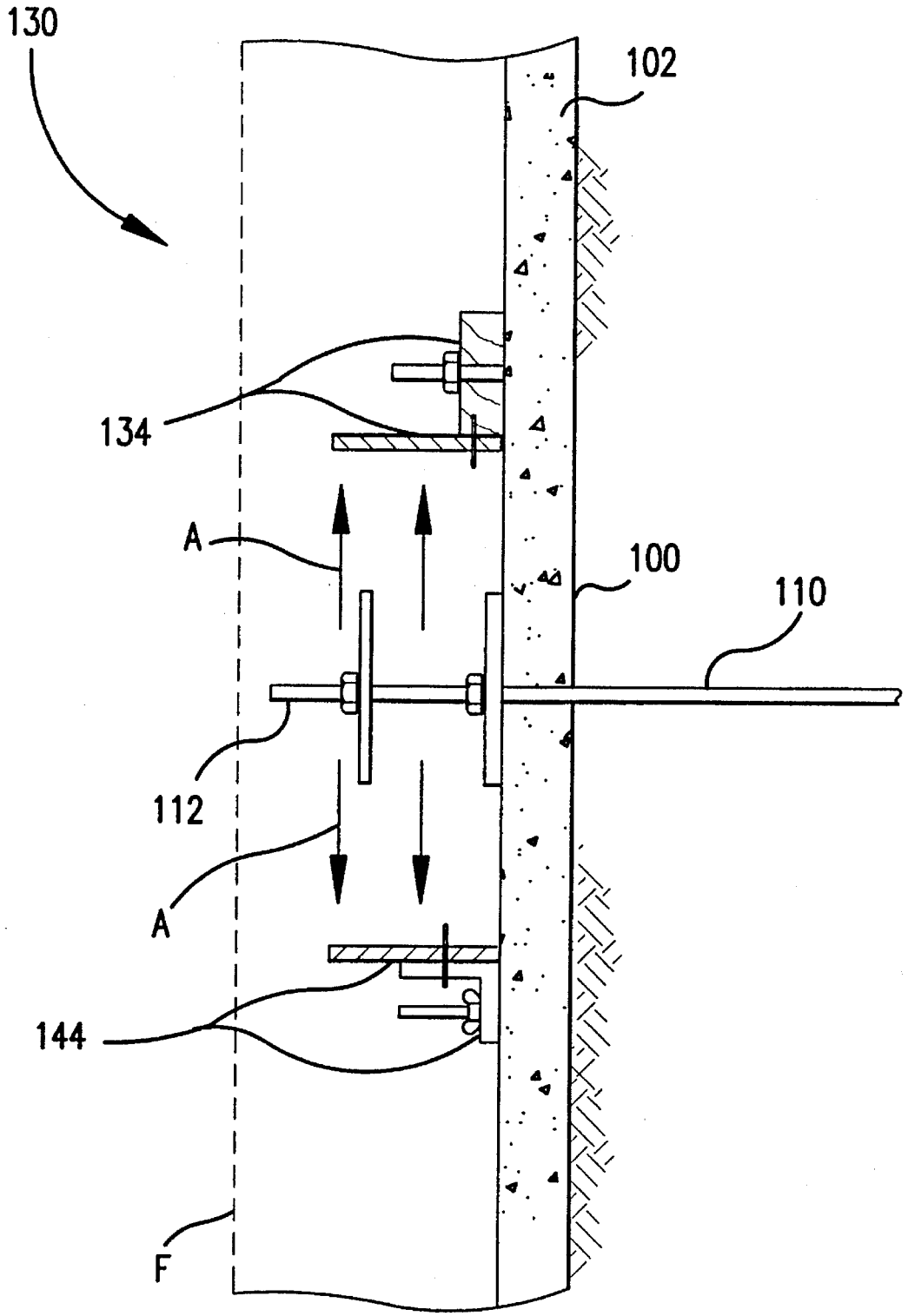
Figure 16:
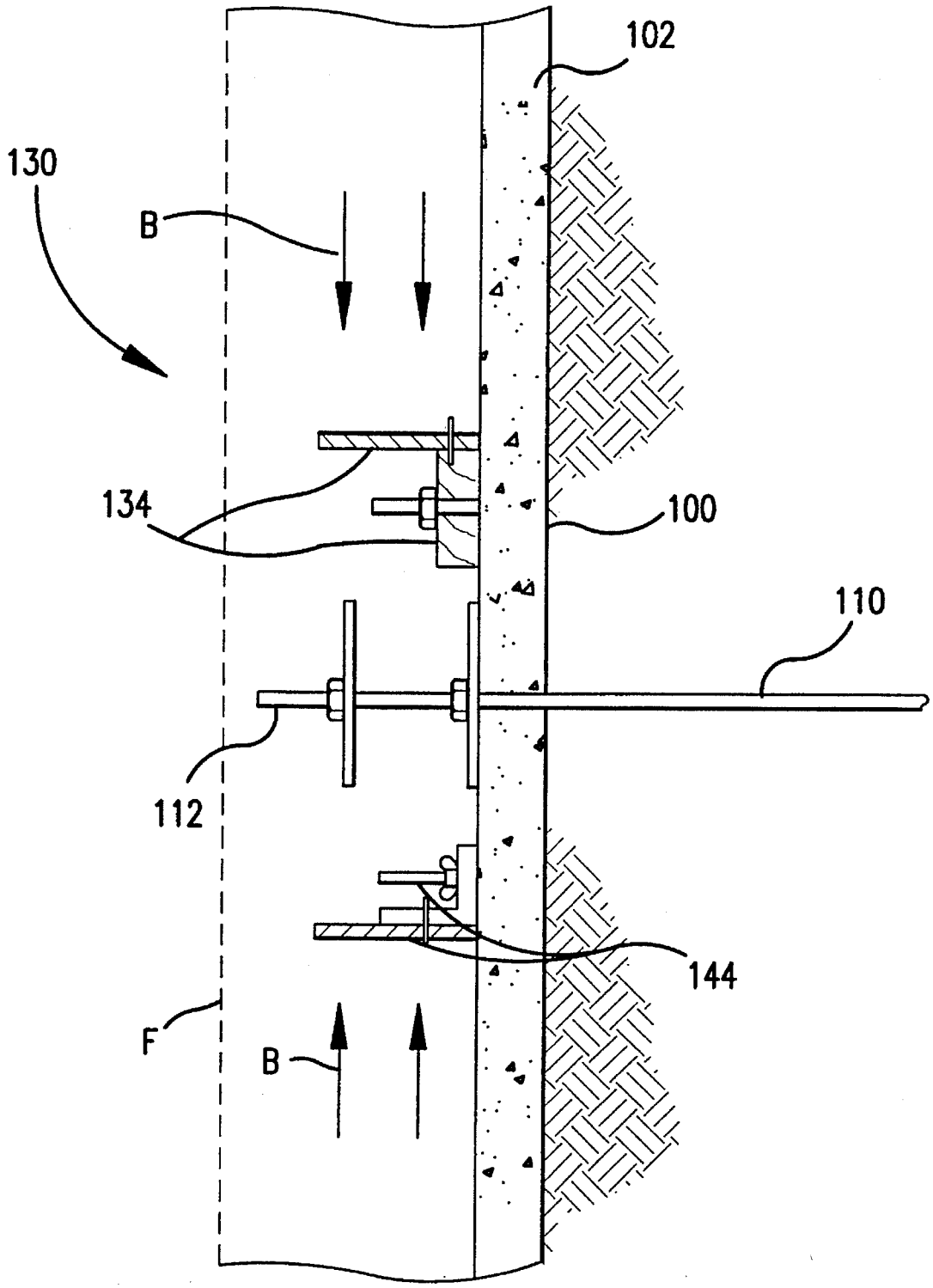
Figure 17:
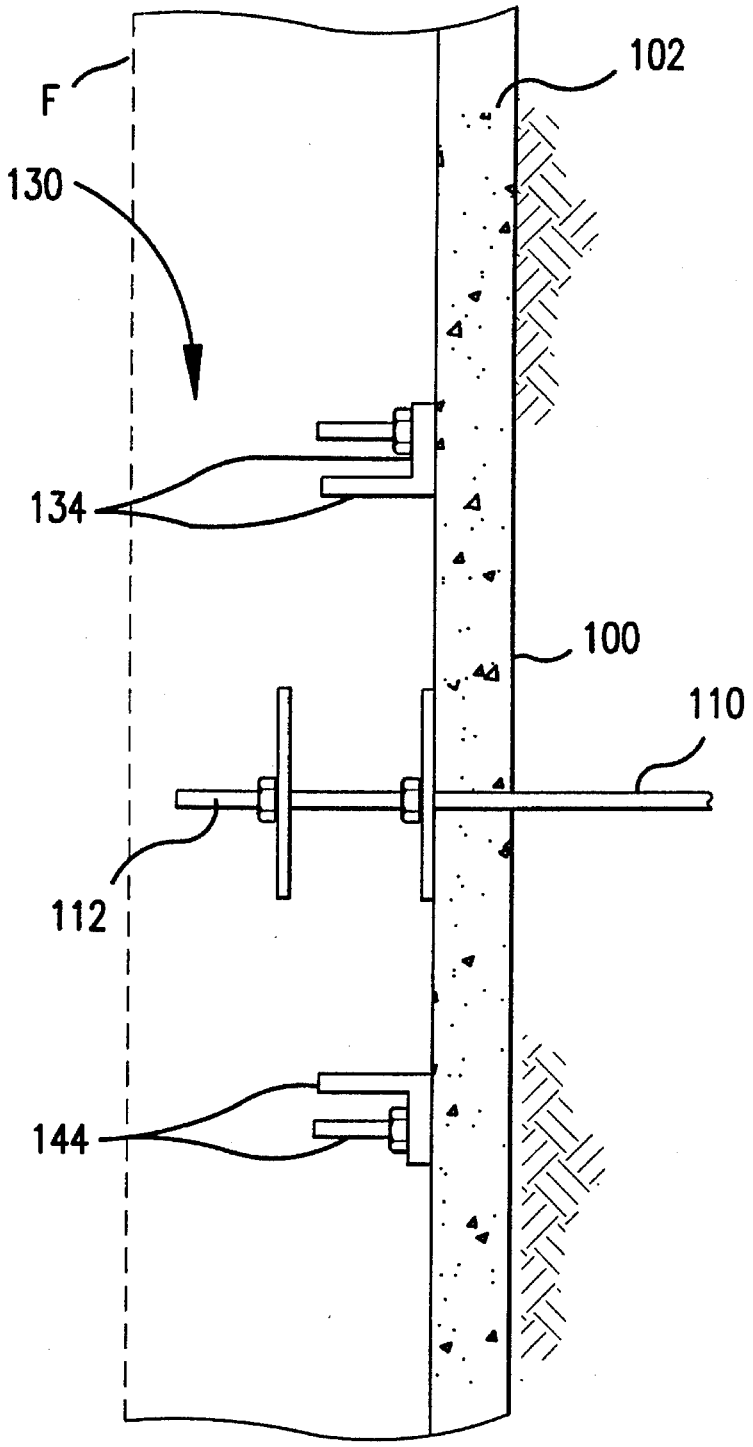

The dashed lines F in FIGS. 15–17 illustrate the ultimate position of the rear surfaces of the facing elements. A first attachment means, shown generally at 130, is positioned adjacent to the exposed cut face. The first attachment means 130 has a first end and a second end. The first end of the first attachment means 130 is secured to the exposed cut face.

Figure 18:
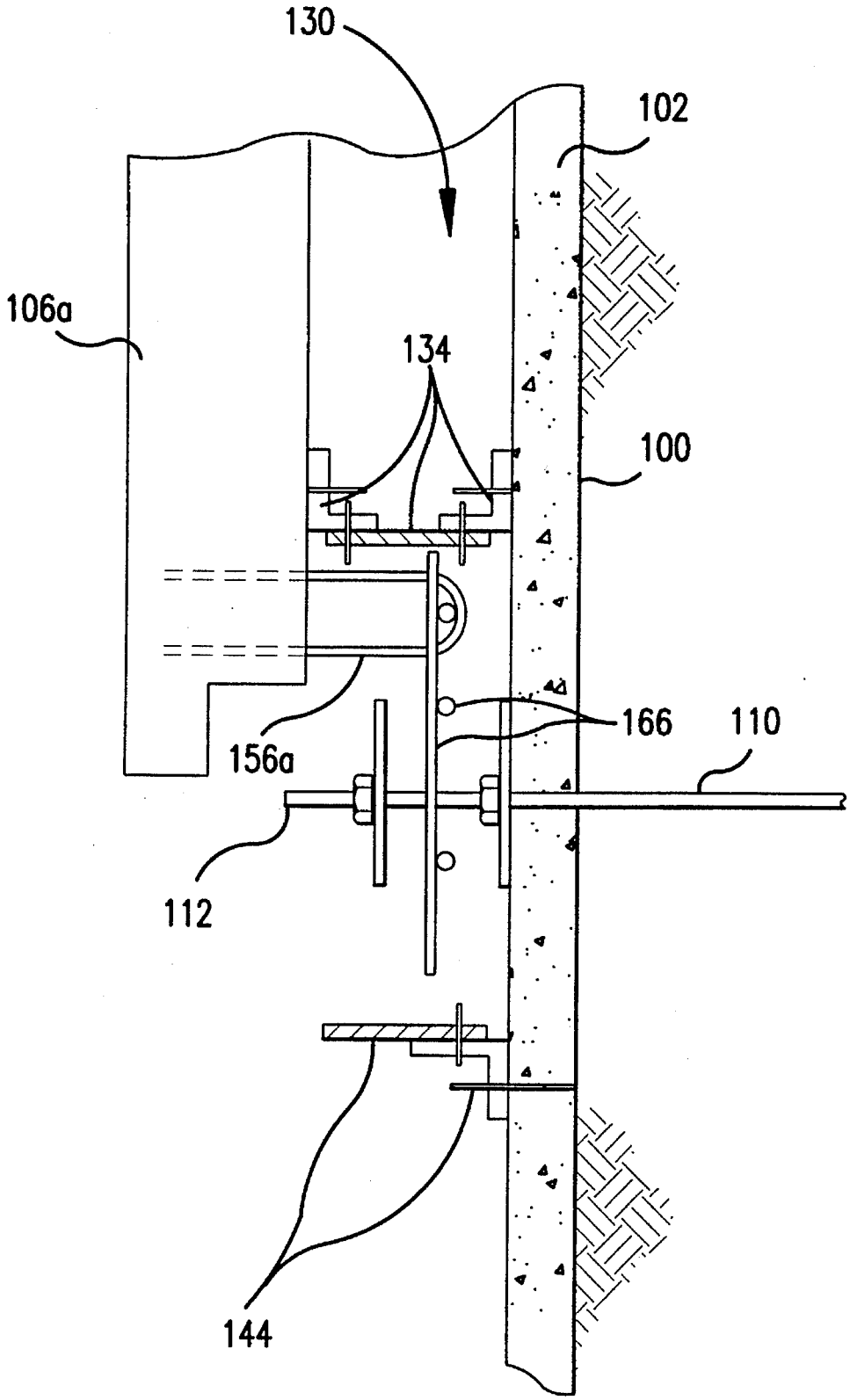
FIGS. 18–20 are partial plan views of the step of erecting the first facing element in accordance with the first embodiment of the retaining wall of the present invention.
Figure 19:
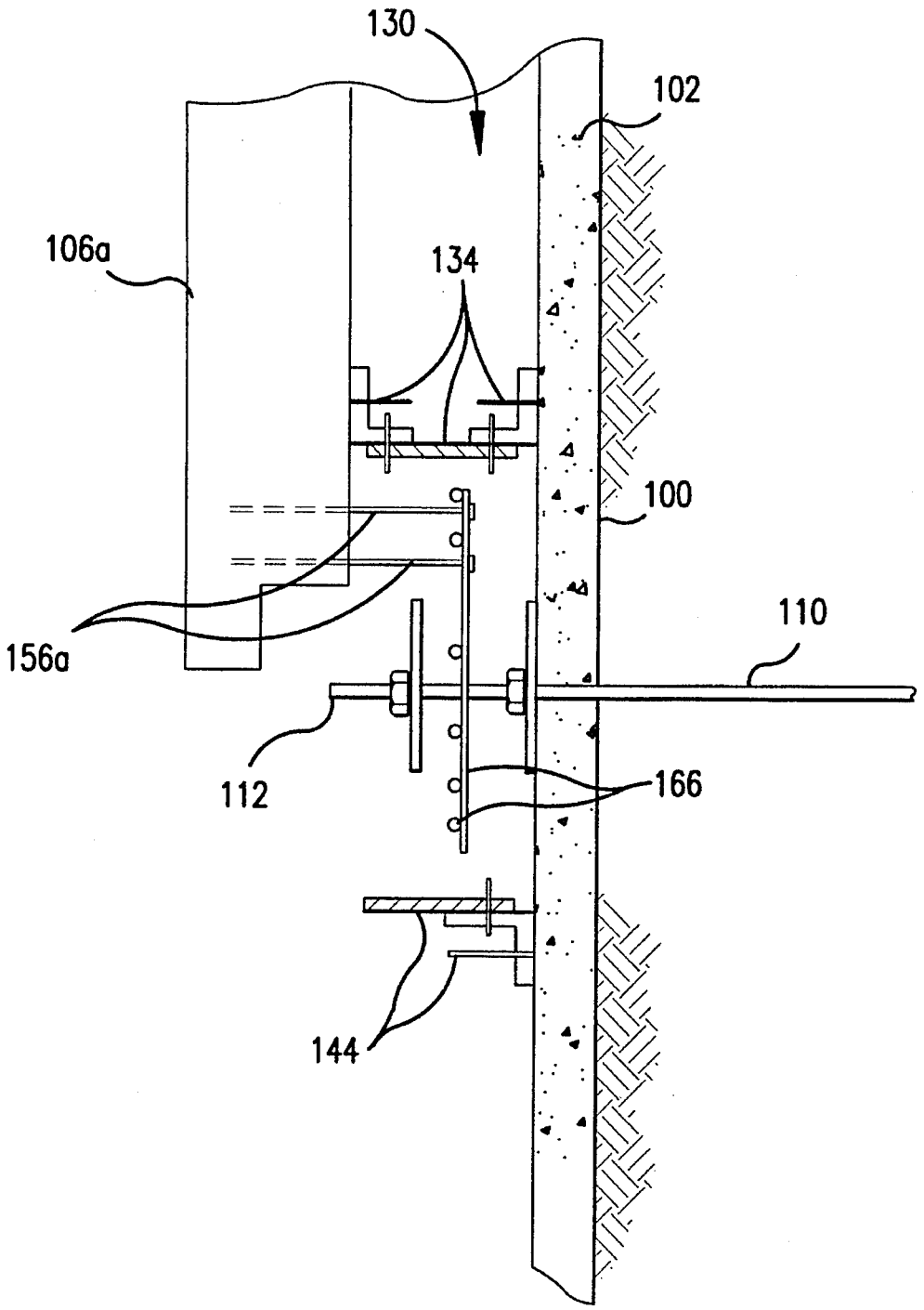
Figure 23:
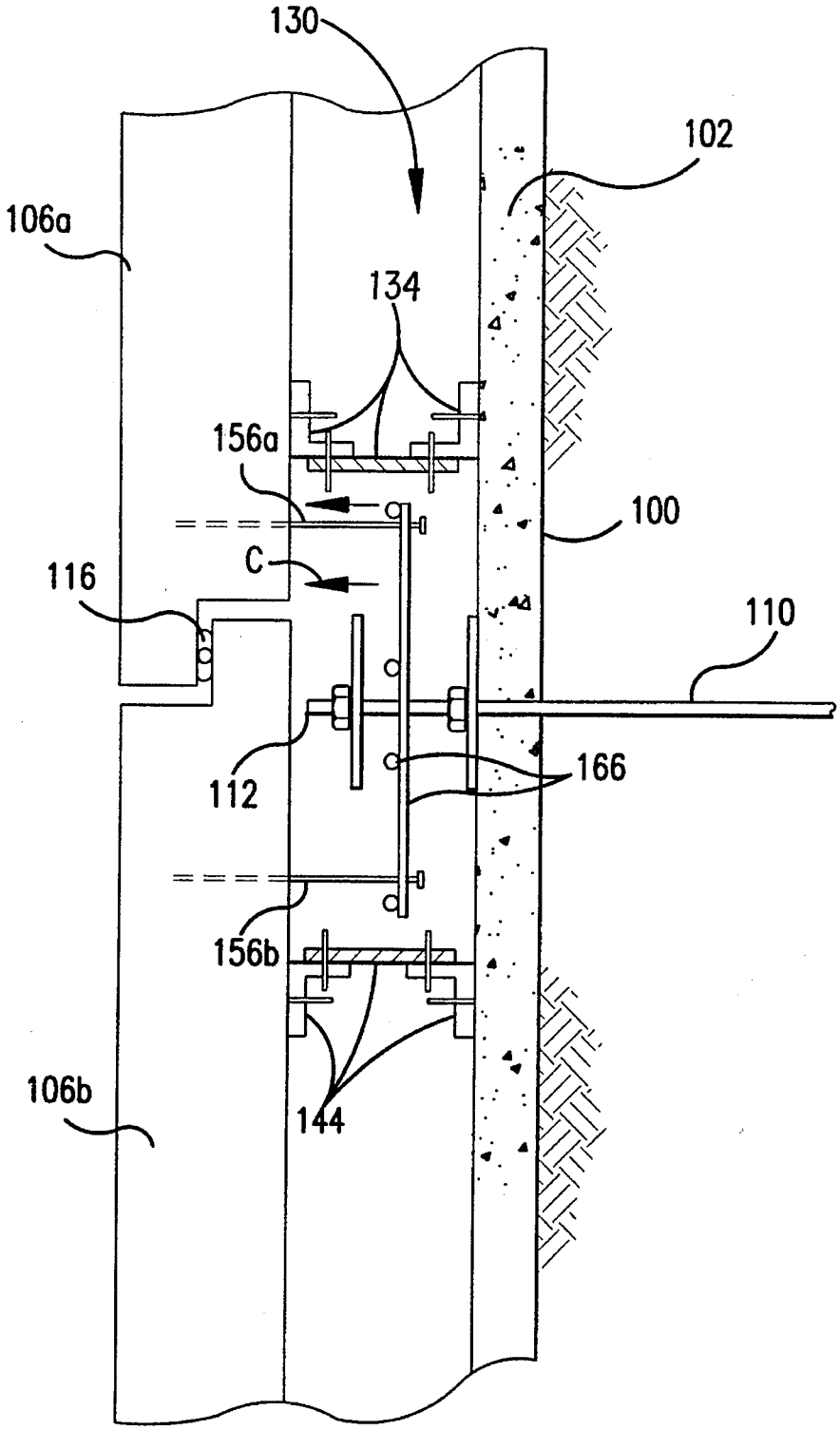
FIGS. 23–25 are partial plan views of the step of erecting the second facing element in accordance with the first embodiment of the retaining wall of the present invention.
Figure 24:
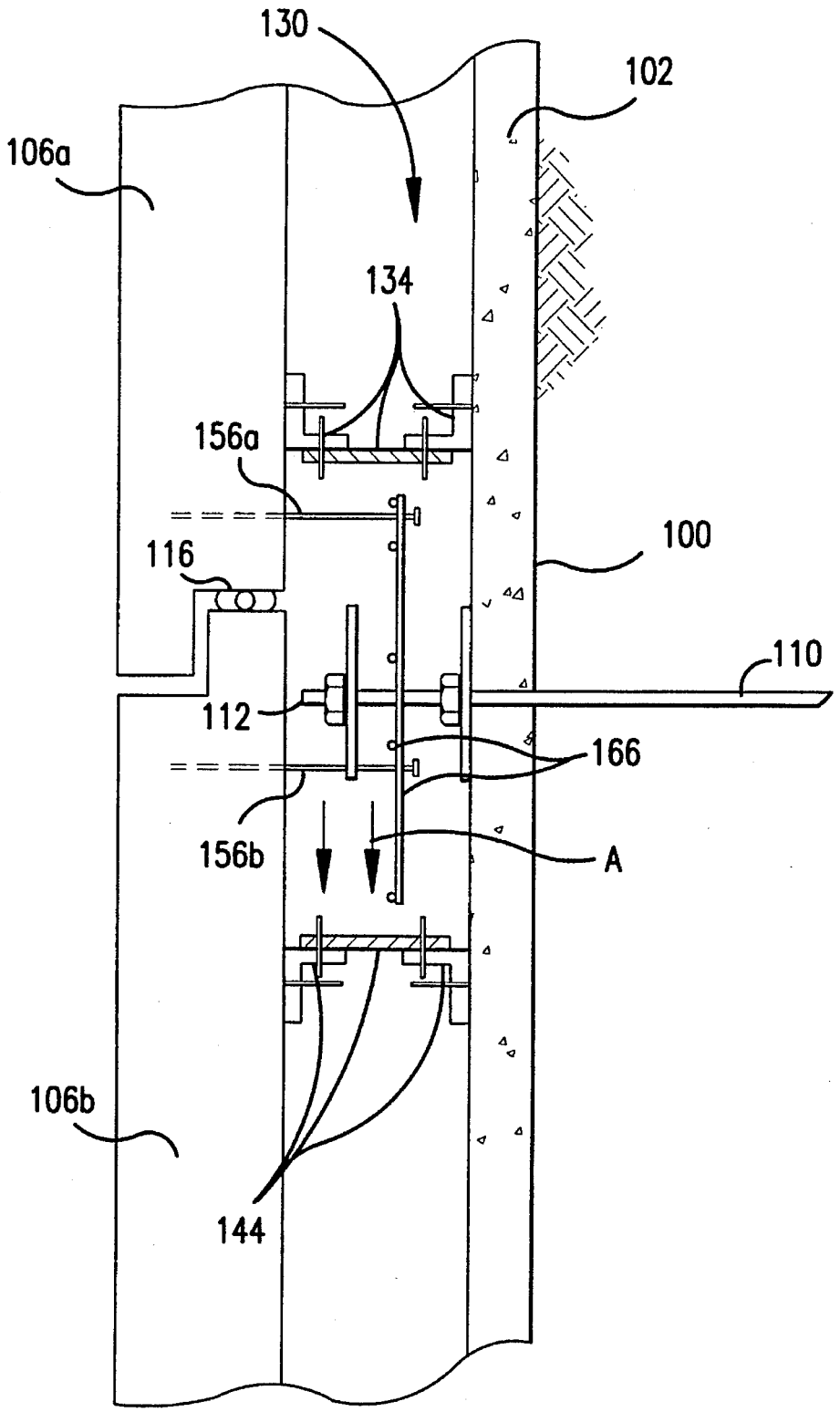
Figure 25:
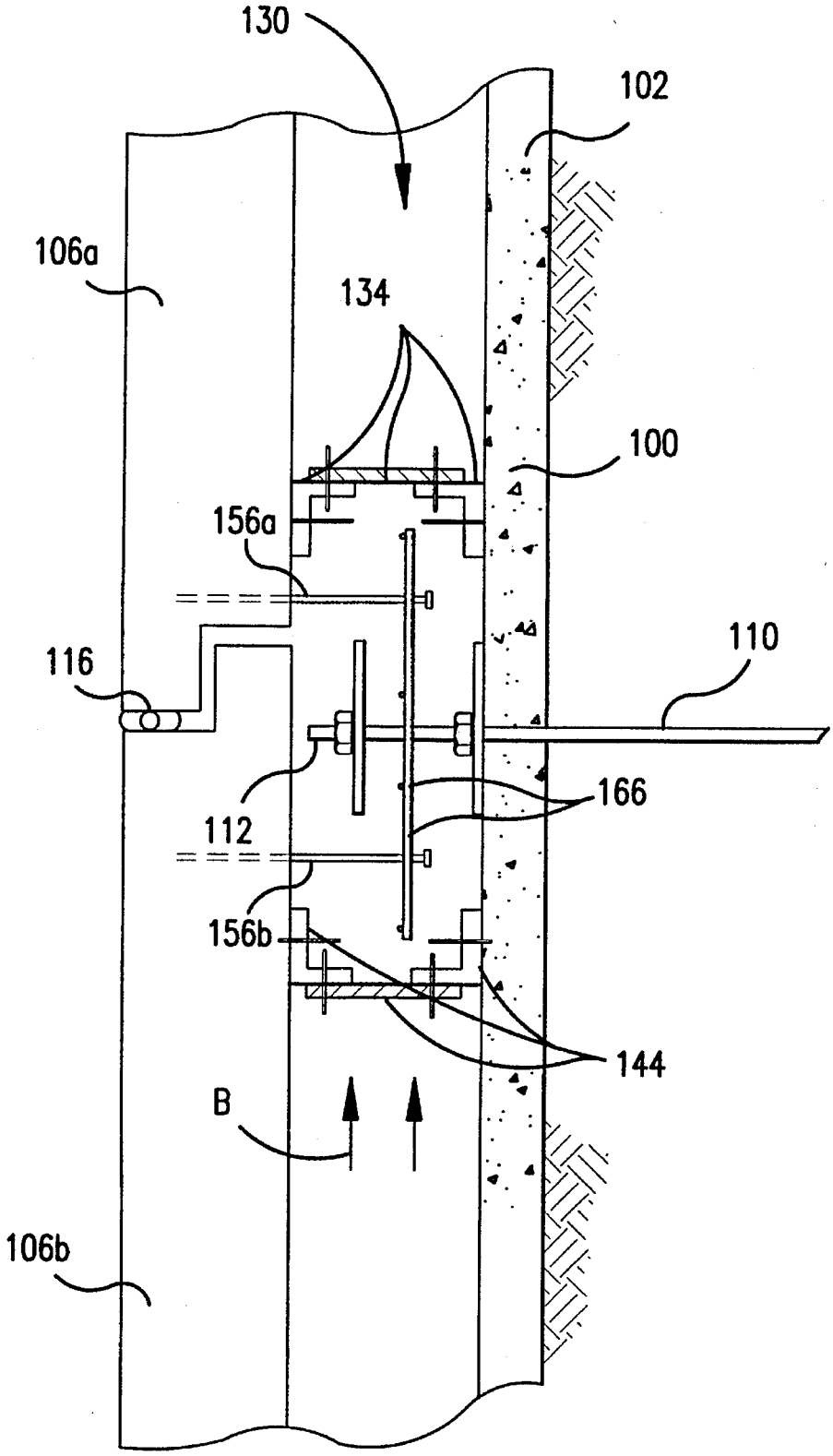

A first facing element 106*a* is erected and secured to the second end of the first attachment means 130 as shown in FIGS. 18–19. A second facing element 106*b* is erected adjacent to the first facing element 106*a* as shown in FIGS. 23–25. Notably, the positioning of the facing elements 106*a*, 106*b* is simplified over other prior art methods because only the leading edge of each element must be attached to the exposed cut face during erection. As shown in FIGS. 23–25, the following edge of each facing element 106*a*, 106*b* is held in place by the previous facing element. Thus, only one of the facing elements —as shown in FIGS. 18–19, 106*a*— must be attached to the exposed cut face at each nail connection point along the wall. Erection of the facing elements 106*a*, 106*b* is thus simplified because greater access is available to the space between the facing elements 106*a*, 106*b* and the exposed cut face 100. More specifically, because the first attachment means 130 need only be secured to one of the facing elements (here, 106*a*), the area of the closure may be prepared for the placing of the reinforced concrete 108 before setting up the other facing element (here, 106*b*). As shown in FIGS. 18–19, a worker is thus able to easily prepare the area of the reinforced concrete closure by making attachments and placing forms without reaching down and over the height of the erect facing elements 106*a*, 106*b*. Accordingly, full-height panels may advantageously be used in constructing the retaining wall of the present invention.

Figure 32:
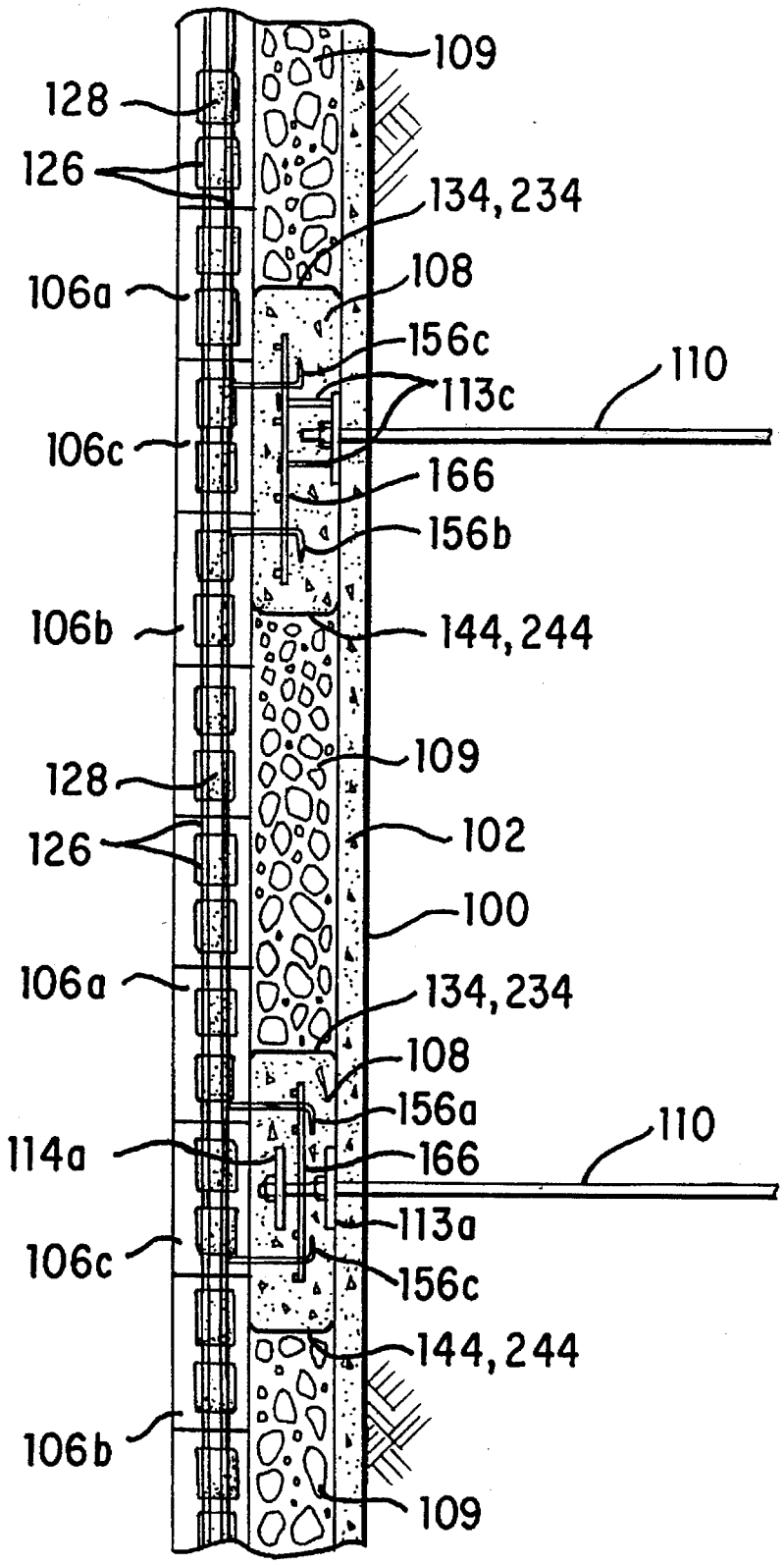
FIG. 32 is a partial plan view of the retaining wall of the present invention when one or more masonry blocks or Ivany Blocks® are utilized for the facing elements.

The first and second facing elements 106*a*, 106*b* are preferably formed from precast concrete, but other suitable construction materials known to those of ordinary skill in the an may also be used. For example, in a further alternative configuration of the present invention as shown in FIG. 32, the facing elements 106*a*, 106*b*, 106*c* of the present invention may be comprised of one or more reinforced blocks, such as masonry blocks or Ivany Blocks® as described in U.S. Pat. No. 4,167,840, the disclosure of which is hereby incorporated by reference. As shown in FIG. 32, the masonry blocks or Ivany Blocks® may be stacked adjacent to one another on top of a concrete footing or leveling pad at the base of the retaining wall. As the blocks are laid, horizontal and vertical reinforcing steel 126 is installed which extends through the apertures of adjacent blocks. The reinforcing steel 126 maintains the blocks in a fixed position with respect to one another. The apertures in the blocks are later filled with cement grout 128 to fully embed the reinforcing steel 126 and create a reinforced structural wall.

When facing elements other than blocks are used, a joint is formed at the interconnection of adjacent facing elements. For example, a lap joint is shown at the interconnection of the first and second facing elements 106*a*, 106*b* in FIGS. 23–25. Other types of joints may also be used as will be appreciated by those of ordinary skill in the art. Between facing elements other than blocks, the center line of the joint should be maintained at a nominal distance from the center line of the nail 110, and should be maintained within the area defined by the reinforced concrete closure. As shown by the arrows C in FIG. 23, the joint between the facing elements 106*a*, 106*b* takes the load imposed by the liquid concrete during placement of the reinforced concrete closure. When blocks such as masonry or Ivany Blocks® are utilized for the facing elements, such a joint is not required since reinforcing extends through and between adjacent blocks to provide support.

Further, a gasket 116 may be used at various locations along the interconnection of the first and second facing elements 106*a*, 106*b* as shown in FIGS. 23–25. This gasket 116 may be formed from neoprene or other suitable elastomeric material. The gasket 116 serves as a cushion between the facing elements 106*a*, 106*b*, and prevents water from seeping from behind the facing elements 106*a*, 106*b*. The gasket 116 also prevents liquid concrete, when poured, from seeping from behind the facing elements 106*a*, 106*b*.

A first anchor means 156*a* is provided for the first facing element 106*a* and a second anchor means 156*b* may be similarly provided for the second facing element 106*b*. Additional anchor means, e.g., 156*c*, may likewise be provided when additional facing elements are used. The anchor means 156*a*, 156*b* may be of any suitable type known to those of ordinary skill in the art, such as one or more anchor loops as shown in FIGS. 18 and 22 or one or more headed studs as shown in FIGS. 19, 23–31 and 38–39. The anchor means 156*a*, 156*b* may be embedded in or threaded into the facing elements 106*a*, 106*b* welded thereto, or otherwise suitably attached to the facing elements 106*a*, 106*b*. A first end of each of the first and second anchor means 156*a*, 156b extends from the respective first or second facing element 106*a*, 106*b* in the area of the retaining wall adjacent to the first end 112 of the nail 110. The first ends thus extend towards the exposed cut face 100. Reinforcing steel 166 is also positioned between the exposed cut face 100 and the first and second facing elements 106*a*, 106*b* in the area of the retaining wall adjacent to the first end 112 of the nail 110. This reinforcing steel 166 may be disposed both horizontally and vertically along the cut face. The amount and character of the anchor means 156*a*, 156*b* and reinforcing steel 166 may be suitably chosen to take a desired amount of the earth loads along the face of the cut. If more support is offered by the anchor means 156*a*, 156*b* and reinforcing steel 166, the facing elements 106*a*, 106*b* need not be as strong. Also, it should be noted that if the layer of shotcrete 102 is designed to be permanent, the facing elements 106*a*, 106*b* may be used merely as architectural features, which do not contribute to the overall strength of the completed retaining wall.

The anchor means 156*a*, 156*b* and reinforcing steel 166 may be positioned prior to erection of the first facing element 106*a*, or after erection of the first facing element 106*a* but before the erection of the second facing element 106*b*. However, it may become difficult to position the anchor means 156*a*, 156*b* and reinforcing steel 166 after both of the facing elements 106*a*, 106*b* have been erected since access to the area behind the elements 106*a*, 106*b* is limited.

As shown in FIGS. 26–29, reinforced concrete or grout 108 is placed along the area of retaining wall adjacent to the first end 112 of the nail 110 between the layer of shotcrete 102 and the first and second facing elements 106*a*, 106*b*. Alternatively, if a layer of shotcrete 102 is not used as shown in FIGS. 21–22, reinforced concrete 108 is placed along the area of retaining wall adjacent to the first end 112 of the nail 110 between the exposed cut face 100 and the first and second facing elements 106*a*, 106*b*. In any event, the reinforced concrete 108 thereby encases the first end 112 of the nail 110, the first ends of the first and second anchor means 156*a*, 156*b*, any bearing plates 113*a*, 114*a*, threaded fastening means 113*b*, 114*b* or embedment anchor means 113*c*, and the reinforcing steel 166. The reinforced concrete 108 may be comprised of reinforced cast-in-place concrete or reinforced pneumatically applied concrete (shotcrete). This isolated reinforced concrete closure effectively ties together the nail and the facing elements 106*a*, 106*b*. The concrete closure is designed to resist any and all lateral loads applied to the facing elements 106*a*, 106*b*, e.g., earth pressures and backfill pressures. Finally, free-draining granular backfill material 109, such as porous concrete, gravel or crushed rock, is placed along the retaining wall between the exposed cut face 100 or the layer of shotcrete 102 disposed along the exposed cut face and the first and second facing elements 106*a*, 106*b*.

Figure 20:
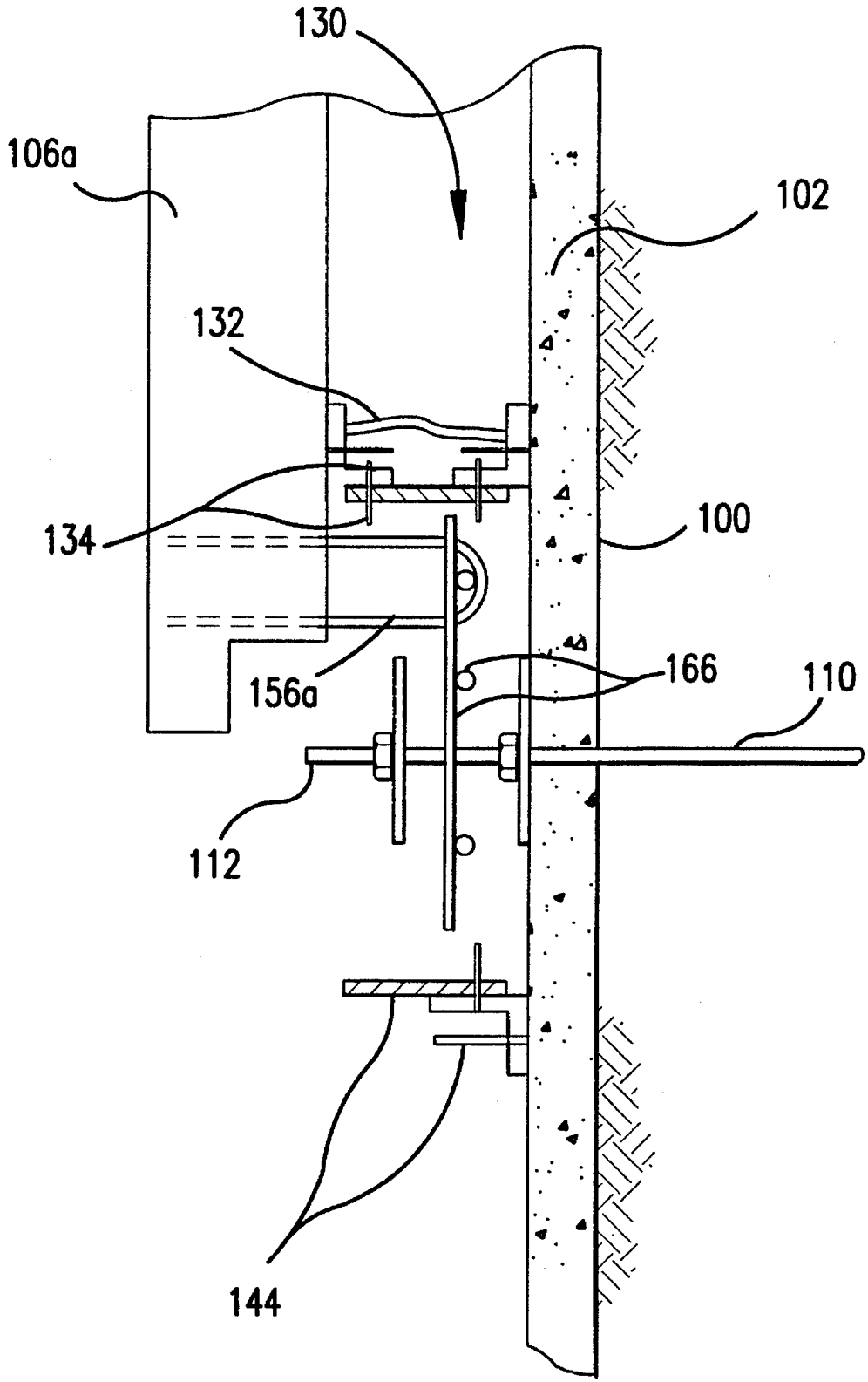

The first attachment means 130 may take on a variety of different configurations. In the embodiment shown in FIGS. 12–20, 23–31 and 38–39, when a layer of shotcrete 102 is used, the first attachment means 130 is secured to the exposed cut face 100 through the layer of shotcrete 102. One form of this embodiment is shown in FIG. 20, wherein the attachment means 130 comprises a conventional rigid construction attachment means 132, such as a strap. Another configuration of this embodiment of the present invention is shown in FIGS. 15–19 and 23–31, wherein the first attachment means 130 is comprised of a first form 134 which is positioned adjacent to the temporary support means and secured thereto.

If no layer of shotcrete 102 is used as shown in FIGS. 21 and 22, the first attachment means 130 may be secured directly to the exposed cut face 100. For example, the first attachment means may comprise a conventional construction attachment means 132, such as a strap as shown in FIG. 22. Alternatively, as shown in FIG. 21, the first attachment means 130 may be comprised of a first form 134 which is positioned adjacent to the exposed cut 100 face and secured directly thereto.

Importantly, the attachment means 130, 132 is capable of resisting the pressures exerted on the facing elements by the liquid concrete during placement of the concrete closure. The method of the present invention thus overcomes the disadvantages associated with prior art systems that do not provide for the retention of the facing elements during erection and placing of concrete.

Notably, while construction of the retaining wall of the present invention is described in conjunction with those FIGS. showing a layer of shotcrete 102 disposed along the exposed cut face 100, construction proceeds similarly when no shotcrete is used as shown in FIGS. 21 and 22. All that differs is that attachments are made directly to the exposed cut face 100 instead of to the layer of shotcrete 102 disposed along the exposed cut face 100.

Further with respect to the forms, according to the present invention, first and second forms or sets of formwork 134, 144 are positioned adjacent to the temporary support means. Each of these first and second forms 134, 144 has a first end and a second end. The first ends of the first and second forms 134, 144 are secured to the exposed cut face 100 or the layer of shotcrete 102 disposed along the exposed cut face 100, and the second ends are positioned adjacent to the respective first or second facing element 106*a*, 106*b*. As noted above, the first form 134 may serve as the first attachment means 130 if the second end of the first form 134 is secured to the first facing element 106*a*, as shown in FIGS. 18–19, 23–31 and 38–39.

The formwork 134, 144 may be constructed in accordance with techniques well known to those of ordinary skill in the art. For example, the forms may be comprised of wood, steel, expanded metal, or other suitable materials. The connections may be nailed, bolted, welded, or otherwise secured as appropriate. FIGS. 15–31 and 38–39 illustrate the use of wood blocking, steel angles or other conventional brackets.

Figure 26:
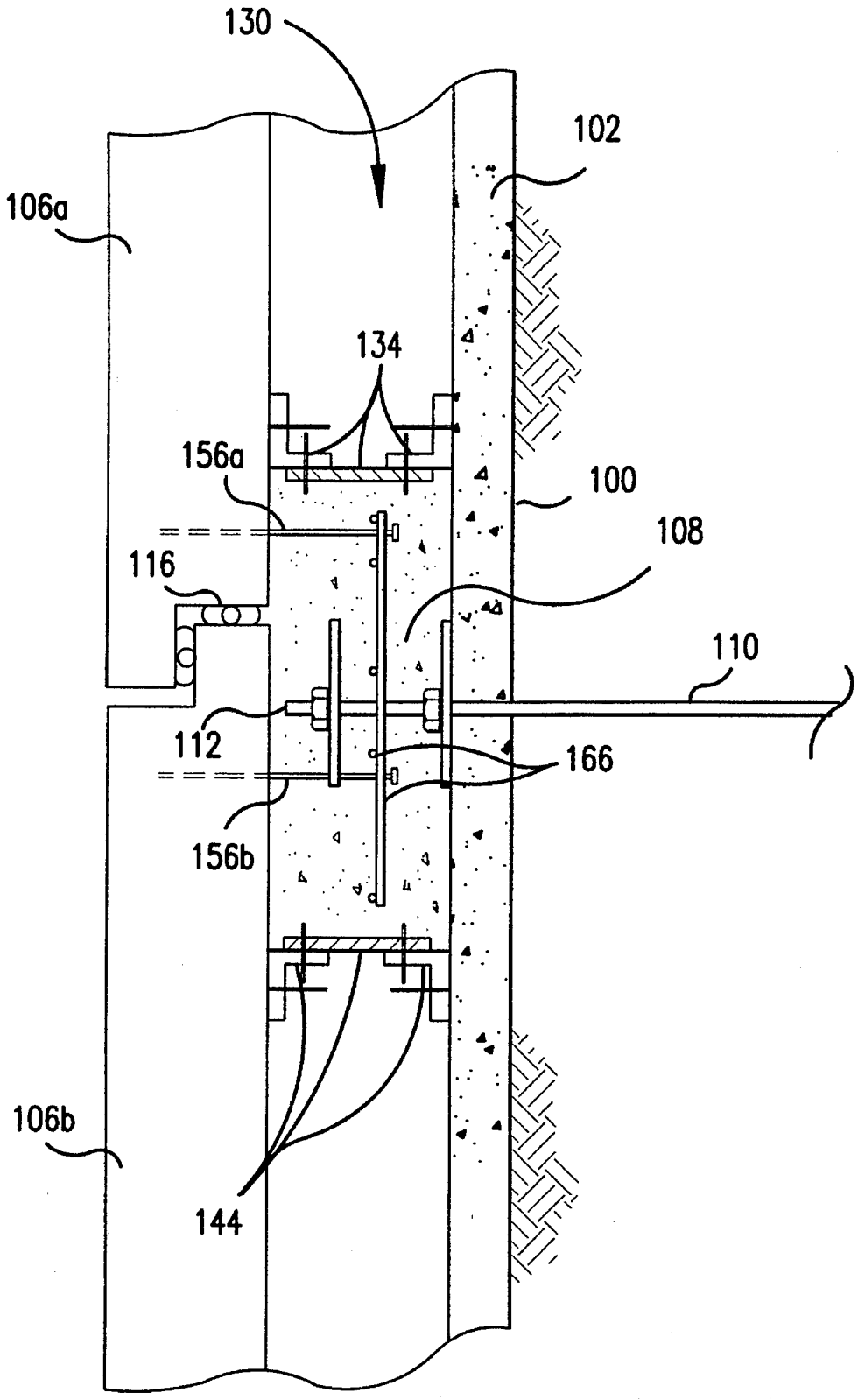
FIGS. 26–29 are partial plan views of the steps of placing reinforced concrete and backfill material in accordance with the first embodiment of the retaining wall of the present invention.
Figure 27:
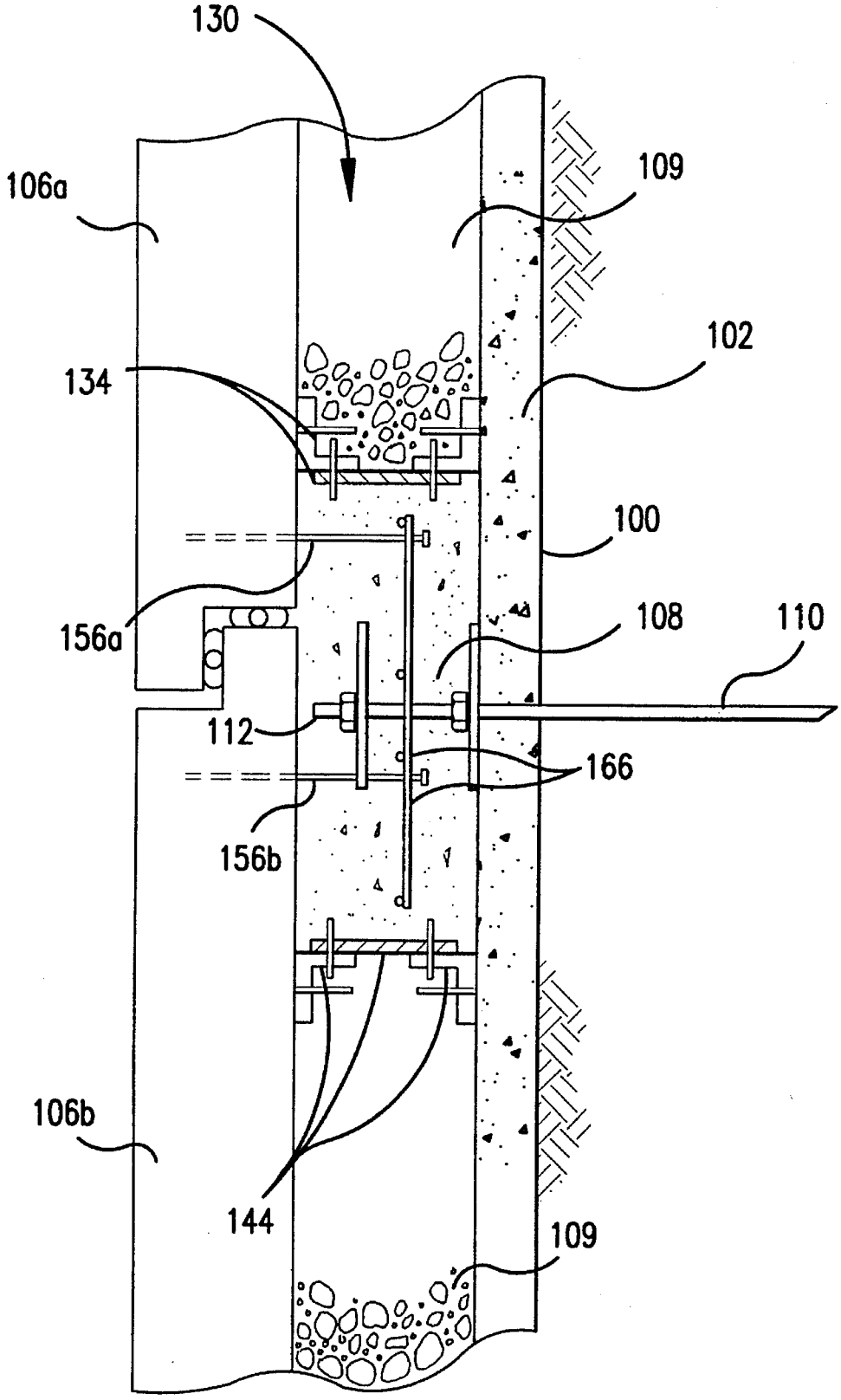

As shown in FIG. 26, the first and second forms 134, 144 are arranged such that the reinforced concrete 108 is placed only along the area of the retaining wall between the first and second forms 134, 144. Thus, an isolated, or discrete, reinforced concrete closure 108 is formed when the reinforced concrete is placed between the first and second forms 134, 144. More specifically, the reinforced concrete 108 is placed, i.e., poured or blown, adjacent to the first end 112 of the nail 110 in the area between the exposed cut face 100 or the layer of shotcrete 102 disposed along the exposed cut face, the first and second facing elements 106*a*, 106*b*, and the first and second forms 134, 144. Finally, as shown in FIG. 27, backfill material 109 is placed along the area of the retaining wall exterior of the first and second forms 134, 144. The backfill material 109 is placed in the area between the exposed cut face 100 or layer of shotcrete 102 disposed along the exposed cut face 100 and the first and second facing elements 106*a*, 106*b* exterior of the first and second forms 134, 144.

As shown in FIG. 12, the studs 134*a*, 144*a* for the formwork may be drilled and set or epoxied in the exposed cut face 100 or the layer of shotcrete 102 disposed along the exposed cut face 100. Alternatively, the studs 134*a*, 144*a* may be shot into the exposed cut face 100 or the layer of shotcrete 102. As shown in FIG. 13, it is also possible to embed the initial forms or studs 134*a*, 144*a* in the layer of shotcrete 102 by retaining the studs 134*a*, 144*a* in place while applying the shotcrete 102.

In the embodiment of the present invention shown in FIGS. 15–19 and 23–31, the first facing element 106*a* is secured to the temporary support means by securing the formwork 134 to the first facing element 106*a*. The first end of the formwork 134 is secured to the layer of shotcrete 102, and the second end is secured to the first facing element 106*a*. Likewise, the first end of the second form 144 is secured to the layer of shotcrete 102. However, the second end of the second form 144 need not be secured to the second facing element 106*b*. Rather, as shown in FIGS. 23–31, the second end of the second form 144 must merely be positioned adjacent to the second facing element 106*b*. More specifically, the second end of the second form 144 must merely be positioned so as to come into contact with the form receiving means positioned along the rear surface of the second facing element 106*b*. In this regard, each of the facing elements 106*a*, 106*b* may have a form receiving means such as a bracket or other construction expedient secured to its rear surface. The form receiving means may be secured to the rear surface of the facing element 106*a*, 106*b* prior to erection, and provides a ready means of positioning or securing the formwork 134, 144.

Again, with this configuration, it is unnecessary to secure the second end of the second form 144 to the second facing element 106*b*. This result is advantageous because access to the area behind the second facing element 106*b* will be extremely limited once it is erected next to the first facing element 106*a*. It would thus be extremely difficult for a user to gain access to secure a connection between the facing element 106*b* and the second form 144. With the present invention, on the other hand, the second end of the second form 144 is merely placed adjacent to the second facing element 106*b* and thus received along the form receiving means This feature is illustrated by FIGS. 23–25 which show no pin connection between the second form 144 and the form receiving means secured to the rear surface of facing element 106*b*.

Unlike the prior art, the formwork 134, 144 and the form receiving means may be appropriately configured to avoid time- and labor-intensive measuring and sizing in the field. For example, a bracket may be used as the form receiving means along the rear surface of a particular facing element 106*a*, 106*b*. A crossing form then extends from the bracket on the facing element 106*a*, 106*b* to a similarly configured form receiving means disposed along the layer of shotcrete. According to the present invention, the brackets and the crossing form may be sized so that the crossing form may be positioned by moving it laterally along the receiving surface of the brackets. In this manner, the formwork may be adjusted accordingly to fit in the space between the layer of shotcrete —or if shotcrete is not used, the exposed cut face —and the facing elements at any point along the wall. Adjustments may thus be made for variations in the spacing between the layer of shotcrete and the rear surfaces of the facing elements, which often occurs in cuts formed in rock or rock-like ground formations. Most importantly, the form receiving means and the crossing forms may be uniformly sized at the start of the construction of the wall, and need not be individually sized to fit at each connection point along the wall.

It should be noted that both of the second ends of the first and second forms 134, 144 may be secured to the respective first or second facing element 106*a*, 106*b*. In fact, as discussed more fully below, in the embodiment of the present invention shown in FIGS. 33–37 and 40–41, both of the second ends of the first and second forms 234, 244 are indeed secured to the respective first or second facing element 106*a*, 106*b*. With this latter embodiment, the first and second forms 234, 244 are preferably flexible, such that they may be used regardless of the spacing between the facing elements 106*a*, 106*b* and the exposed cut face 100 or the layer of shotcrete 102 disposed along the exposed cut face 100. For example, the flexible forms 234, 244 shown in FIGS. 33–37 and 40–41 may be comprised of a heavy gage screen, chicken wire, or filter fabric. It is envisioned that such flexible forms 234, 244 may be secured in a rolled up condition to the rear surfaces of the facing elements 106*a*, 106*b* prior to erection. The flexible forms 234, 244 would then be rolled out to extend towards the exposed cut face 100 or the layer of shotcrete 102 and secured thereto. Like the form system discussed above, this type of formwork would eliminate the need for costly and time-consuming measuring, sizing and form-fitting operations in the field.

Regardless of the type of formwork 134, 144,234,244 utilized, an isolated reinforced concrete closure 108 is formed in the retaining wall of the present invention. The closure is formed when the reinforced concrete 108 is placed along the area of the retaining wall between the first and second sets of formwork 134, 144, 234, 244. The formwork 134, 144, 234, 244 essentially isolates the reinforced concrete closure to the area of the retaining wall adjacent to the first end 112 of the soil nail 110. More specifically, the reinforced concrete 108 is placed adjacent to the first end 112 of the nail 110 between the exposed cut face 100 or the layer of shotcrete 102 disposed along the exposed cut face 100, the first and second facing elements 106*a*, 106*b*, and the first and second sets of formwork 134, 144, 234, 244. To complete the wall, the backfill material 109 is placed along the area of the retaining wall exterior of the first and second forms 134, 144, 234, 244, i.e., between the exposed cut face 100 or the layer of shotcrete 102 disposed along the exposed cut face 100 and the first and second facing elements 106*a*, 106*b* exterior of the first and second forms 134, 144, 234, 244.

Notably, the reinforced concrete 108 may be placed prior to installation of the backfill material 109, or alternatively the backfill material 109 may be installed first. It is also possible to place the reinforced concrete 108 and backfill material 109 simultaneously with the added advantage that the pressure on the first and second forms 134, 144, 234, 244 defining the closure will be balanced.

Along the same lines, the forms or formwork 134, 144 may be suitably designed to take advantage of the order of the placement of these materials. For example, the formwork 134, 144 may be positioned as shown in FIGS. 15 and 24 when the reinforced concrete 108 will be placed prior to the installation of the free-draining backfill material 109. The reinforced concrete 108 will thus exert pressure on the formwork 134, 144 as shown by the arrows A in FIGS. 15 and 24. This configuration affords the formwork 134, 144 a self-closing design. More specifically, as shown by the arrows A in FIG. 24, even if the formwork 144 is secured but not attached to the form receiving means on the back face of the second facing element 106*b*, the pressure of the concrete will force the formwork to close when the crossing form comes to rest against the bracket which acts as a stop. Again, this feature is significant since it is likely that access to the area behind the facing elements 106*a*, 106*b* will be limited once they are erected. This feature eliminates the need for an additional attachment, and thus the need for such access. FIG. 26 illustrates the formwork 134, 144 as used when the reinforced concrete 108 is added first, and FIG. 27 shows the completed wall after placement of the free-draining backfill material.

Figure 28:
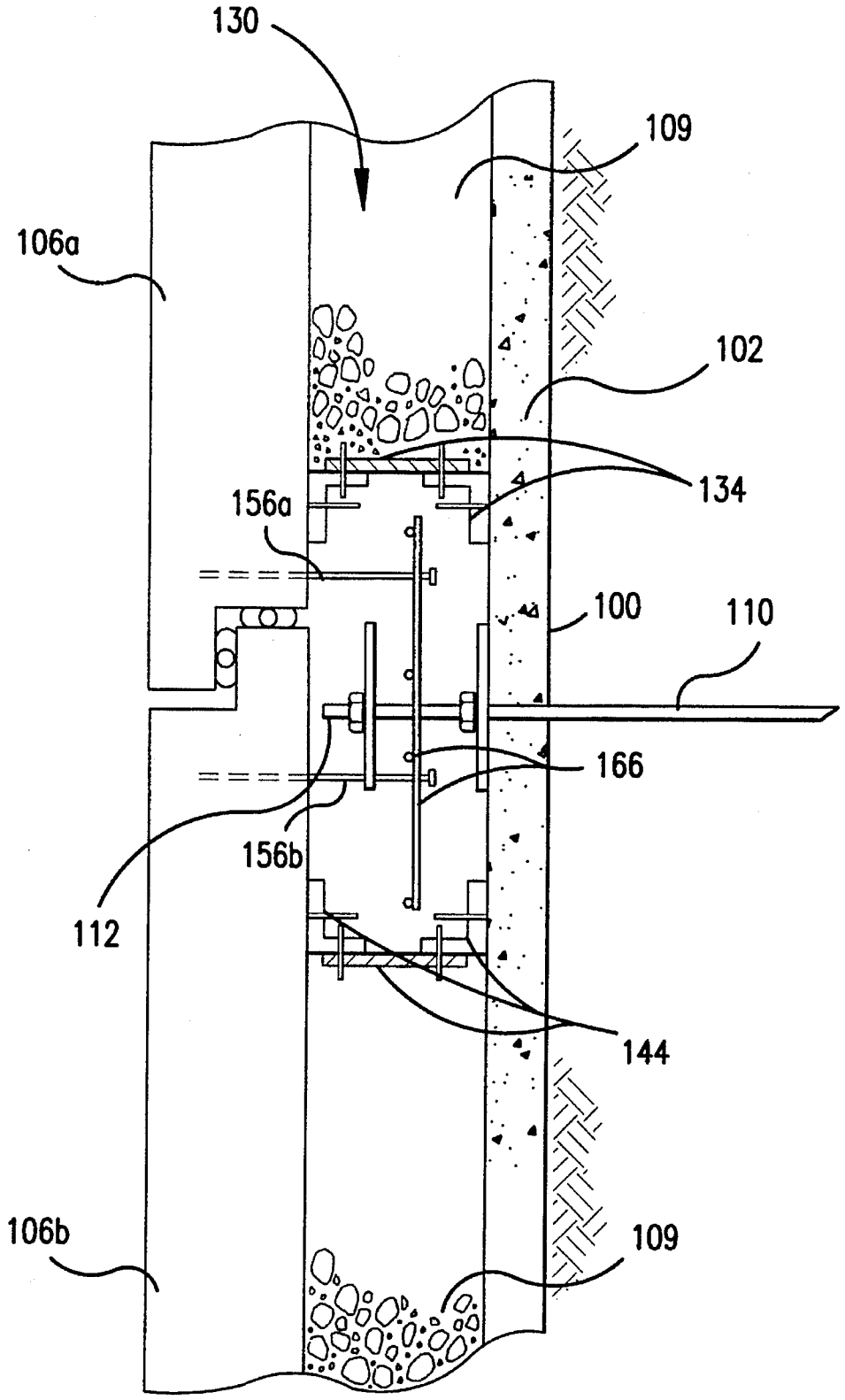
Figure 29:
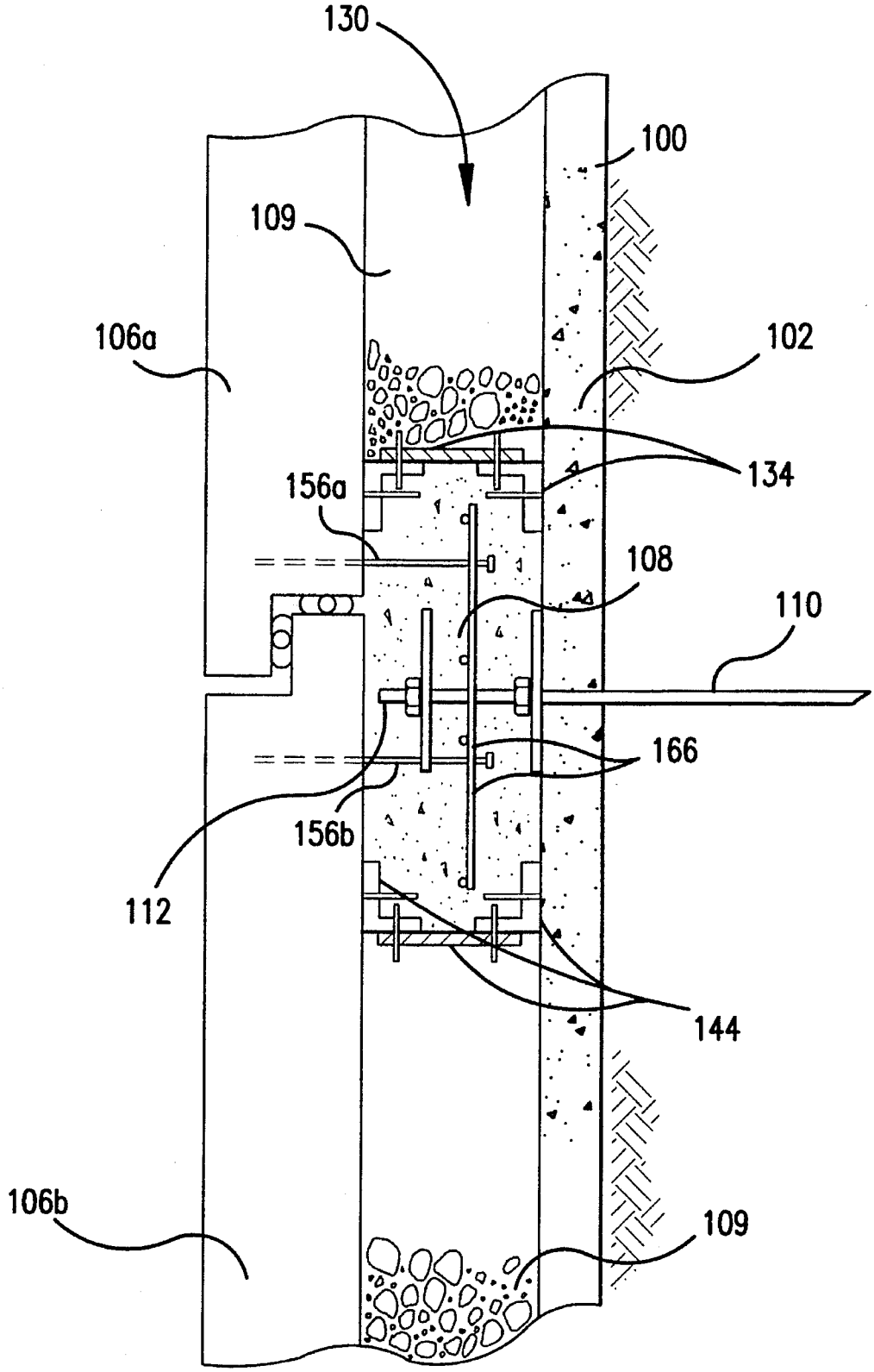

Alternatively, the formwork 134, 144 may be positioned as shown in FIGS. 16 and 25 when the backfill material 109 will be placed prior to the placement of the reinforced concrete 108. The backfill material 109 will thus exert pressure on the formwork 134, 144 as shown by the arrows B in FIGS. 16 and 25. This configuration is similarly self-closing. As shown by the arrows B in FIG. 25, the pressure of the backfill 109 will force the formwork to close when the form comes to rest against the bracket on the back face of the facing element 106*b*. FIG. 28 shows the formwork 134, 144 as used when the backfill material 109 is placed first, while FIG. 29 illustrates the completed wall upon subsequent placement of the reinforced concrete 108.

Figure 30:
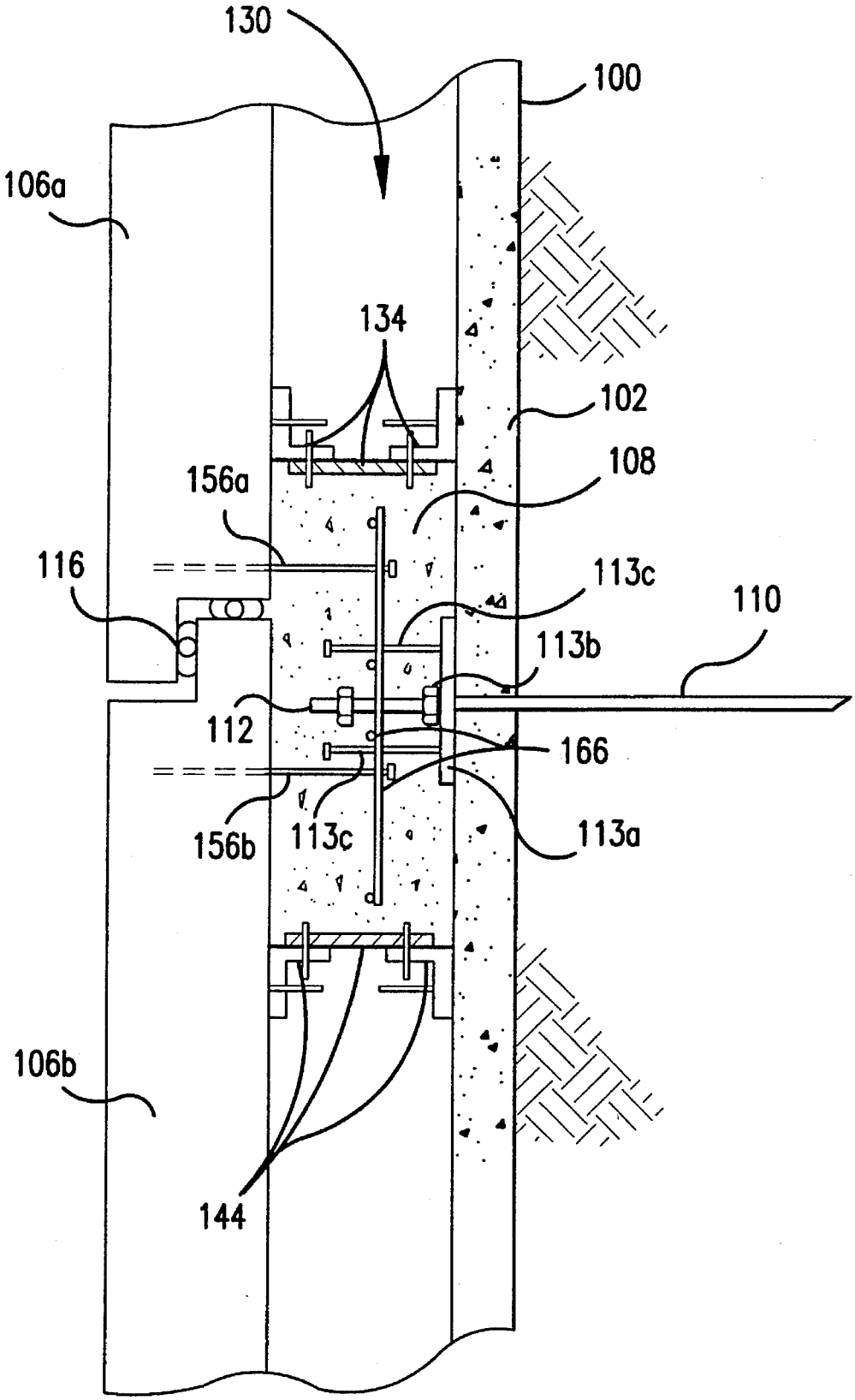
FIGS. 30–31 are partial plan views of an alternative construction of the first embodiment of the retaining wall of the present invention.
Figure 31:
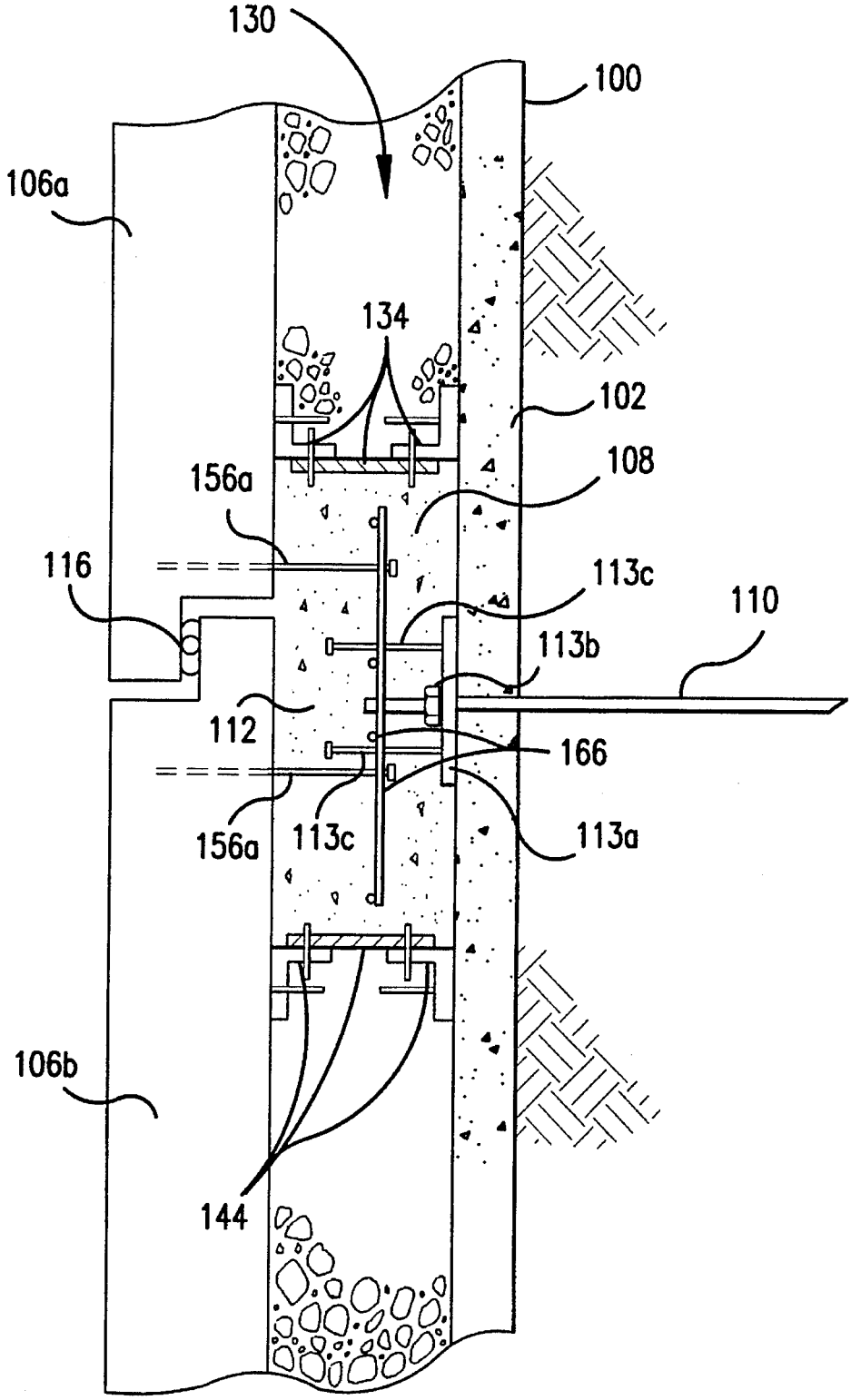

A further alternative configuration of this embodiment of the retaining wall of the present invention is shown in FIGS. 30 and 31. With this configuration, a gasket 116 is again used at the joint between the facing elements 106*a*, 106*b*. However, the joint is offset significantly from the end 112 of the nail 110. This allows for the use of only a single anchor means 156*a* in the area of the reinforced concrete closure extending from the first facing element 106*a*. Reinforcing steel 166 is used, as is an embedment anchor means 113*c*. Alternatively, a second bearing plate and second threaded fastening means could be used.

Figure 33:
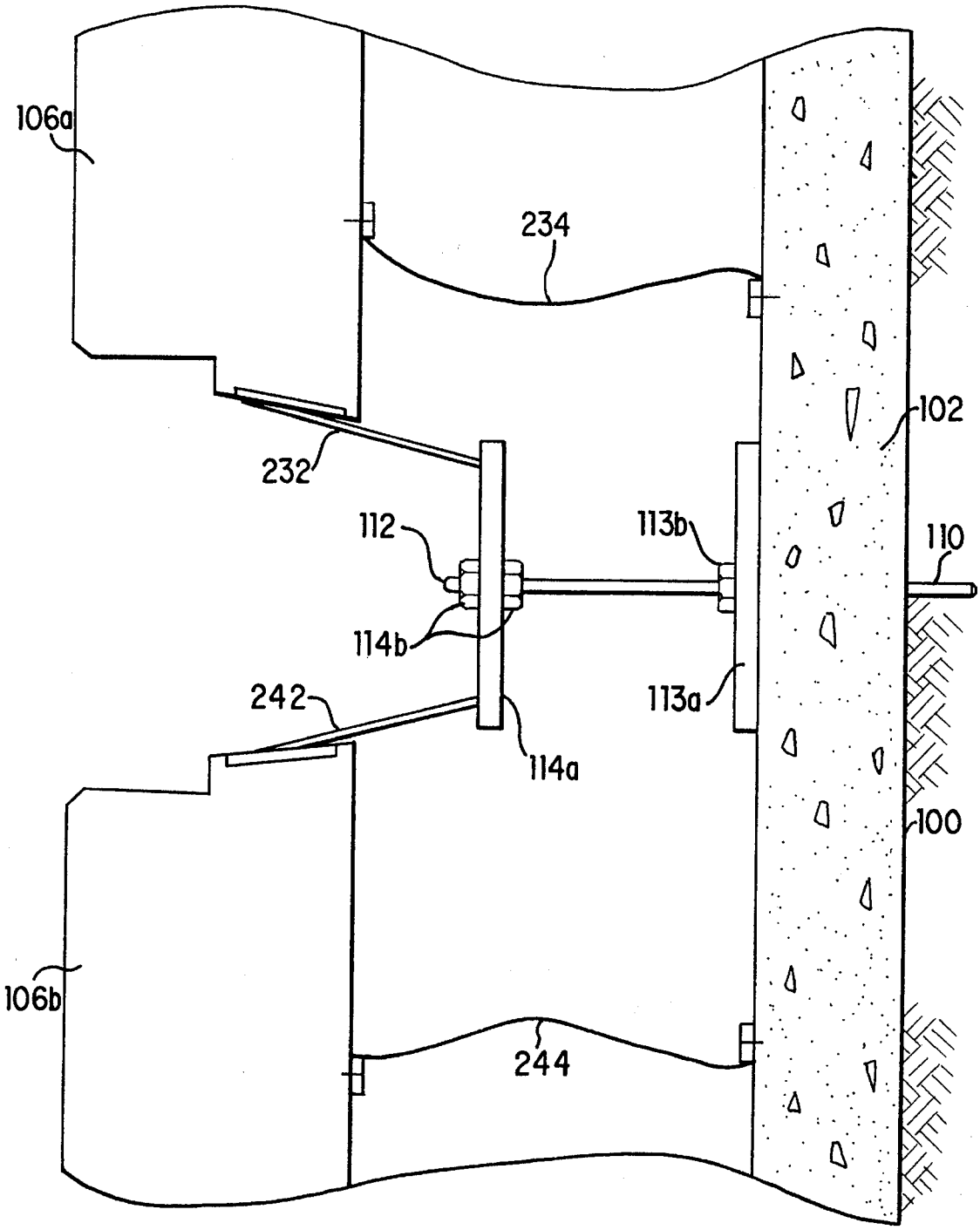
FIGS. 33 and 35 are partial plan views of the steps in the construction of a second embodiment of the retaining wall of the present invention.
Figure 34:
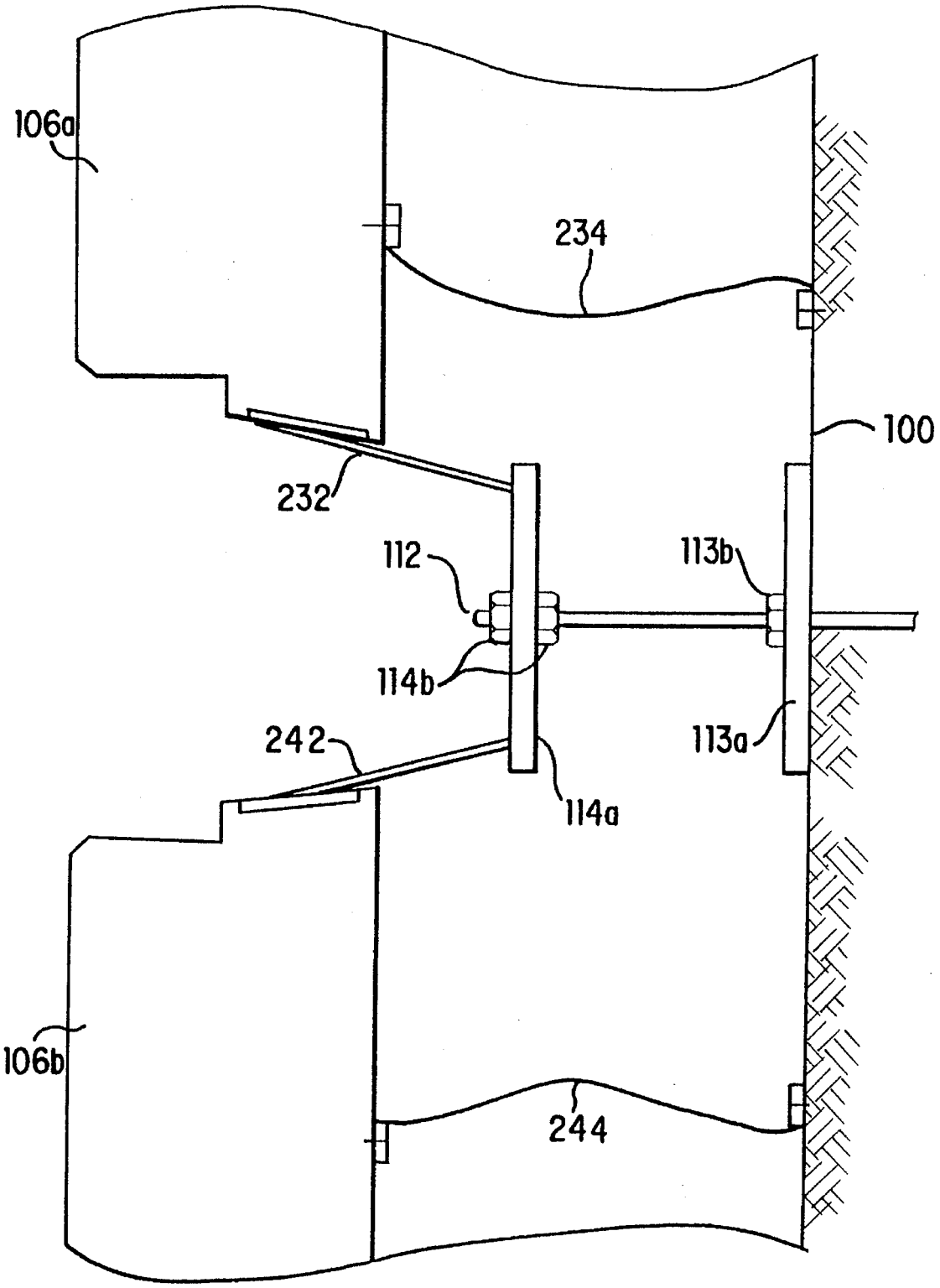
FIG. 34 is a partial plan view of a step in the construction of a second embodiment of the retaining wall of the present invention when a layer of shotcrete is not used for the temporary support means.
Figure 35:
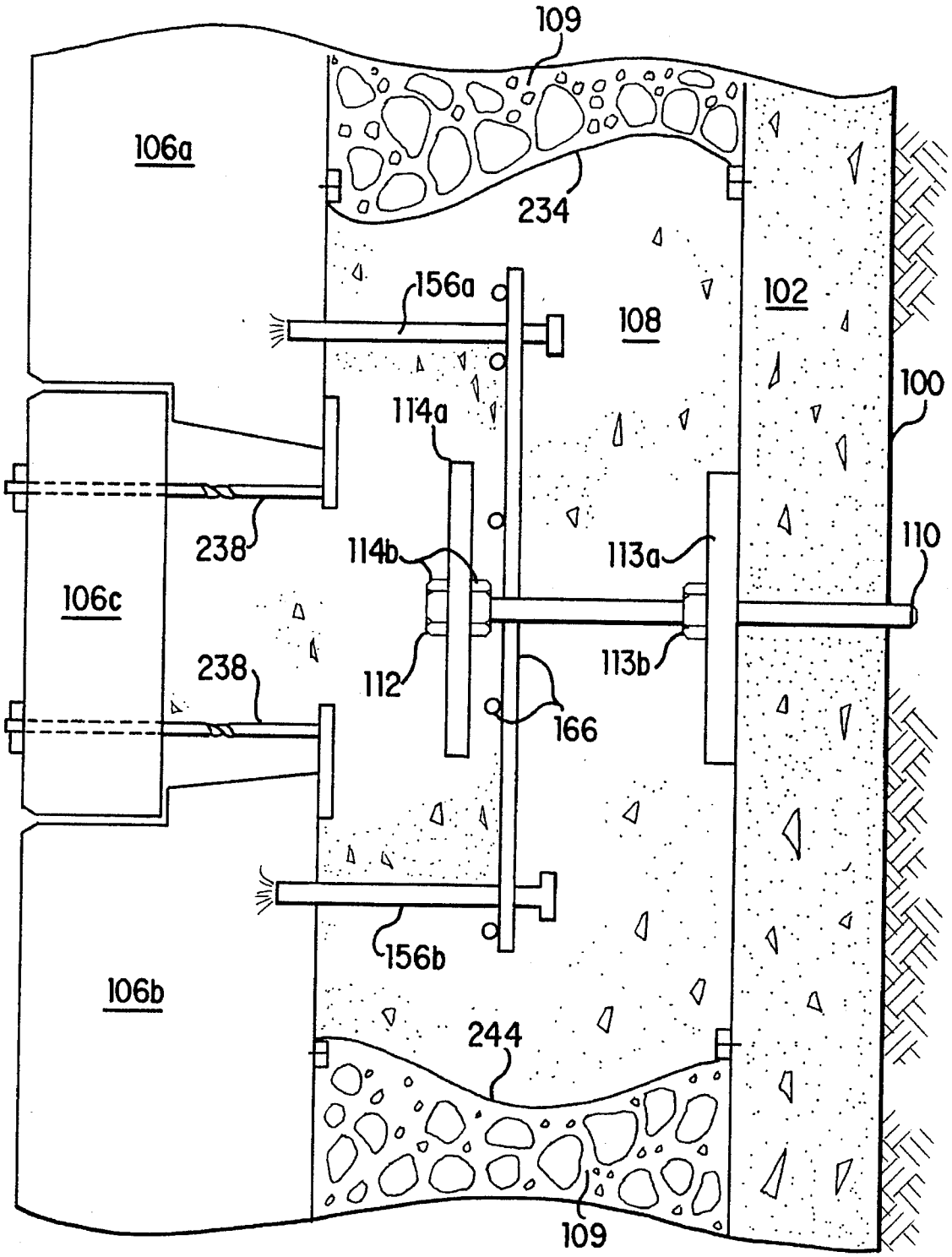
Figure 36:
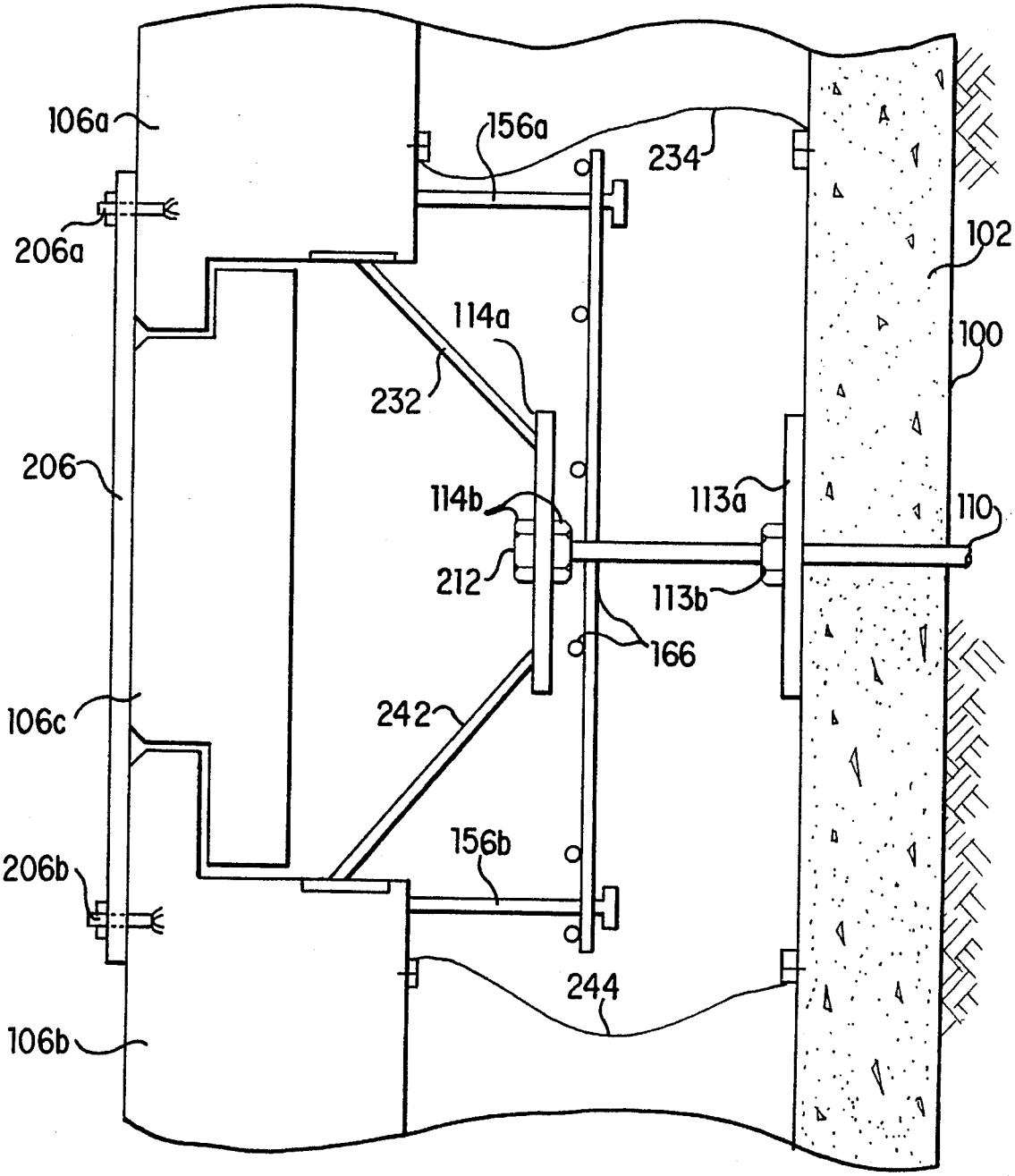
FIGS. 36–37 are partial plan views of the steps in the construction of an alternative construction of the second embodiment of the retaining wall of the present invention.

An alternative embodiment of the present invention is shown in FIGS. 33–37 and 40–41. In this embodiment of the present invention, a second attachment means is also used. The first ends of the first and second attachment means are first secured to the exposed cut face 100 through the temporary support means by securing them to the first end 112 of the nail 110. In this regard, temporary attachment means 232, 242 which are secured to the first end 112 of the nail 110 are used as shown in FIGS. 33, 34 and 36. The first attachment means 232 is used when erecting the first facing element 106*a*, and the second attachment means 242 similarly used in erecting the second facing element 106*b*. Any type of conventional attachment may be used, such as a steel bar and plate system. Once again, the attachment means 232, 242 are capable of resisting the pressures exerted on the facing elements 106*a*, 106*b* by the liquid concrete during placement of the reinforced concrete closure.

According to this embodiment of the present invention, after the facing elements 106*a*, 106*b* are erected using the attachment means 232, 242, first and second forms 234, 244 are then positioned adjacent to the shotcrete 102 disposed along the exposed cut face 100 as shown in FIG. 33. Alternatively, when no shotcrete 102 is used as shown in FIG. 34, the first and second forms 234, 244 are positioned directly adjacent to the exposed cut face 100 and secured thereto. Each of the first and second forms 234, 244 has first and second ends, with the first ends secured to the exposed cut face 100 directly or to the exposed cut face 100 through the layer of shotcrete 102. The second end of the first form 234 is secured to the first facing element 106*a*, while the second end of the second form 244 is secured to the second facing element 106*b*. Preferably, the first and second forms 234, 244 of this embodiment are flexible, such that they may be used regardless of the spacing between the facing elements 106*a*, 106*b* and the exposed cut face 100 or the layer of shotcrete 102 disposed along the exposed cut face 100. As discussed above, the flexible forms 234, 244 may be comprised of a heavy gage screen, chicken wire, or filter fabric. These forms 234, 244 may be secured in a rolled up condition to the rear surfaces of the facing elements 106*a*, 106*b* prior to erection. The flexible forms 234, 244 may then be rolled out to extend towards the exposed cut face 100 or the layer of shotcrete 102 and secured thereto. The forms 234, 244 could thus be used to extend across variable spaces between the facing elements 106*a*, 106*b* and the exposed cut face 100 or layer of shotcrete 102, thus eliminating the need for costly and time-consuming measuring and sizing in the field.

Figure 37:
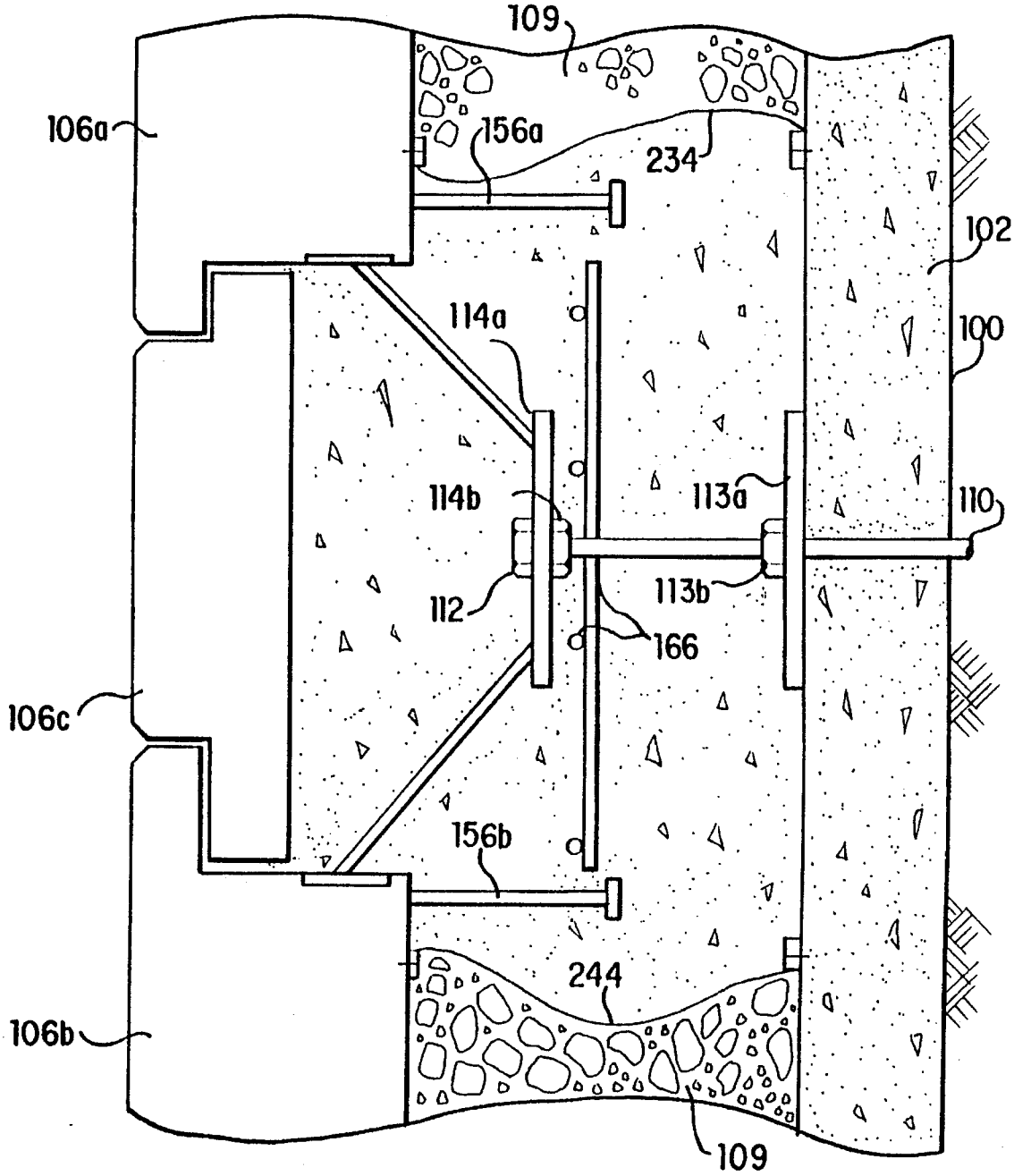
Figure 38:
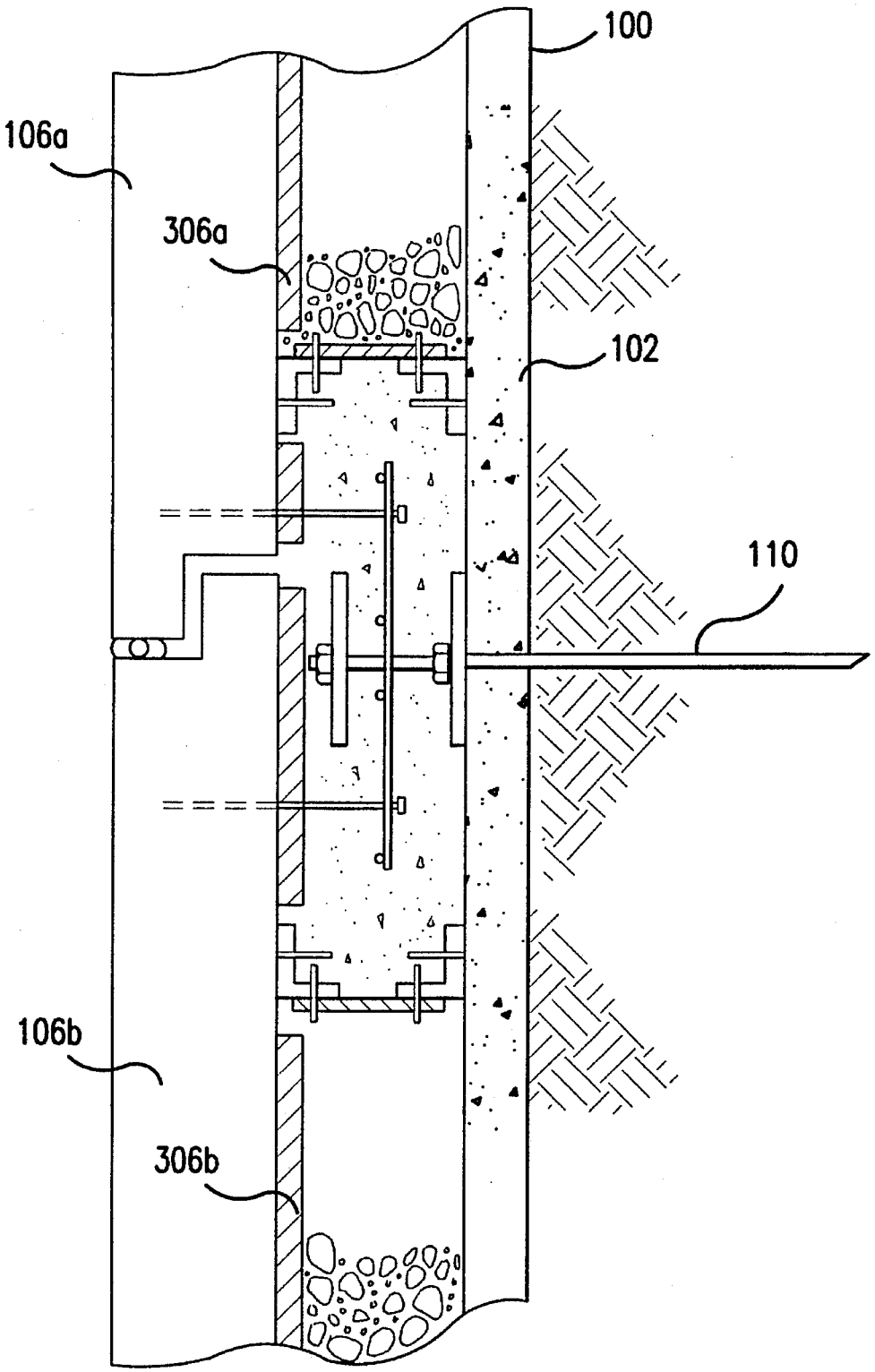
FIGS. 38–41 are partial plan views of the first and second embodiments of the retaining wall of the present invention showing the addition of further insulation means.
Figure 39:
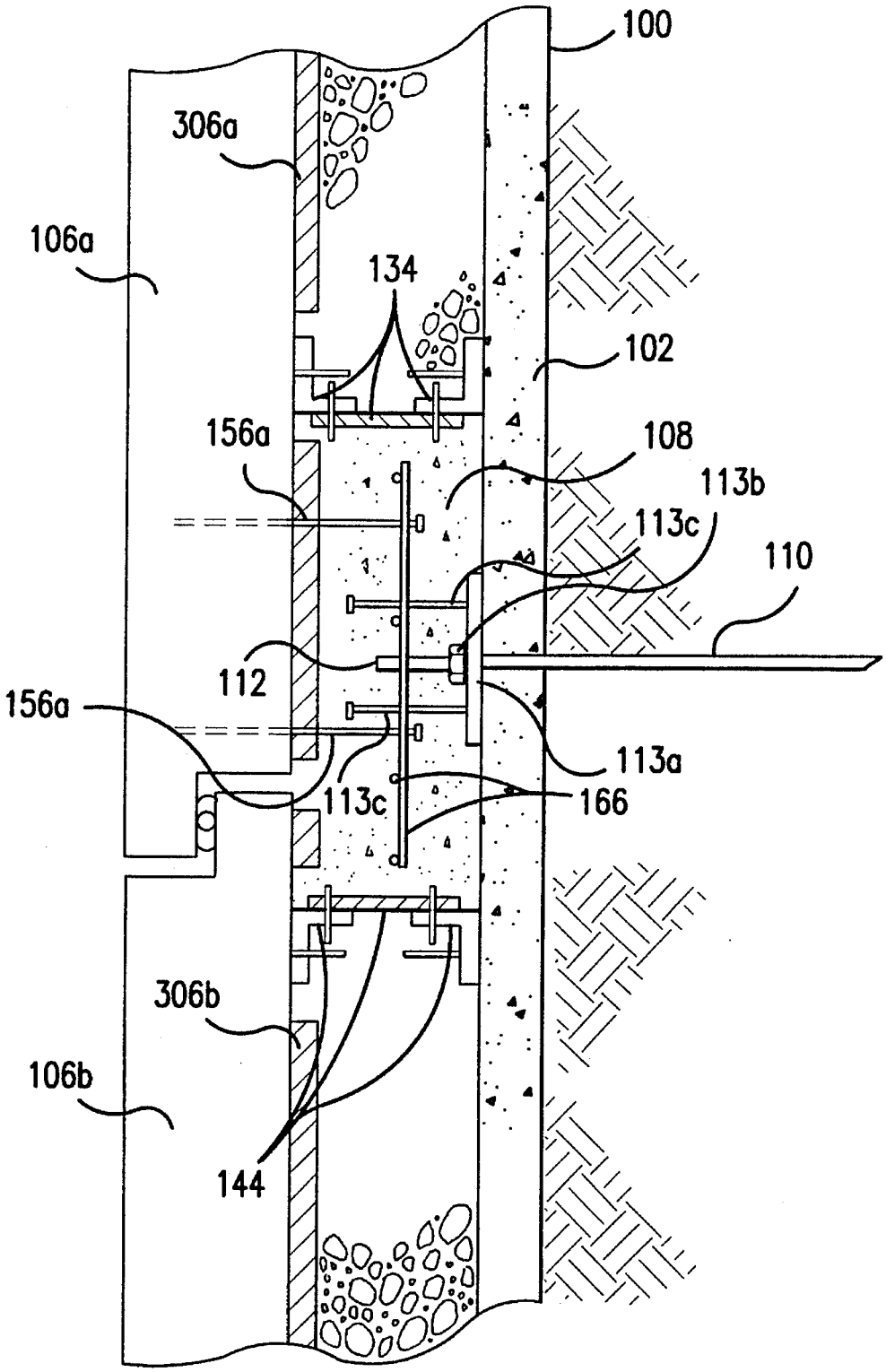
Figure 40:
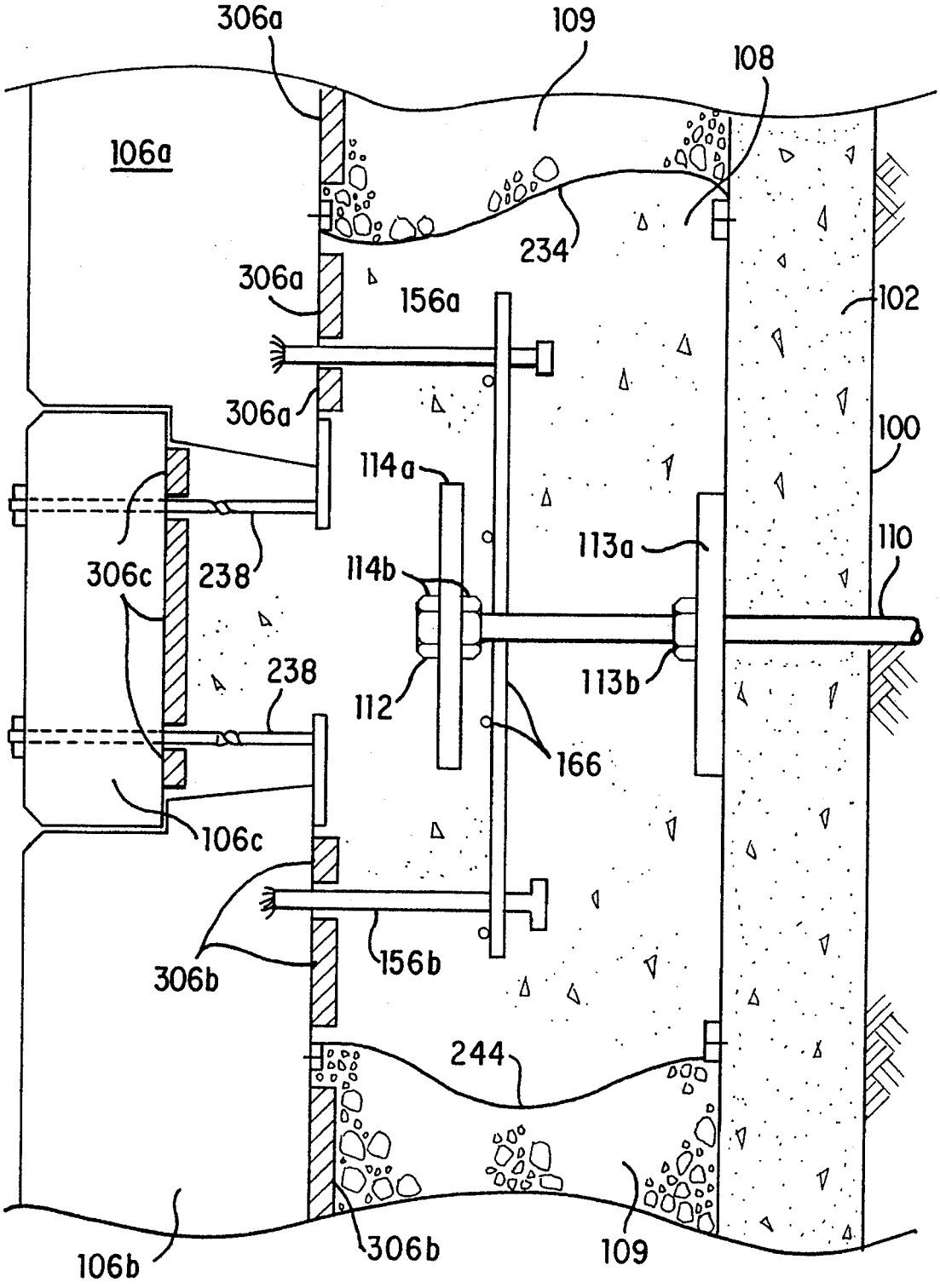
Figure 41:
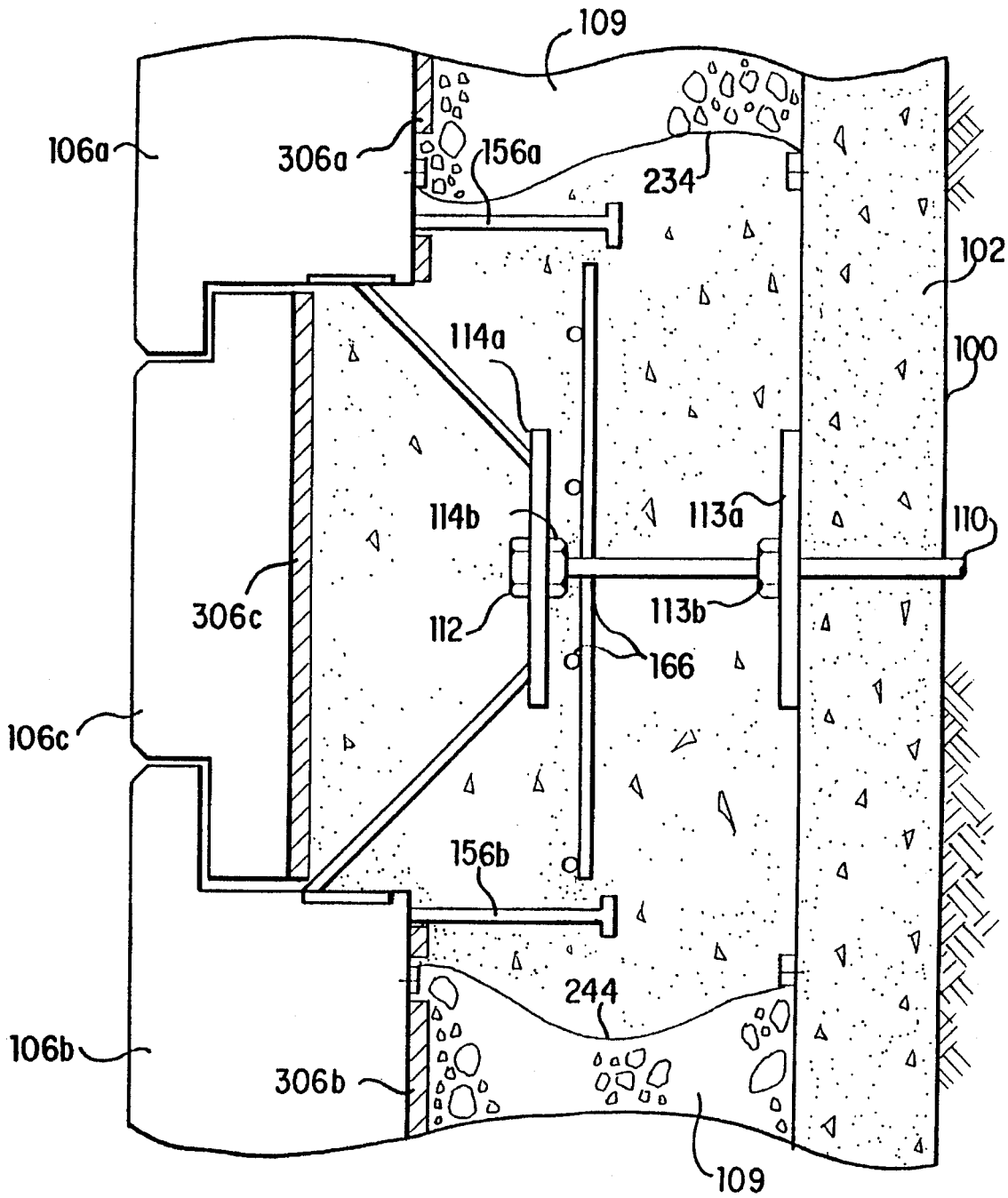

With this embodiment of the present invention, a third facing element 106*c*, preferably formed of precast concrete, may be erected adjacent to the first and second facing elements 106*a*, 106*b*. As shown in FIGS. 35–37, this third facing element 106*c* may be secured between the first and second facing elements 106*a*, 106*b* in any conventional manner known to those of ordinary skill in the art. For example, as shown in FIG. 35, a tapered form bolt 238 may be used. After the reinforced concrete is placed, the upper portion of this bolt 238 may be removed, and the hole patched to restore the smooth and continuous outer surface. Alternatively, as shown in FIG. 36, the third facing element 106*c* may be secured between the first and second facing elements 106*b*, 106*c* with a waler, strongback, or horizontal beam 206. The waler 206 is positioned and secured to the first and second facing elements 106*a*, 106*b* with a connection means 206*a*, 206*b* such that the third facing element 106*c* is held in place while the reinforced concrete closure 108 is placed. After placing the reinforced concrete 108, the waler 206 and connection means 206*a*, 206*b* may be removed, and any holes patched to restore the smooth and continuous outer surface as shown in FIG. 37.

If used, the third facing element 106*c* serves to complete the outer face, and also conveniently provides a form for the reinforced concrete closure 108. As shown in FIGS. 35 and 37, the isolated closure is formed when the reinforced concrete 108 is placed along the area of the retaining wall between the first and second forms 234, 244. The reinforced concrete 108 may again be comprised of reinforced cast-in-place concrete or reinforced pneumatically applied concrete (shotcrete). Similar to the embodiment described above, the reinforced concrete 108 is placed adjacent to the first end 112 of the nail 110 between the exposed cut face 100 or the layer of shotcrete 102 disposed along the exposed cut face 100, the first, second and third facing elements 106*a*, 106*b*, 106*c*, and the first and second forms 234, 244. Again, the wall is completed by placing backfill material 109 along the area of the retaining wall exterior of the first and second forms 234, 244, i.e., between the exposed cut face 100 or the layer of shotcrete 102 disposed along the exposed cut face and the first and second facing elements 106*a*, 106*b* exterior of the first and second forms 234, 244.

Notably, if a third facing element is not used, shotcrete may advantageously be used to form the reinforced concrete closure pour. With this configuration, shotcrete fills the area between adjacent facing elements 106*a* and 106*b* shown in FIGS. 33–34. Because shotcrete is very stiff, it may be placed and trimmed to set up where desired. The shotcrete may thus be placed and trimmed so as to be flush with the outer face of the adjacent facing elements 106*a*, 106*b*. The exposed shotcrete closure pour thus forms a part of a continuous outer face for the retaining wall.

Either of the above-described embodiments of the present invention may be used with full-height precast facing elements or with successive tiers of precast facing elements. If full height panels are used, successive tiers of nails must be vertically aligned to ensure proper attachment to the facing elements and to allow for the use of an isolated cast-in-place concrete closure. If, however, successive tiers of facing elements are used, the nails need not line up, and a staggered joint system may be employed.

Further, as noted above, the facing elements 106*a*, 106*b*, 106*c* and the excavated cut are separated in accordance with present invention, and the space between them which is not adjacent to the nail is filled with free draining backfill material. With this configuration, an air space is created which insulates the ground formation along the cut from the cold air temperatures. This insulation helps to prevent the ground formation from freezing and causing damage to the wall. As shown in FIGS. 38–41, this insulating effect may be further increased if one or more layers of insulation material 306*a*, 306*b*, 306*c* is added to the rear surfaces of the facing elements 106*a*, 106*b*, 106*c*. The added layer of insulation 306*a*, 306*b*, 306*c* is designed to extend along the rear surfaces of the facing elements 106*a*, 106*b*, 106*c* in the area of the wall between the facing elements 106*a*, 106*b*, 106*c* and the cut face. The layer or layers of insulation 306*a*, 306*b*, 306*c* may be added to the facing elements 106*a*, 106*b*, 106*c* prior to erection, or after the elements 106*a*, 106*b*, 106*c* have been placed along the wall.

Figure 42:
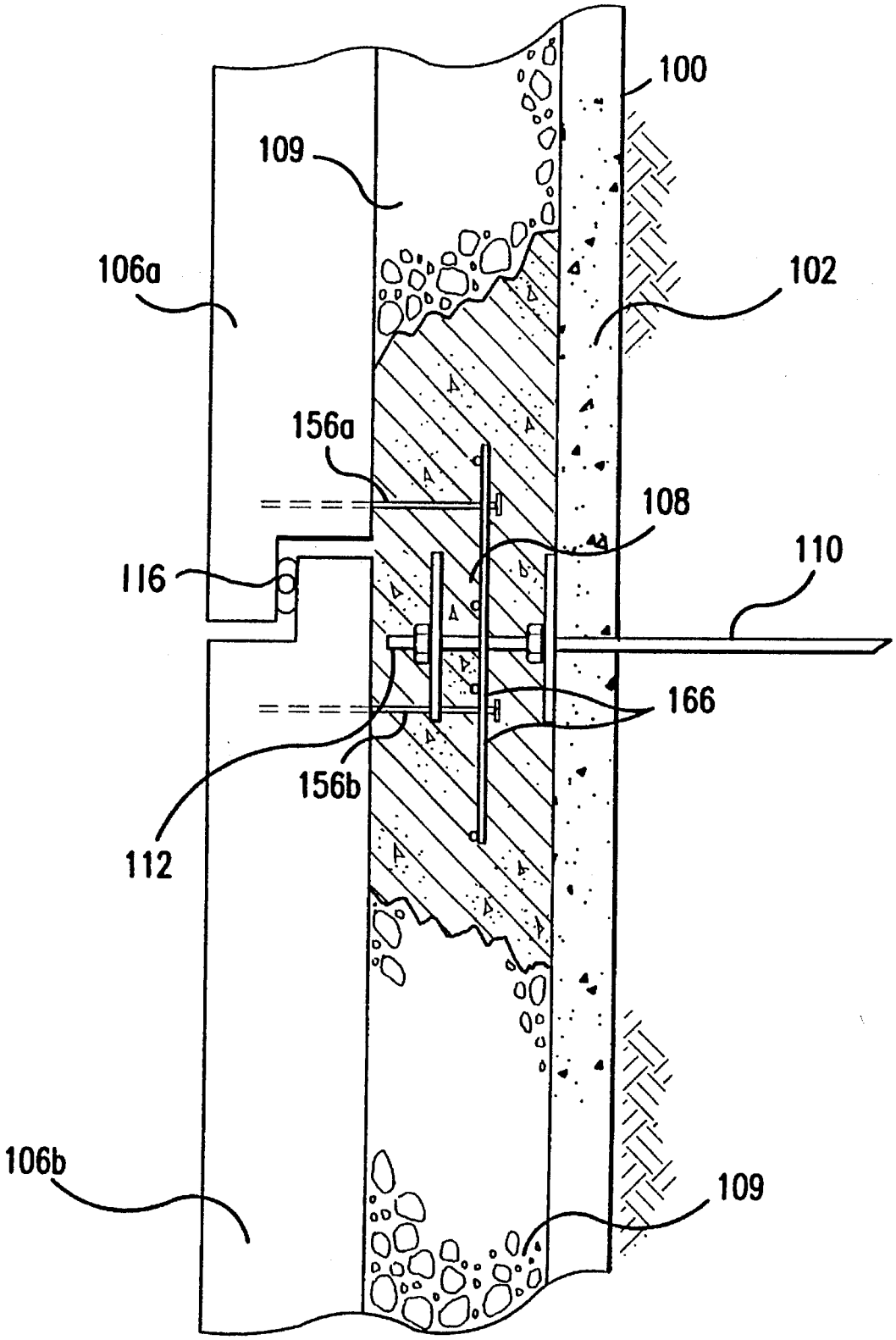
FIGS. 42–48 are partial plan views of the first and second embodiments of the retaining wall of the present invention showing a reinforced concrete closure comprised of shotcrete.
Figure 43:
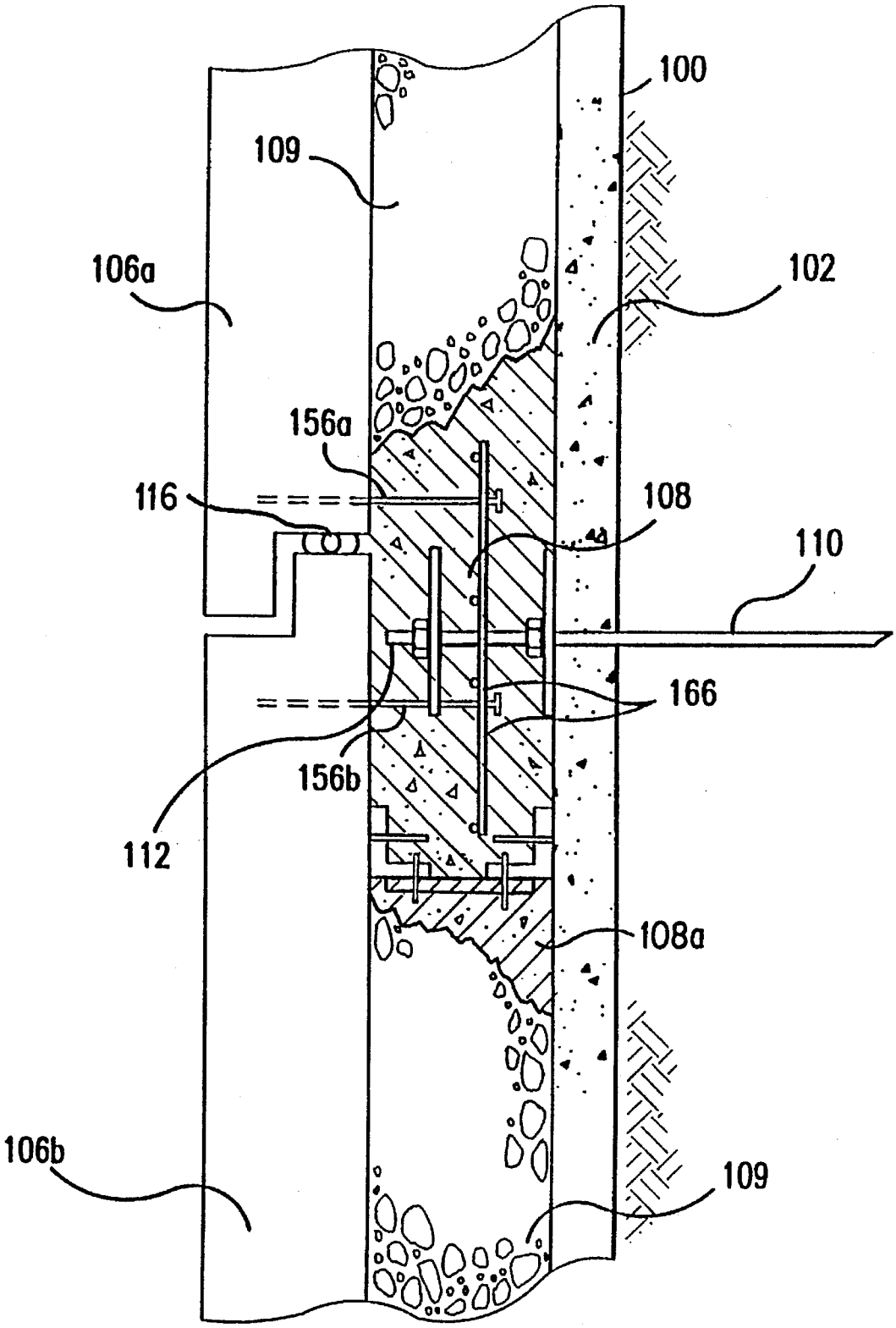
Figure 44:
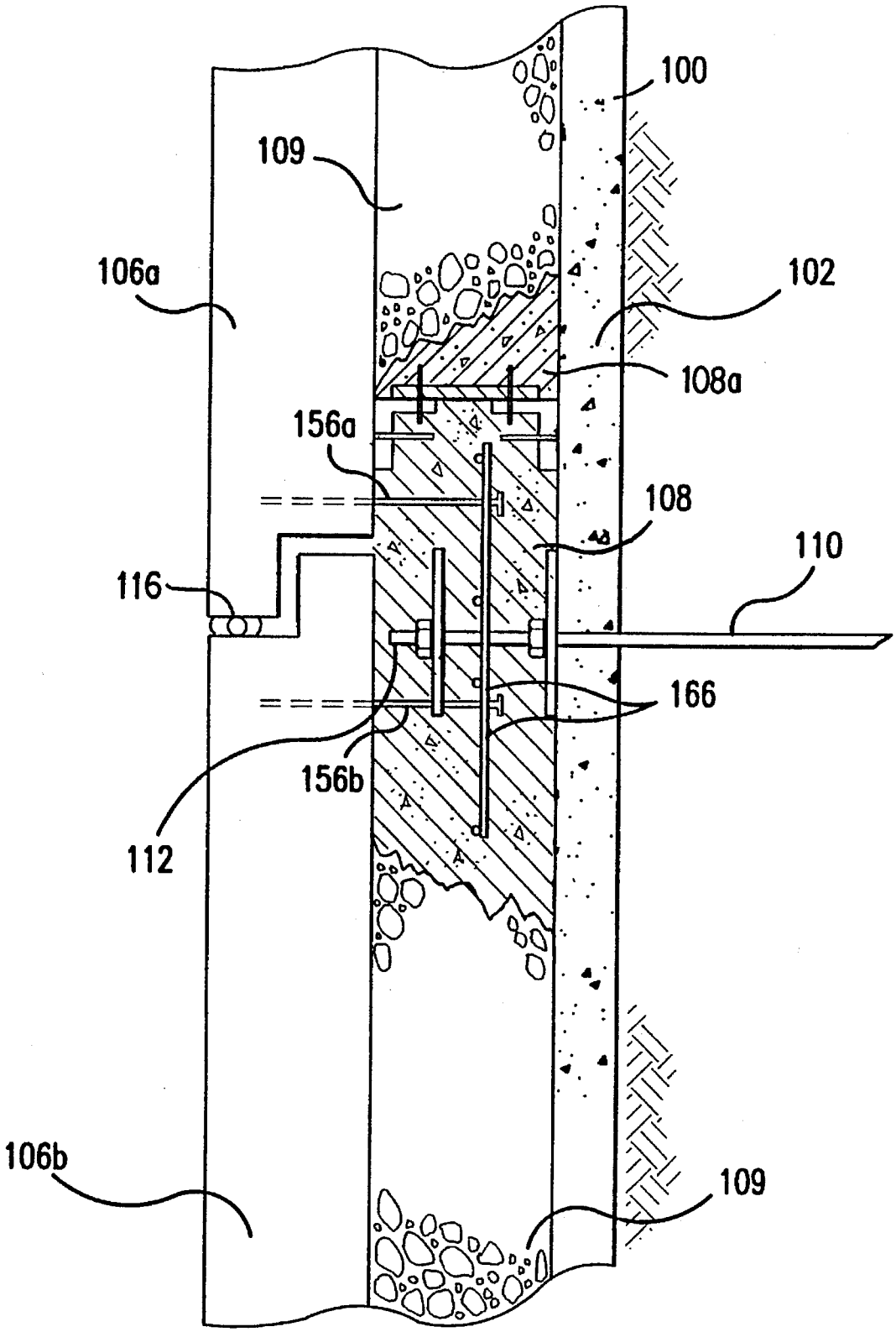
Figure 45:
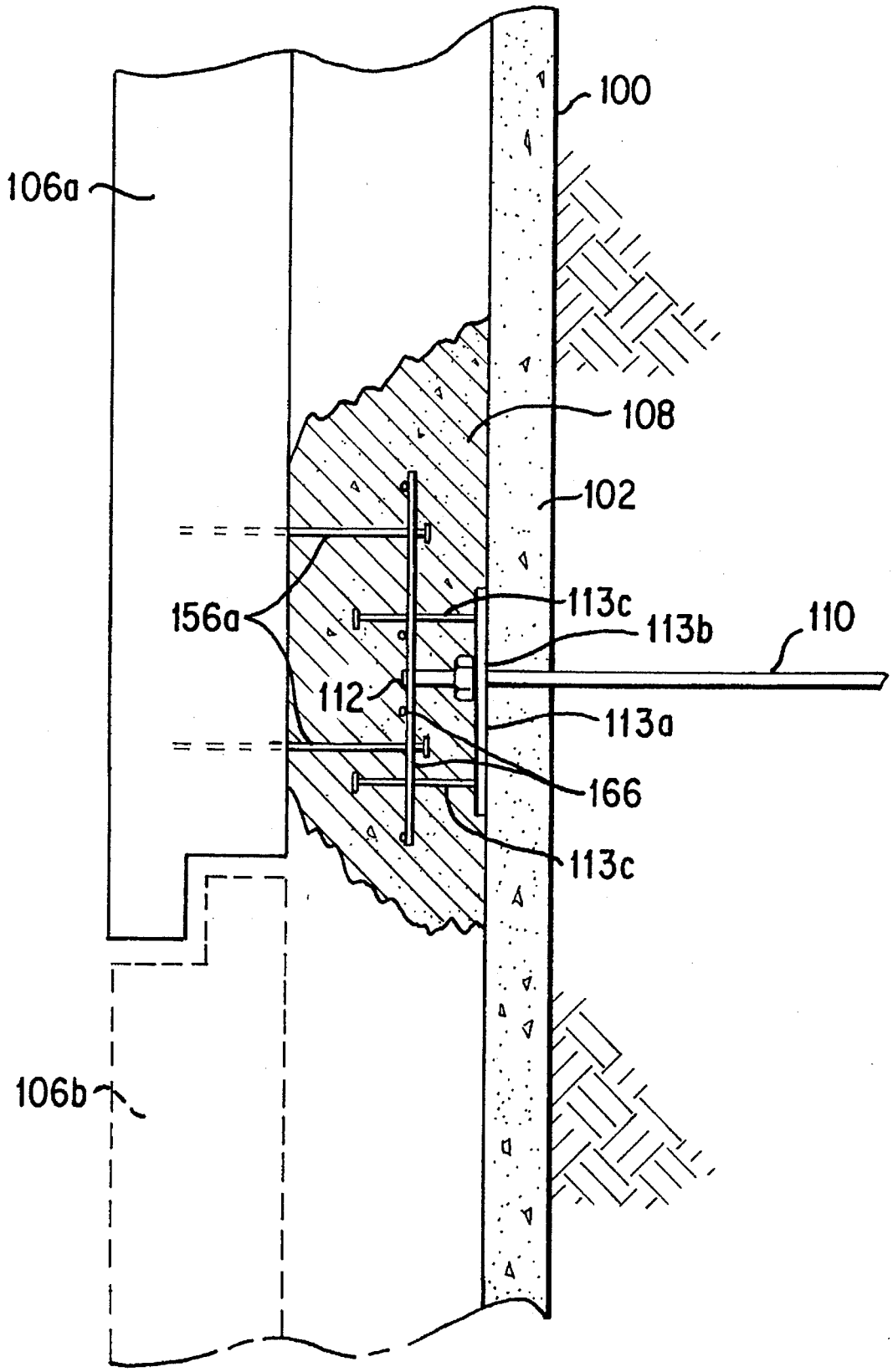
Figure 46:
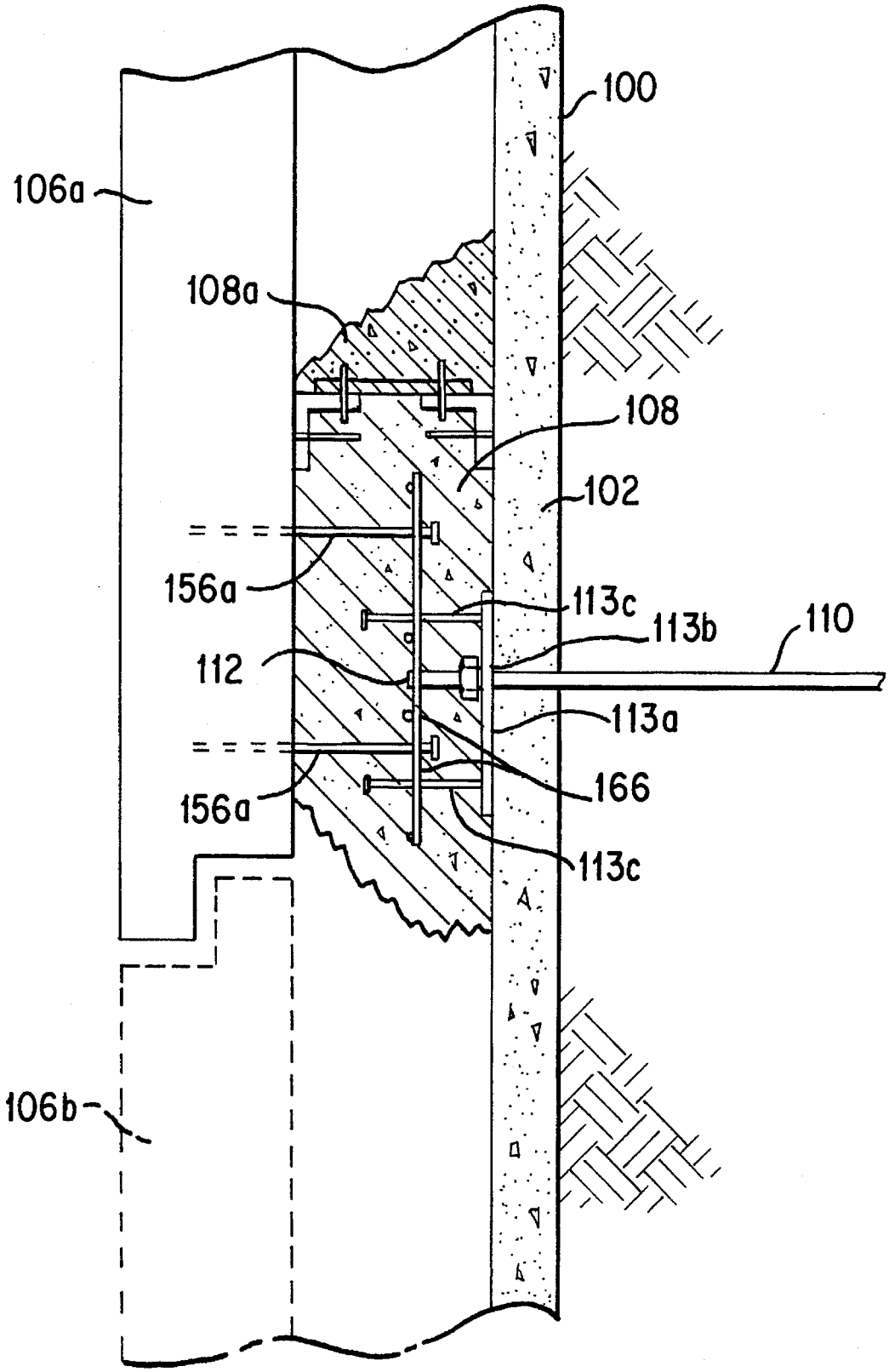
Figure 47:
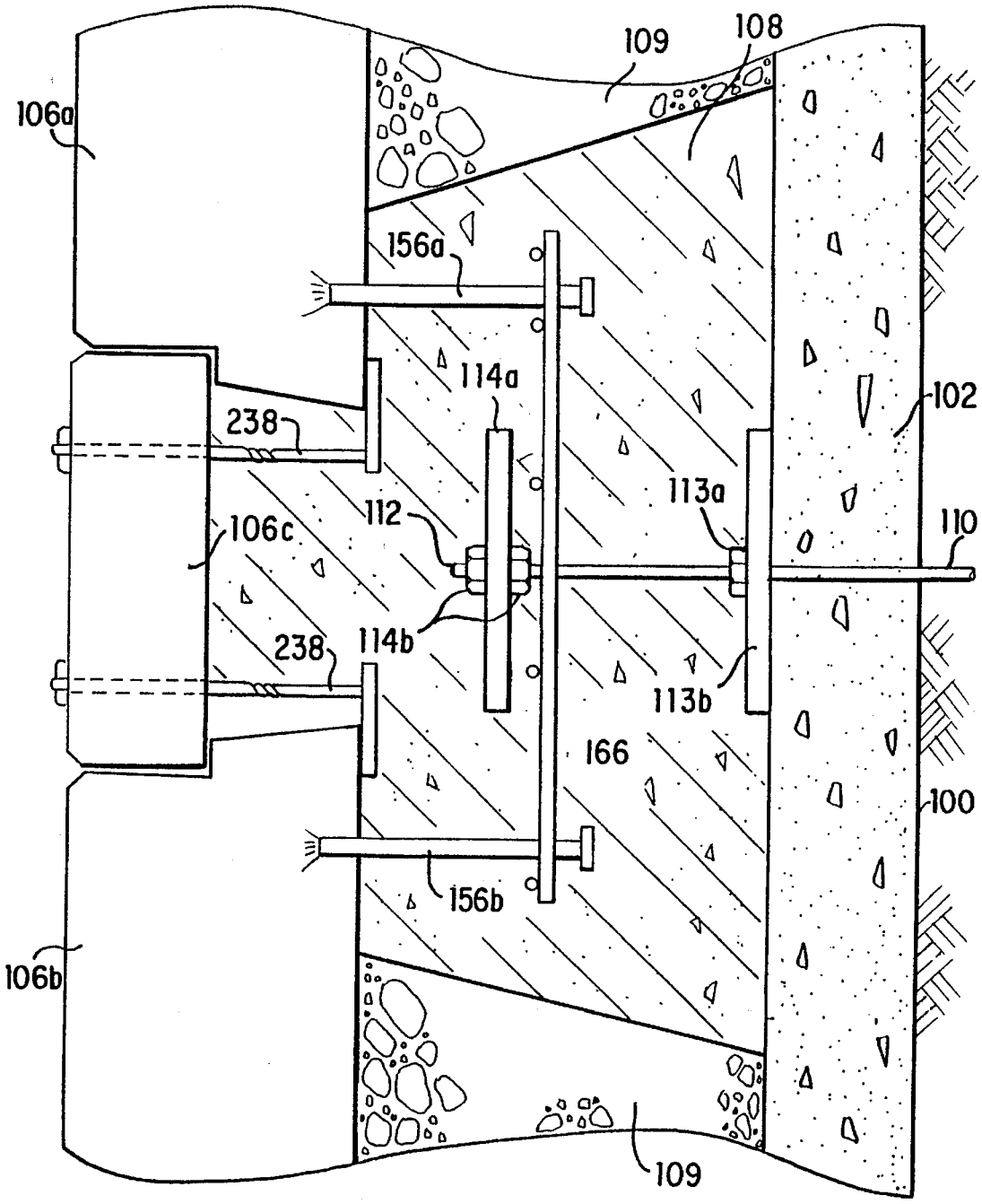
Figure 48:
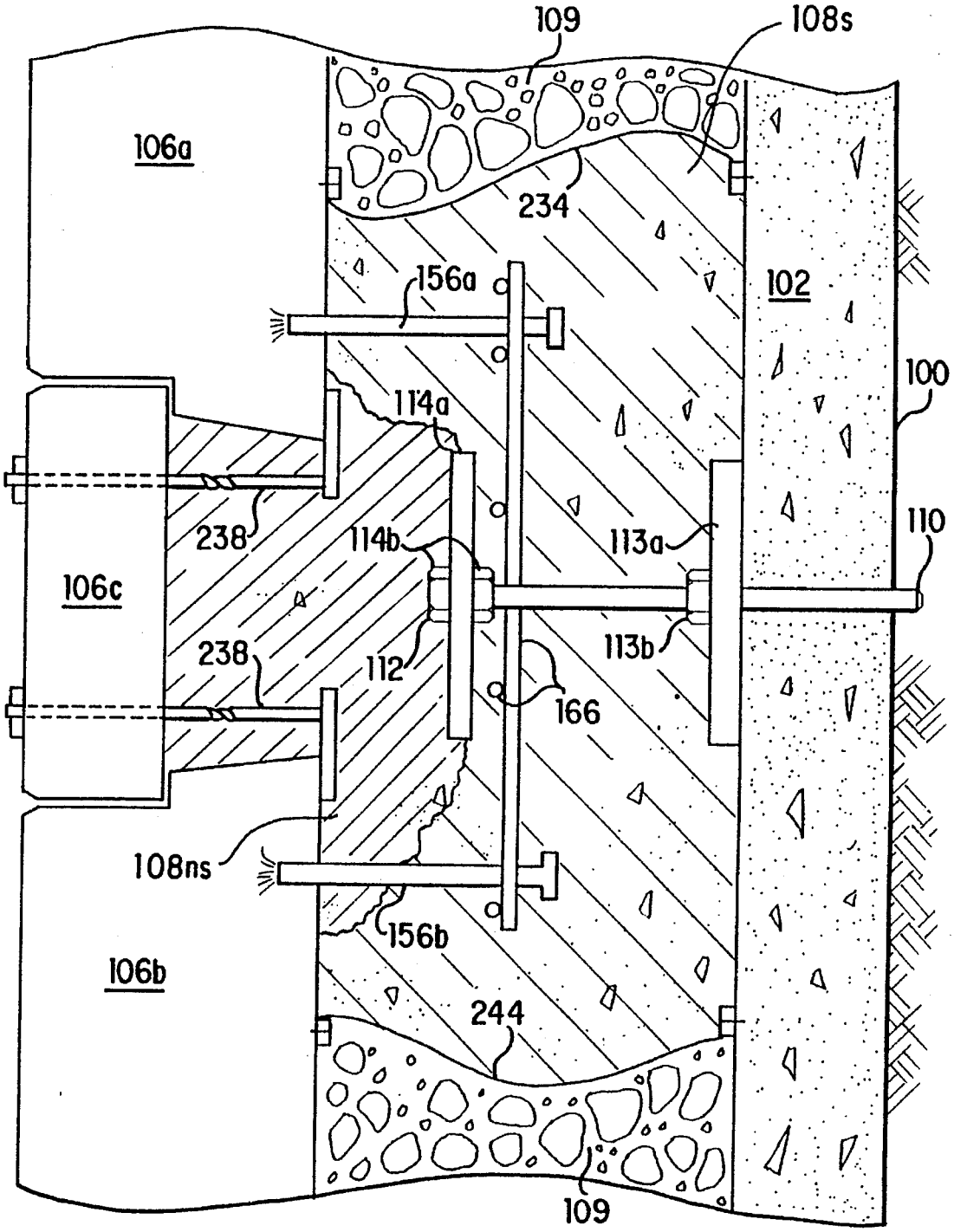

With either of the above-described embodiments of the present invention, the reinforced concrete closure 108 may be comprised of reinforced cast-in-place concrete or shotcrete. The concrete closures shown in FIGS. 26–32, 35 and 37–41 may be formed either from cast-in-place concrete or shotcrete, while a closure specifically comprised of shotcrete is shown in FIGS. 42–48. With a shotcrete closure as shown in FIGS. 42, 45 and 47, formwork may not be required between the facing elements 106*a*, 106*b* and the exposed cut face 100 or the layer of shotcrete 102 disposed therealong. Forms may be unnecessary when shotcrete is used for the closure 108 since the shotcrete itself is very stiff and can be placed and trimmed to set up where desired. Alternatively, of course, the shotcrete may be used in connection with formwork disposed along one or both sides of the closure, as shown in FIGS. 43–44, 46 and 48. If formwork is disposed along one side of the closure as shown in FIGS. 43–44 and 46, a shotcrete fillet 108*a* may be used for further support. Also, with the embodiment shown in FIG. 48, a combination of secondary (structural) shotcrete 108*s* and non-structural concrete or shotcrete (fill) 108*ns* may be used. A shotcrete closure is advantageous because it may eliminate the need for extensive formwork and because it exerts less pressure on the facing elements 106*a*, 106*b* than a comparable cast-in-place concrete closure. Finally, as with all of the embodiments of the present invention as discussed above, backfill material 109 is added to the remaining space of the retaining wall once the shotcrete closures 109 are in place.

Figure 49:
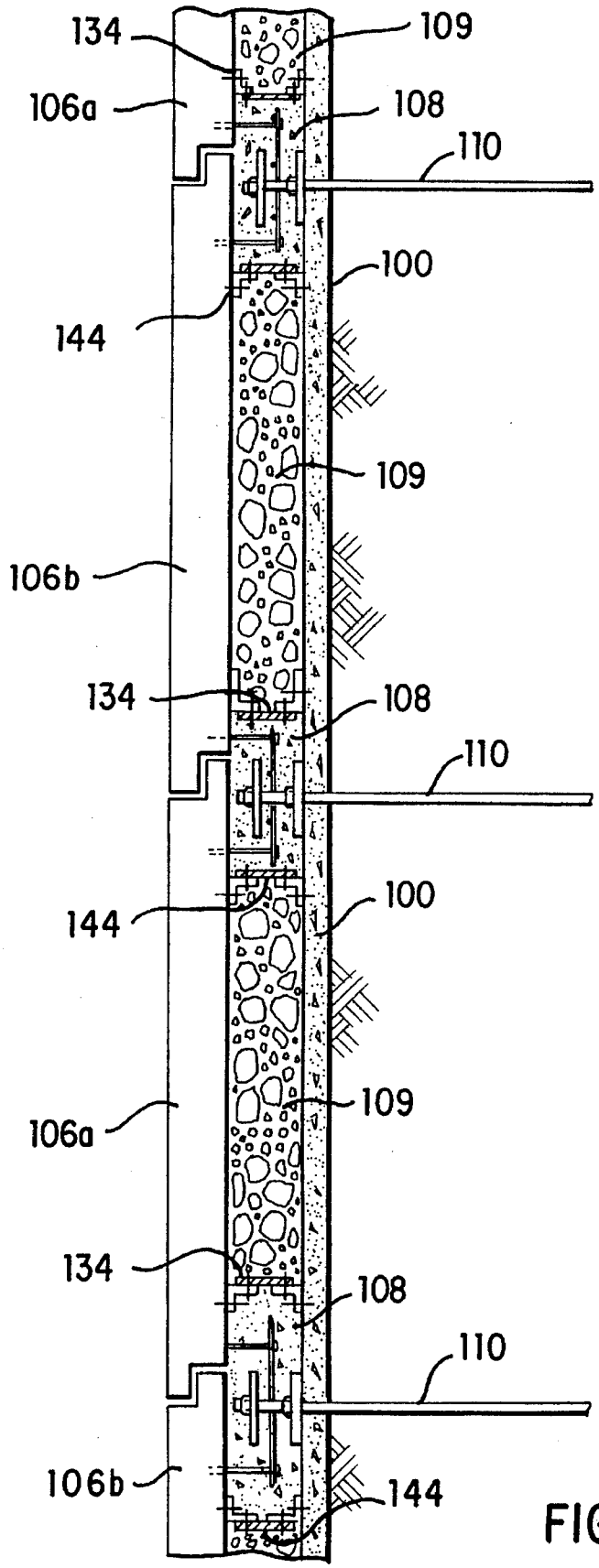
FIG. 49 is a more complete plan view of the retaining wall of the present invention showing multiple facing elements and multiple reinforced concrete closures.

FIG. 49 shows a more complete section of a finished retaining wall constructed according to the present invention. Multiple facing elements 106*a*, 106*b* are disposed along the outer face of the retaining wall and are connected to multiple nails 110 via multiple isolated reinforced concrete closures 108. The reinforced concrete closures 108 are disposed at points along the wall adjacent to the exposed ends of the nails 110. The reinforced concrete closures 108 are defined by the individual sets of formwork 134, 144 which are similarly disposed adjacent to the exposed ends of the nails 110.

Figure 50:
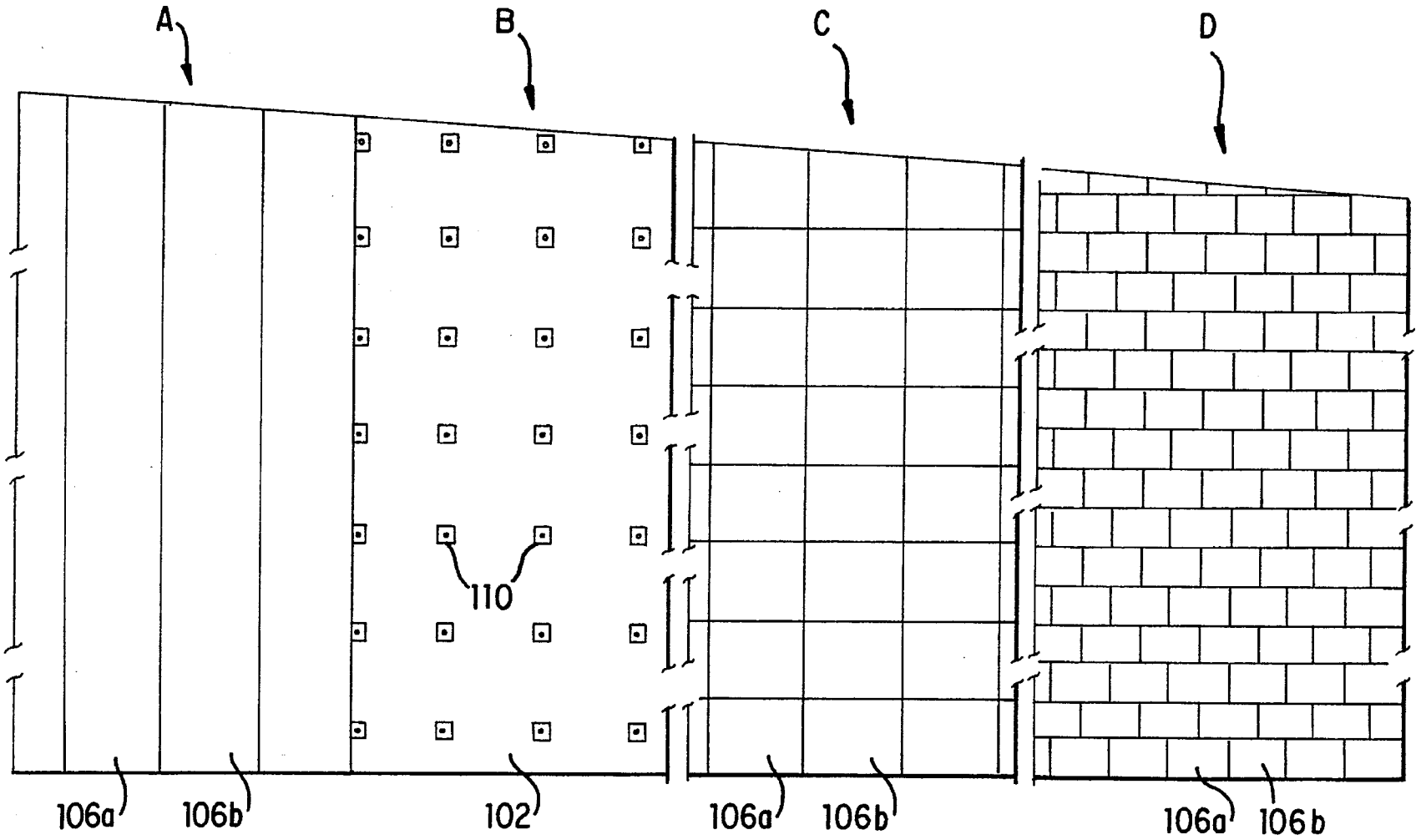
FIG. 50 is a partially broken away elevational view showing the retaining wall of the present invention at various stages of construction and showing various facing elements including full-height panels, segmental panels, and blocks.

FIG. 50 shows a partially broken away elevational view of the retaining wall of the present invention at various stages of construction, and various facing elements including full-height panels, segmental panels, and blocks. Area A shows the retaining wall of the present invention with a plurality of full-height precast facing elements 106*a*, 106*b* in place. Area B shows the temporary support means including the nails 110 and/or layer of shotcrete 102 in place and ready for placement of the facing elements. Area C shows the retaining wall of the present invention with a plurality of precast facing elements 106*a*, 106*b* in place which are not full-height panels. Finally, area D shows a plurality of masonry block or Ivany Block® facing elements 106*a*, 106*b* as the outer face of the retaining wall of the present invention.

From the foregoing detailed description, it will be evident that there are a number of changes, adaptations and modifications of the present invention which come within the province of those skilled in the art. It is intended that all such variations not departing from the spirit of the invention be considered as within the scope thereof as limited solely by the claims appended hereto.

What is claimed is:

1. A method of constructing a retaining wall comprising the following steps:

excavating a cut in successive sections to form exposed cut faces;

temporarily shoring up the exposed cut face of each successively excavated section with a temporary support means, said temporary support means comprising a nail installed through the exposed cut face into the ground, a first end of said nail extending outwardly from said exposed cut face; and forming an outer face by positioning a first attachment means adjacent to said exposed cut face, said first attachment means having a first end and a second end, securing said first end of said first attachment means to said exposed cut face, erecting a first facing element, securing said first facing element to said second end of said first attachment means, erecting a second facing element adjacent to said first facing element, placing reinforced concrete along the area of said retaining wall adjacent to said first end of said nail between said exposed cut face and said first and second facing elements, said reinforced concrete thereby forming a permanent structural connection between said first and second facing elements and said nail by encasing said first end of said nail, and placing backfill material along the remaining area of said retaining wall between said exposed cut face and said first and second facing elements.

2. The method of constructing a retaining wall of claim 1 wherein the step of securing said first end of said first attachment means to said exposed cut face comprises securing said first end of said first attachment means directly to said exposed cut face.

3. The method of constructing a retaining wall of claim 1 wherein the step of forming an outer face further comprises:

positioning first and second forms adjacent to said exposed cut face, said first and second forms each having first and second ends, securing said first ends of said first and second forms to said exposed cut face, positioning said second end of said first form adjacent to said first facing element, and positioning said second end of said second form adjacent to said second facing element, such that the step of placing reinforced concrete places reinforced concrete along the area of said retaining wall between said first and second forms, and such that the step of placing backfill material places backfill material along the area of said retaining wall exterior of said first and second forms.

4. The method of constructing a retaining wall of claim 1 wherein the step of positioning the first attachment means comprises positioning a first form adjacent to said exposed cut face, said first form having a first end and a second end, wherein the step of securing said first end of said first attachment means to said exposed cut face comprises securing said first end of said first form to said exposed cut face, and wherein the step of securing said first facing element to said second end of said first attachment means comprises securing said second end of said first form to said first facing element.

5. The method of constructing a retaining wall of claim 4 wherein the step of forming an outer face further comprises:

positioning a second form adjacent to said exposed cut face, said second form having a first end and a second end, securing said first end of said second form to said exposed cut face, and positioning said second end of said second form adjacent to said second facing element, such that the step of placing reinforced concrete places reinforced concrete along the area of said retaining wall between said first and second forms, and such that the step of placing backfill material places backfill material along the area of said retaining wall exterior of said first and second forms.

6. The method of constructing a retaining wall of claim 1 wherein the step of forming an outer face further comprises:

positioning a second attachment means adjacent to said exposed cut face, said second attachment means having a first end and a second end, securing said first end of said second attachment means to said exposed cut face, and securing said second facing element to said second end of said second attachment means.

7. The method of constructing a retaining wall of claim 6 wherein the step of securing said first ends of said first and second attachment means to said exposed cut face comprises securing said first ends of said first and second attachment means to said first end of said nail.

8. The method of constructing a retaining wall of claim 7 further comprising the steps of:

positioning first and second forms adjacent to said exposed cut face, each of said first and second forms having first and second ends, securing said first ends of said first and second forms to said exposed cut face, securing said first facing element to said second end of said first form, and securing said second facing element to said second end of said second form, such that the step of placing reinforced concrete places reinforced concrete along the area of said retaining wall between said first and second forms, and such that the step of placing backfill material places backfill material along the area of said retaining wall exterior of said first and second forms.

9. The method of constructing a retaining wall of claim 8 further comprising the steps of:

erecting a third facing element adjacent to said first and second facing elements, and securing said third facing element between said first and second facing elements, such that the step of placing reinforced concrete places reinforced concrete along the area of said retaining wall between said exposed cut face and said first, second and third facing elements.

10. The method of constructing a retaining wall of claim 1 wherein said temporary support means further comprises a layer of barrier material disposed along the exposed cut face.

11. The method of constructing a retaining wall of claim 1 wherein said temporary support means further comprises a layer of pneumatically applied concrete, and wherein the step of securing said first end of said first attachment means to said exposed cut face comprises securing said first end of said first attachment means to said temporary support means.

12. The method of constructing a retaining wall of claim 11 wherein the step of securing said first end of said first attachment means to said temporary support means comprises securing said first end of said first attachment means to said layer of pneumatically applied concrete.

13. The method of constructing a retaining wall of claim 12 wherein the step of forming an outer face further comprises:

positioning first and second forms adjacent to said temporary support means, said first and second forms each having first and second ends, securing said first ends of said first and second forms to said layer of pneumatically applied concrete, positioning said second end of said first form adjacent to said first facing element, and positioning said second end of said second form adjacent to said second facing element, such that the step of placing reinforced concrete places reinforced concrete along the area of said retaining wall between said first and second forms, and such that the step of placing backfill material places backfill material along the area of said retaining wall exterior of said first and second forms.

14. The method of constructing a retaining wall of claim 11 wherein the step of positioning the first attachment means comprises positioning a first form adjacent to said temporary support means, said first form having a first end and a second end, wherein the step of securing said first end of said first attachment means to said temporary support means comprises securing said first end of said first form to said layer of pneumatically applied concrete, and wherein the step of securing said first facing element to said second end of said first attachment means comprises securing said second end of said first form to said first facing element.

15. The method of constructing a retaining wall of claim 14 wherein the step of forming an outer face further comprises:

positioning a second form adjacent to said temporary support means, said second form having a first end and a second end, securing said first end of said second form to said temporary support means, and positioning said second end of said second form adjacent to said second facing element, such that the step of placing reinforced concrete places reinforced concrete along the area of said retaining wall between said first and second forms, and such that the step of placing backfill material places backfill material along the area of said retaining wall exterior of said first and second forms.

16. The method of constructing a retaining wall of claim 11 wherein the step of forming an outer face further comprises:

positioning a second attachment means adjacent to said temporary support means, said second attachment means having a first end and a second end, securing said first end of said second attachment means to said temporary support means, and securing said second facing element to said second end of said second attachment means.

17. The method of constructing a retaining wall of claim 16 wherein the step of securing said first ends of said first and second attachment means to said temporary support means comprises securing said first ends of said first and second attachment means to said first end of said nail.

18. The method of constructing a retaining wall of claim 17 further comprising the steps of:

positioning first and second forms adjacent to said temporary support means, each of said first and second forms having first and second ends, securing said first ends of said first and second forms to said temporary support means, securing said first facing element to said second end of said first form, and securing said second facing element to said second end of said second form, such that the step of placing reinforced concrete places reinforced concrete along the area of said retaining wall between said first and second forms, and such that the step of placing backfill material places backfill material along the area of said retaining wall exterior of said first and second forms.

19. The method of constructing a retaining wall of claim 18 further comprising the steps of:

erecting a third facing element adjacent to said first and second facing elements, and securing said third facing element between said first and second facing elements, such that the step of placing reinforced concrete places reinforced concrete along the area of said retaining wall between said layer of pneumatically applied concrete and said first, second and third facing elements.

20. The method of constructing a retaining wall of claim 1 further comprising the step of:

providing a first anchor means for said first facing element and a second anchor means for said second facing element, a first end of each of said first and second anchor means extending from said respective first or second facing element in the area of said retaining wall adjacent to said first end of said nail, said first ends of said first and second anchor means extending towards said exposed cut face, wherein the step of providing said first and second anchor means occurs prior to the step of placing said reinforced concrete, said reinforced concrete thereby forming a permanent structural connection between said first and second facing elements and said nail by encasing said first end of said nail and said first ends of said first and second anchor means.

21. A method of constructing a retaining wall comprising the following steps:

excavating a cut in successive sections to form exposed cut faces;

temporarily shoring up the exposed cut face of each successively excavated section with a temporary support means, said temporary support means comprising a nail installed through the exposed cut face into the ground, a first end of said nail extending outwardly from said exposed cut face; and forming an outer face by positioning first and second forms adjacent to said exposed cut face, each of said first and second forms having a first end and a second end, securing said first ends of said first and second forms to said exposed cut face, erecting a first facing element, positioning said second end of said first form adjacent to said first facing element, erecting a second facing element adjacent to said first facing element, positioning said second end of said second form adjacent to said second facing element, placing reinforced concrete along the area of said retaining wall adjacent to said first end of said nail between said exposed cut face, said first and second facing elements, and said first and second forms, said reinforced concrete thereby forming a permanent structural connection between said first and second facing elements and said nail by encasing said first end of said nail, and placing backfill material along the area of said retaining wall exterior of said first and second forms.

22. The method of constructing a retaining wall of claim 21 wherein the step of securing said first ends of said first and second forms to said exposed cut face comprises securing said first ends of said first and second forms directly to said exposed cut face.

23. The method of constructing a retaining wall of claim 21 further comprising the step of:

positioning an attachment means adjacent to said exposed cut face, said attachment means having a first end and a second end, securing said first end of said attachment means to said exposed cut face, and securing said second end of said attachment means to said first facing element.

24. The method of constructing a retaining wall of claim 21 wherein said temporary support means further comprises a layer of barrier material disposed along the exposed cut face.

25. The method of constructing a retaining wall of claim 21 wherein said temporary support means further comprises a layer of pneumatically applied concrete, and wherein the step of securing said first ends of said first and second forms to said exposed cut face comprises securing said first ends of said first and second forms to said temporary support means through said layer of pneumatically applied concrete.

26. The method of constructing a retaining wall of claim 25 further comprising the step of:

positioning an attachment means adjacent to said temporary support means, said attachment means having a first end and a second end, securing said first end of said attachment means to said temporary support means through said layer of pneumatically applied concrete, and securing said second end of said attachment means to said first facing element.

27. The method of constructing a retaining wall of claim 21 wherein said second end of said first form is secured to said first facing element.

28. The method of constructing a retaining wall of claim 21 further comprising the step of:

providing a first anchor means for said first facing element and a second anchor means for said second facing element, a first end of each of said first and second anchor means extending from said respective first or second facing element in the area of said retaining wall adjacent to said first end of said nail, said first ends of said first and second anchor means extending towards said exposed cut face, wherein the step of providing said first and second anchor means occurs prior to the step of placing said reinforced concrete, said reinforced concrete thereby forming a permanent structural connection between said first and second facing elements and said nail by encasing said first end of said nail and said first ends of said first and second anchor means.

29. A method of constructing a retaining wall comprising the following steps:

excavating a cut in successive sections to form exposed cut faces;

temporarily shoring up the exposed cut face of each successively excavated section with a temporary support means, said temporary support means comprising a nail installed through the exposed cut face into the ground, a first end of said nail extending outwardly from said exposed cut face; and forming an outer face by positioning first and second attachment means adjacent to said exposed cut face, each of said first and second attachment means having a first end and a second end, securing said first ends of said first and second attachment means to said exposed cut face through said first end of said nail, erecting a first facing element, securing said first facing element to said second end of said first attachment means, erecting a second facing element adjacent to said first facing element, securing said second facing element to said second end of said second attachment means;

positioning first and second forms adjacent to said exposed cut face, each of said first and second forms having first and second ends, securing said first ends of said first and second forms to said exposed cut face, securing said first facing element to said second end of said first form, securing said second facing element to said second end of said second form, placing reinforced concrete along the area of said retaining wall adjacent to said first end of said nail between said exposed cut face, said first and second facing elements, and said first and second forms, said reinforced concrete thereby forming a permanent structural connection between said first and second facing elements and said nail by encasing said first end of said nail, and placing backfill material along the area of said retaining wall between said exposed cut face and said first and second facing elements exterior of said first and second forms.

30. The method of constructing a retaining wall of claim 29 wherein said temporary support means further comprises a layer of barrier material disposed along the exposed cut face.

31. The method of constructing a retaining wall of claim 29 wherein said temporary support means further comprises a layer of pneumatically applied concrete, and wherein the step of securing said first ends of said first and second forms to said exposed cut face comprises securing said first ends of said first and second forms to said temporary support means through said layer of pneumatically applied concrete.

32. The method of constructing a retaining wall of claim 29 further comprising the step of:

providing a first anchor means for said first facing element and a second anchor means for said second facing element, a first end of each of said first and second anchor means extending from said respective first or second facing element in the area of said retaining wall adjacent to said first end of said nail, said first ends of said first and second anchor means extending towards said exposed cut face, wherein the step of providing said first and second anchor means occurs prior to the step of placing said reinforced concrete, said reinforced concrete thereby forming a permanent structural connection between said first and second facing elements and said nail by encasing said first end of said nail and said first ends of said first and second anchor means.

33. The method of constructing a retaining wall of claim 29 further comprising the steps of:

erecting a third facing element adjacent to said first and second facing elements, and securing said third facing element between said first and second facing elements, such that the step of placing said reinforced concrete places reinforced concrete along the area of said retaining wall between said exposed cut face, said first, second and third facing elements, and said first and second forms.

34. A retaining wall for a cut which is excavated in successive sections to form exposed cut faces, said retaining wall comprising:

a temporary support means supporting the exposed cut face of each successively excavated section, said temporary support means comprised of a nail installed through the exposed cut face into the ground, a first end of said nail extending outwardly from said exposed cut face; and an outer face, said outer face comprised of first and second facing elements, first and second forms positioned adjacent to said exposed cut face, each of said first and second forms having a first end and a second end, said first ends of said first and second forms secured to said exposed cut face, said second end of said first form positioned adjacent to said first facing element, said second end of said second form positioned adjacent to said second facing element, reinforced concrete, wherein said reinforced concrete is placed along the area of said retaining wall adjacent to said first end of said nail, and wherein said reinforced concrete is placed between said exposed cut face, said first and second facing elements, and said first and second forms, said reinforced concrete thereby forming a permanent structural connection between said first and second facing elements and said nail by encasing said first end of said nail, and backfill material, wherein said backfill material is placed along the area of said retaining wall between said exposed cut face and said first and second facing elements exterior of said first and second forms.

35. The retaining wall of claim 34 further comprising an attachment means positioned adjacent to said exposed cut face, said attachment means having a first end and a second end, said first end of said attachment means secured directly to said exposed cut face, and said second end of said attachment means secured to said first facing element.

36. The method of constructing a retaining wall of claim 34 wherein said temporary support means further comprises a layer of barrier material disposed along the exposed cut face.

37. The retaining wall of claim 34 wherein said temporary support means further comprises a layer of pneumatically applied concrete, and wherein said first ends of said first and second forms are secured to said exposed cut face through said layer of pneumatically applied concrete.

38. The retaining wall of claim 37 further comprising an attachment means positioned adjacent to said temporary support means, said attachment means having a first end and a second end, said first end of said attachment means secured to said temporary support means through said layer of pneumatically applied concrete, and said second end of said attachment means secured to said first facing element.

39. The retaining wall of claim 34 wherein said second end of said first form is secured to said first facing element.

40. The retaining wall of claim 34 further comprising a first anchor means for said first facing element and a second anchor means for said second facing element, wherein a first end of each of said first and second anchor means extends from said respective first or second facing element in the area of said retaining wall adjacent to said first end of said nail, wherein said first ends of said first and second anchor means extend towards said exposed cut face, and wherein said first ends of said first and second anchor means are encased in said reinforced concrete, said reinforced concrete thereby forming a permanent structural connection between said first and second facing elements and said nail by encasing said first end of said nail and said first ends of said first and second anchor means.

41. The retaining wall of claim 34 wherein said first end of said nail includes a first bearing plate and a first threaded fastening means.

42. The retaining wall of claim 41 wherein said first bearing plate includes an embedment anchor means, wherein said embedment anchor means extends away from said exposed cut face, and wherein said embedment anchor means is encased in said reinforced concrete.

43. The retaining wall of claim 41 wherein said first end of said nail further includes a second bearing plate and a second threaded fastening means, and wherein said second bearing plate and said second threaded fastening means are encased in said reinforced concrete.

44. The retaining wall of claim 34 wherein said first and second facing elements are formed from precast concrete.

45. The retaining wall of claim 34 wherein said first and second facing elements are comprised of one or more masonry blocks.

46. The retaining wall of claim 34 wherein said first and second facing elements are comprised of one or more Ivany Blocks®.

47. The retaining wall of claim 34 wherein said backfill material is free-draining granular material.

48. The retaining wall of claim 34 wherein said reinforced concrete is reinforced pneumatically applied concrete.

49. The retaining wall of claim 34 wherein said reinforced concrete is reinforced cast-in-place concrete.

50. The retaining wall of claim 34 wherein said first and second facing elements each have front and rear surfaces, and further comprising a layer of insulation disposed along the rear surfaces of each of said first and second facing elements.

51. A retaining wall for a cut which is excavated in successive sections to form exposed cut faces, said retaining wall comprising:

a temporary support means supporting the exposed cut face of each successively excavated section, said temporary support means comprised of a nail installed through the exposed cut face into the ground, a first end of said nail extending outwardly from said exposed cut face; and an outer face, said outer face comprised of first and second attachment means disposed adjacent to said exposed cut face, each of said first and second attachment means having a first end and a second end, said first ends of said first and second attachment means secured to said exposed cut face through said first end of said nail, first and second facing elements, said first facing element secured to said second end of said first attachment means, said second facing element secured to said second end of said second attachment means, and first and second forms positioned adjacent to said exposed cut face, each of said first and second forms having first and second ends, said first ends of said first and second forms secured to said exposed cut face, said first facing element secured to said second end of said first form, said second facing element secured to said second end of said second form, reinforced concrete, wherein said reinforced concrete is placed along the area of said retaining wall adjacent to said first end of said nail such that said first end of said nail is encased in said reinforced concrete, and wherein said reinforced concrete is placed between said exposed cut face, said first and second facing elements, and said first and second forms, said reinforced concrete thereby forming a permanent structural connection between said first and second facing elements and said nail by encasing said first end of said nail, and backfill material, wherein said backfill material is placed along the area of said retaining wall between said exposed cut face and said first and second facing elements exterior of said first and second forms.

52. The retaining wall of claim 51 wherein said temporary support means further comprises a layer of barrier material disposed along the exposed cut face.

53. The retaining wall of claim 51 wherein said temporary support means further comprises a layer of pneumatically applied concrete, and wherein said first ends of said first and second forms are secured to said exposed cut face through said layer of pneumatically applied concrete.

54. The retaining wall of claim 51 further comprising a first anchor means for said first facing element and a second anchor means for said second facing element, wherein a first end of each of said first and second anchor means extends from said respective first or second facing element in the area of said retaining wall adjacent to said first end of said nail, wherein said first ends of said first and second anchor means extend towards said exposed cut face, and wherein said first ends of said first and second anchor means are encased in said reinforced concrete, said reinforced concrete thereby forming a permanent structural connection between said first and second facing elements and said nail by encasing said first end of said nail and said first ends of said first and second anchor means.

55. The retaining wall of claim 51 wherein said first end of said nail includes a first bearing plate and a first threaded fastening means.

56. The retaining wall of claim 55 wherein said first bearing plate includes an embedment anchor means, wherein said embedment anchor means extends away from said exposed cut face, and wherein said embedment anchor means is encased in said reinforced concrete.

57. The retaining wall of claim 55 wherein said first end of said nail further includes a second bearing plate and a second threaded fastening means, and wherein said second bearing plate and said second threaded fastening means are encased in said reinforced concrete.

58. The retaining wall of claim 51 further comprising a third facing element disposed adjacent to said first and second facing elements, wherein said third facing element is secured between said first and second facing elements, and wherein said reinforced concrete is placed along the area of said retaining wall between said exposed cut face, said first, second and third facing elements, and said first and second forms.

59. The retaining wall of claim 58 wherein said first, second and third facing elements are formed from precast concrete.

60. The retaining wall of claim 58 wherein said first, second and third facing elements are comprised of one or more masonry blocks.

61. The retaining wall of claim 58 wherein said first, second and third facing elements are comprised of one or more Ivany Blocks®.

62. The retaining wall of claim 51 wherein said first and second forms are flexible.

63. The retaining wall of claim 51 wherein said backfill material is freed-draining granular material.

64. The retaining wall of claim 51 wherein said reinforced concrete is reinforced pneumatically applied concrete.

65. The retaining wall of claim 51 wherein said reinforced concrete is reinforced cast-in-place concrete.

66. The retaining wall of claim 51 wherein said first, second and third facing elements each have front and rear surfaces, and further comprising a layer of insulation disposed along the rear surfaces of each of said first, second and third facing elements.

* * * * *